US005619312A

United States Patent [19]

Hatano et al.

[11] Patent Number: 5,619,312

[45] Date of Patent: Apr. 8, 1997

[54] DEVELOPING DEVICE WITH DEVELOPER-SUPPLYING MECHANISM

[75] Inventors: Shintarou Hatano, Hiroshima; Hiroshi Kawahito, Kitakatsuragi-gun; Yoshiki Ichikawa, Shiki-gun; Fumito Mizoguti, Yamatokoriyama; Masahiro Tsuji, Nara; Takao Hiroyasu, Nara; Hiroshi Kawamoto, Nara; Syouichi Fujita, Kashiba; Hideyuki Nishimura, Yamatokoriyama; Itaru Kawabata, Kashiba; Yuichi Kazaki, Yamatokoriyama, all of Japan

[73] Assignee: Sharp Kabushiki Kaisha, Osaka, Japan

[21] Appl. No.: 335,948

[22] Filed: Nov. 8, 1994

[30] Foreign Application Priority Data

| | | | |
|---|---|---|---|
| Nov. 10, 1993 | [JP] | Japan | 5-281535 |
| Nov. 11, 1993 | [JP] | Japan | 5-282441 |
| Mar. 2, 1994 | [JP] | Japan | 6-032618 |

[51] Int. Cl.[6] ..... G03G 15/08; G03G 21/00

[52] U.S. Cl. ..... 399/61; 399/263

[58] Field of Search ..... 355/200, 210, 355/245, 246, 260

[56] References Cited

U.S. PATENT DOCUMENTS

| | | | |
|---|---|---|---|
| 4,614,165 | 9/1986 | Folkins et al. | 118/657 |
| 4,901,115 | 2/1990 | Nakamura et al. | 355/246 |
| 5,045,884 | 9/1991 | Ohira et al. | 355/245 |
| 5,250,749 | 10/1993 | Aimoto | 355/245 X |
| 5,430,530 | 7/1995 | Ott et al. | 355/260 |
| 5,430,532 | 7/1995 | Ueda et al. | 355/260 |
| 5,450,178 | 9/1995 | Kawashima et al. | 355/260 |

FOREIGN PATENT DOCUMENTS

| | | |
|---|---|---|
| 57-011357A | 1/1982 | Japan . |
| 60-189775A | 9/1985 | Japan . |
| 62-165677A | 7/1987 | Japan . |
| 62-264069A | 11/1987 | Japan . |
| 63-088580A | 4/1988 | Japan . |
| 1-188877A | 7/1989 | Japan . |
| 2-063080A | 3/1990 | Japan . |
| 2-216167A | 8/1990 | Japan . |
| 3-169333A | 7/1991 | Japan . |
| 3-221980A | 9/1991 | Japan . |

*Primary Examiner*—Fred L. Braun
*Attorney, Agent, or Firm*—David G. Conlin; Milton Oliver

[57] ABSTRACT

A developing device incorporating a developer supply unit and a developer discharge section, in which a supply developer including a mixture of toner and carrier is successively supplied to a developer container from the developer supply unit and a deteriorated developer in the developer container is discharged through the developer discharge section. The developer supply unit has a sponge roller for selectively attracting toner to a surface thereof, a magnet roller for selectively attracting carrier to a surface thereof, and a member for scraping and bringing the toner and carrier attracted to these rollers into the developer container. The developer including toner and carrier in a predetermined ratio is thus stably supplied to the developer container. In another example of the developer supply unit, agitating of the developer is performed while shovelling the developer deposited in a lower part of the unit by a transport screw. With this structure, since the toner and carrier are evenly mixed in the unit, the developer having a uniform toner concentration is supplied to the developer container, thereby continuing satisfactory development.

56 Claims, 46 Drawing Sheets

DEVELOPING DEVICE WITH DEVELOPER-SUPPLYING MECHANISM

FIELD OF THE INVENTION

The present invention relates to a developing device which stores a two-component developer including toner and carrier, and supplies the toner to the surface of a photoreceptor in an electrophotographic apparatus such as a copying machine so as to develop an electrostatic latent image formed on the photoreceptor surface into a visible form.

BACKGROUND OF THE INVENTION

For example, a developing device which develops an electrostatic latent image on a photoreceptor surface into a visible form using a two-component developer including carrier and toner is often used in dry-type copying machines. In such a developing device, the toner is consumed during a developing operation, while the carrier is not consumed and remains in the developing device. Consequently, the carrier deteriorates as the carrier and the toner in the developing device are frequently agitated. Then, a resin coat layer on the surface of the carrier is removed and the toner adheres to the surface thereof. As a result, the charging performance of the developer is gradually degraded.

In order to solve such a problem, for example, Japanese Publication for Examined Patent Application No. 21591/1990 discloses a device which restrains the degradation of the charging performance by continuously supplying a small amount of carrier to the developing device as well as toner that is consumed during a developing operation.

For example, as illustrated in FIG. 55, a developing device 108 includes a developer container 116 having therein a rotatable developing roller 117 formed by a magnet roller, and a rotatable agitating roller 118. Developer held in the developer container 116 is composed of carrier and toner. The carrier is formed by a magnetic substance and includes a resin coat layer for restraining the toner from adhering to the carrier surface. When the carrier and the toner are agitated by the agitating roller 118, the toner is charged by friction. The developing roller 117 transports the carrier by attracting the carrier with a magnetic force and forming a magnetic brush. The toner attracted to the carrier by Coulomb force is supplied to a photoreceptor 104 and attracted to the electrostatic latent image on the photoreceptor 104, thereby developing the image. The length of the magnetic brush is regulated by a doctor 119.

An opening for the supply of the developer is formed in a top wall 116*a* of the developer container 116. A developer supply unit 120 is placed above the opening so that it fits into the opening. The developer supply unit 120 is separated into two rooms, a toner storage 120*a* and a carrier storage 120*b*. The toner storage 120*a* stores toner, and the carrier storage 120*b* stores carrier only.

Disposed at the bottom of the storages 120*a* and 120*b* are a developer supply roller 121 and a carrier supply roller 122. As the developer supply roller 121 and the carrier supply roller 122 are rotated, the toner and the carrier in the toner storage 120*a* and the carrier storage 120*b* flow downward into the developer container 116 during the time in which the rollers 121 and 122 are driven. The rollers 121 and 122 are driven according to a detection signal of a toner-concentration detecting sensor 123 incorporated into the developer container 116.

The excess developer caused by the supply of the carrier is discharged from the developer container 116 through a discharge opening 116*c* formed in a predetermined location of a developer wall section 116*b* by an overflow mechanism, and collected in a collecting container 124. By successively suppling the toner and carrier and discharging the developer in a repeated manner, the deteriorated developer in the developer container 116 is replaced with newly supplied toner and carrier. With this structure, the amount of developer in the developer container 116 is maintained uniform, the charging performance of the developer is maintained, and degradation of copy quality is restrained.

However, with the structure of the developing device 108, since the toner and the carrier are separately supplied to the developer container 116 by the detection signal of the toner-concentration detecting sensor 123, the toner and the carrier have not been sufficiently mixed immediately after the supplying process. If copying is performed using developer in such an insufficient mixing state, copy quality is degraded. For example, when copying is performed immediately after the supply of carrier, some areas may have very low densities. On the other hand, when copying is performed immediately after the supply of toner, images may become foggy or some toner spots may appear on a produced copy, resulting in degraded copy quality.

Another developing device has a developer supply unit 130. As illustrated in FIG. 56, the developer supply unit 130 stores in a developer storage 130*a* a high-dense developer including toner and carrier in a predetermined ratio, and supplies the developer in the developer container by rotating a developer supply roller 131 located under the developer storage 130*a*. This developing device has a simplified structure compared to that of the developing device shown in FIG. 55 but enables simultaneous supply of toner and carrier to the developer container 116.

However, the above-mentioned developing device suffers from the following drawbacks. Specifically, although the developer to be supplied has been arranged to have a predetermined toner concentration, when the developer is introduced into the developer storage 130*a*, the carrier whose specific gravity is larger than that of toner is deposited on the bottom. As a result, the balance of toner and carrier in the developer becomes uneven, the toner concentration becomes lower in a lower part 131 (indicated by hatching in FIG. 56) than in an upper part 132.

If developer having such an uneven toner concentration is supplied to the developer container 116, the amount of carrier in the developer in the developer container may abruptly increases or the toner concentration in the developer therein may be unexpectedly increased. Such variations in the toner concentration in developer which is to be supplied to the developer container 116 prevent expected replacement of the deteriorated developer, thereby failing to maintain a desirable replacement ratio. Consequently, the charging performance of the developer in the developing device varies, resulting in degraded copy quality.

SUMMARY OF THE INVENTION

It is an object of the present invention to provide a developing device capable of maintaining satisfactory copy quality by stably supplying toner and carrier in a predetermined ratio to a developer container.

In order to achieve the above object, a developing device of the present invention includes:

a developer container for storing a developer including toner and carrier;

agitating means for agitating the developer in the developer container;

a developing roller for bringing the developer in the developer container agitated by the agitating means into contact with the electrostatic latent image;

developer supply means for successively supplying a supply developer including toner and carrier to the developer container; and developer discharge means for discharging the developer in the developer container as the supply developer is supplied to the developer container by the developer supply means, the developer supply means including:

a supply-developer storage section, disposed above the developer container, for storing the supply developer including a mixture of toner and carrier;

a toner attracting member, disposed at the bottom of the supply-developer storage section, for selectively attracting toner to a surface thereof;

a carrier attracting member, disposed at the bottom of the supply-developer storage section, for selectively attracting carrier to a surface thereof; and scraper means for scraping and bringing the toner and the carrier from the surfaces of the toner attracting member and the carrier attracting member into the developer container.

With this structure, the toner in the developer in the supply-developer storage section is mainly attracted to the toner attracting member, while the carrier in the developer is mainly attracted to the carrier attracting member. The developer in the supply-developer storage section is supplied to the developer container by scraping the attracted toner and carrier from the surfaces of the toner attracting member and the carrier attracting member and bringing them into the developer container using the scraper means. At this time, a predetermined amount of toner is attracted to the toner attracting member and a predetermined amount of carrier is attracted to the carrier attracting member irrespectively of the mixing state of the toner and carrier in the supply-developer storage section. It is therefore possible to stably supply the toner and the carrier in a predetermined ratio to the developer container, and continue to perform satisfactory development.

With this structure, it is desirable to form the toner attracting member and the carrier attracting member as a single rotatable roller. In this case, the ratio of toner to carrier supplied to the developer container is determined by a ratio of the toner attracting member to the carrier attracting member on a roller surface.

It is also possible to form the toner attracting member and the carrier attracting member as separate rollers. In this case, by controlling the rotation speed and the rotation time of each roller according to an output of the toner-concentration detecting means for detecting a toner concentration in the developer in the developer container, the toner and the carrier in an appropriate ratio corresponding to the toner concentration in the developer container is supplied to the developer container.

Moreover, if the carrier attracting member is formed by an electromagnet, by changing the value of electric power to be supplied to the electromagnet, a magnetic force of the carrier attracting member is varied and thus an amount of carrier to be attracted to the carrier attracting member is varied. Accordingly, the amount of carrier to be supplied to the developer container is easily adjusted.

Another object of the present invention is to provide a developing device capable of restraining degradation of charging performance of a developer to maintain satisfactory image quality by evenly mixing toner and carrier in a supply unit and by supplying the mixture to a developing device while maintaining a uniform toner concentration.

In order to achieve the above object, a developing device of the present invention includes:

a developer container for storing a developer including toner and carrier;

agitating means for agitating the developer in the developer container;

a developing roller for bringing the developer in the developer container agitated by the agitating means into contact with the electrostatic latent image;

developer supply means for successively supplying a supply developer including toner and carrier to the developer container; and developer discharge means for discharging the developer in the developer container as the supply developer is supplied to the developer container by the developer supply means, the developer supply means including:

a supply-developer storage section for storing the supply developer including a mixture of toner and carrier;

at least one transporting means, disposed in the supply-developer storage section, for transporting the developer deposited in a lower part of the supply-developer storage section toward an upper part thereof; and driving means for changing relative positions of the transporting means in the supply-developer storage section and the supply-developer storage section by driving at least one of the supply-developer storage section and the transporting means, for agitating the supply developer in the supply-developer storage section, wherein the toner and the carrier in the supply-developer storage section are evenly mixed by changing the relative positions of the transporting means and the supply-developer storage section by the driving means while transporting the developer deposited in the lower part of the supply-developer storage section toward the upper part thereof by the transporting means.

When the developer including toner and carrier is introduced into the supply-developer storage section, the carrier whose specific gravity is heavier than that of the toner is deposited in the lower part of the supply-developer storage section, while the toner having a lighter specific gravity stays in the upper part thereof. Consequently, the mixing state of the toner and the carrier in the supply-developer storage section becomes uneven, and the toner concentration in the lower part becomes higher than that in the upper part. However, with the above-mentioned structure, since the toner and the carrier in the supply-developer storage section are evenly mixed, the developer is supplied to the developer container while maintaining a uniform toner concentration. As a result, the replacement ratio of the developer in the developing device is maintained uniform, and satisfactory development continues.

In order to achieve the above object, another developing device of the present invention includes:

a developer container for storing a developer including toner and carrier;

agitating means for agitating the developer in the developer container;

a developing roller for bringing the developer in the developer container agitated by the agitating means into contact with the electrostatic latent image;

developer supply means for successively supplying a supply developer including toner and carrier to the developer container; and developer discharge means for discharging the developer in the developer container as the supply developer is supplied to the developer container by the developer supply means, the developer supply means including:

a supply-developer storage section for storing the supply developer including a mixture of toner and carrier;

developer transporting means, disposed in the supply-developer storage section, for transporting the developer in the developer storage section to the developer container; and developer providing means for providing the developer in the supply-developer storage section to the developer transporting means while agitating the developer.

Since the structure includes the developer providing means for supplying the developer to the developer transporting means while agitating the developer in the supply-developer storage section, the developer including substantially evenly mixed toner and carrier is supplied to the developer container. As a result, a uniform replacement ratio of the carrier is maintained in the developing device, and satisfactory development continues.

With this structure, the developer transporting means preferably includes:

a developer receiving section, disposed in a longitudinal direction of the supply-developer storage section with a predetermined space from the bottom the supply-developer storage section, for receiving the developer provided by the developer providing means; and a developer transporting section for transporting the developer supplied to the developer receiving section to the developer container, and the developer providing means preferably includes a collecting member having a shovelling section arranged in a longitudinal direction of the supply-developer storage section, the collecting member collecting the developer deposited in the lower part of the supply-developer storage section by the shovelling section and supplying the developer to the developer receiving section while rotating around the developer receiving section.

With such a structure, since the developer providing means shovels the developer from the lower part of the supply-developer storage section and supplies the developer to the developer receiving section, it is possible to prevent the carrier from remaining in the lower part of the supply-developer storage section, thereby achieving satisfactory agitation of toner and carrier.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a schematic cross section of a developing device according to Embodiment 1 of the present invention.

FIG. 54 is a flowchart showing how the control device of FIG. 53 controls the driving of a collecting member.

FIG. 55 is a schematic cross section of a conventional developing device.

FIG. 56 is a schematic cross section of another conventional developing device.

DETAILED DESCRIPTION OF THE PREFERRED EMBODIMENTS

[Embodiment 1]

The following description discusses one embodiment of the present invention with reference to FIGS. 1 to 4.

Figure 2:
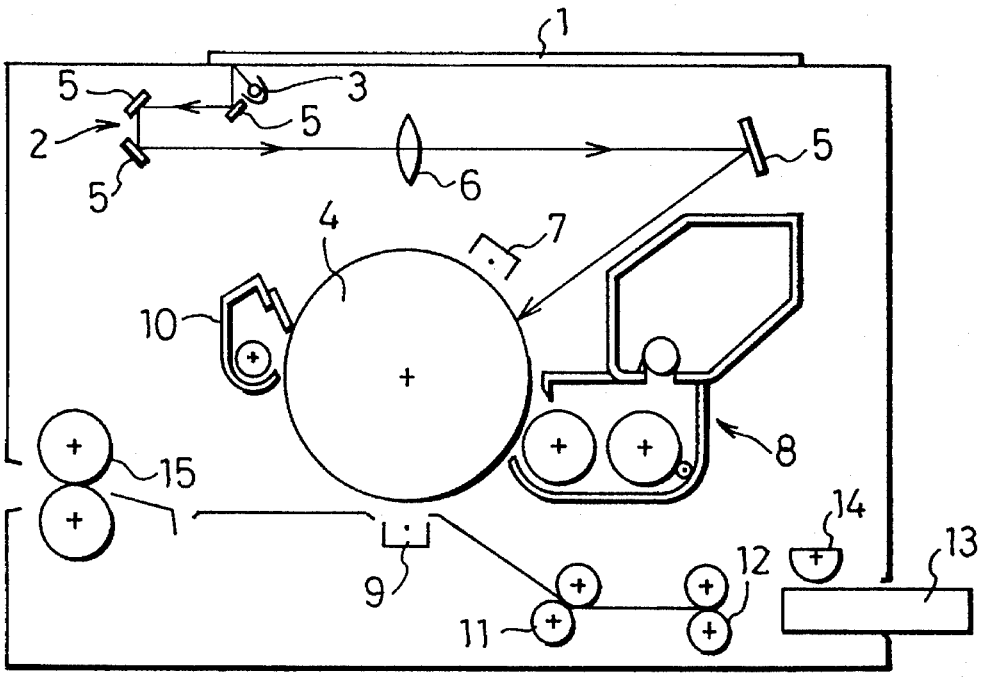
FIG. 2 illustrates a schematic structure of a copying machine incorporating the developing device of FIG. 1.

FIG. 2 illustrates a schematic structure of a copying machine incorporating a developing device of the present invention. The copying machine includes a document platen 1 located on an upper surface thereof, and an exposure optical system 2 disposed below the document platen 1. The exposure optical system 2 is formed by a light source lamp 3 which scans a document (not shown) placed on the document platen 1 while applying light to the document, a plurality of reflecting mirrors 5 for directing reflected light from the document toward a photoreceptor 4, and a lens unit 6 disposed on the light path of the reflected light.

Disposed around the photoreceptor 4 are a charger 7 for charging the surface of the photoreceptor 4 to a predetermined potential, an eraser (not shown), a developing device 8 for developing an electrostatic latent image formed on the surface of the photoreceptor 4, a transfer charger 9 for transferring the toner image from the surface of the photoreceptor 4 to a sheet, a cleaning device 10 for collecting residual toner on the surface of the photoreceptor 4, and a discharging device (not shown). Timing rollers 11 for timely supplying a sheet, transport rollers 12, a sheet feed cassette 13, and a feed roller 14 are positioned on one side of the photoreceptor 4 from which a sheet is fed toward the photoreceptor 4. A fixing device 15 for fixing the toner image on the sheet is located on the other side of the photoreceptor 4 through which the sheet is discharged.

Figure 1:
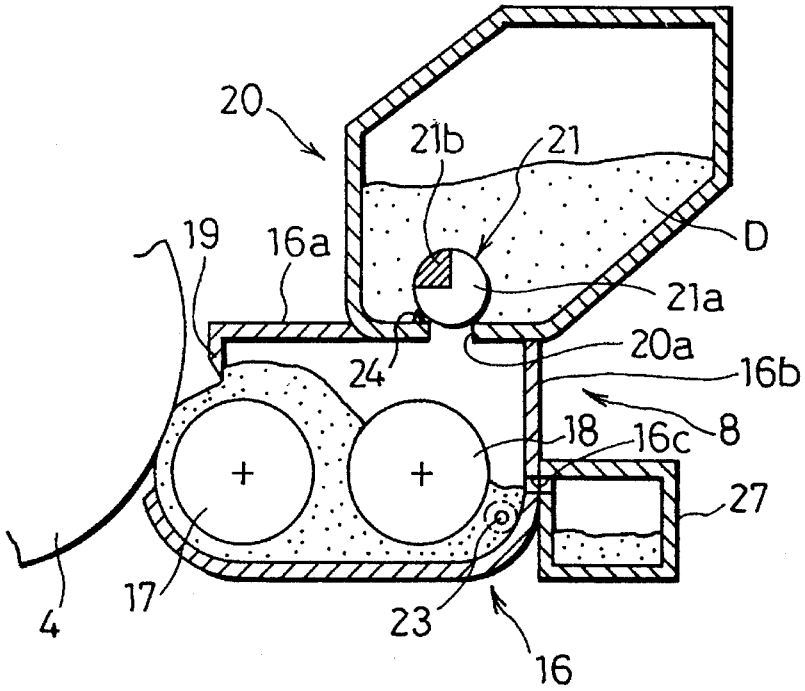
FIGS. 1 to 54 illustrate some embodiments of the present invention.

As illustrated in FIG. 1, the developing device 8 includes a developer container 16 having therein a developing roller 17 formed by a magnet roller, and an agitating roller 18 (agitating means). The developing roller 17 and the agitating roller 18 are rotatably mounted. A developer stored in the developer container 16 includes carrier and toner. The carrier made of a magnetic substance has a resin coat layer for restraining the toner from adhering to the carrier surface. When the carrier and the toner are agitated by the agitating roller 18, the toner is charged by friction. The developing roller 17 transports the carrier by attracting the carrier with a magnetic force and forming a magnetic brush. At this time, developing is performed by supplying the toner adhering to the carrier due to the Coulomb force to the photoreceptor 4 and attracting the toner to the electrostatic latent image on the photoreceptor 4. The length of the magnetic brush is regulated by a doctor 19.

A developer supply opening is formed in a top wall 16*a* of the developer container 16. A developer supply unit (developer supply section) 20 is positioned above the developer supply opening so as to fit into the opening. The developer supply unit 20 contains a developer D including a mixture of toner and carrier.

A developer supply roller 21 (developer supply means) is rotatably mounted at the bottom of the developer supply unit 20. Also, formed on the bottom of the developer supply unit 20 is an opening 20*a* which is connected to the developer supply opening formed in the top wall 16*a* of the developer container 16. As the developer supply roller 21 is rotated, the developer D in the developer supply unit 20 is supplied to the developer container 16.

The developer supply roller 21 includes a magnet member 21*a* and a sponge member 21*b* having a length equal to the length of the roller, respectively. The magnet member 21*a* is a permanent magnet, and mainly attracts the carrier in the developer D. The sponge member 21*b* mainly attracts the toner in the developer D.

The central angles of the roller with respect to the magnet member 21*a* and the sponge member 21*b* are set so that the ratio of toner to carrier becomes appropriate. In this embodiment, the developer supply roller 21 is arranged so that the central angles of the roller with respect to the magnet member 21*a* and the sponge member 21*b* are 1 to 3, i.e., 90° C. and 270° C., respectively. Consequently, the magnet member 21*a* and the sponge member 21*b* occupy one quarter and three quarters of the surface area of the roller, respectively. It is thus possible to attract the developer D having toner and carrier in an appropriate ratio to the surface of the developer supply roller 21.

In addition, a scraper 24 as developer scraping means is mounted at the opening 20*a* of the developer supply unit 20 so as to be in contact with the surface of the developer supply roller 21, for scraping and bringing the toner and the carrier attracted to the developer supply roller 21 into the developer container 16. Namely, the developer D including toner and carrier in an approximate ratio, attracted to the surface of the developer supply roller 21, is supplied to the developer container 16.

A developer collecting container 27 with an open side is freely attachable to and removable from a side wall 16*b* of the developer container 16. The side wall 16*b* has a developer output opening 16*c* for connecting the developer container 16 to the collecting container 27.

The developer container 16 is also provided with a toner-concentration detecting sensor 23 (toner-concentration detecting means) for detecting a toner concentration in the developer container 16. The toner-concentration detecting sensor 23 is a permeability sensor, and detects the permeability when brought into contact with the carrier of the developer container 16. The ratio of toner to the carrier is calculated from the detected permeability. For example, when the amount of carrier which comes into contact with the toner-concentration detecting sensor 23 is small, it is judged that the permeability is low and the toner ratio is high. On the other hand, when the amount of carrier which comes into contact with the toner-concentration detecting sensor 23 is large, it is judged that the permeability is high and the toner ratio is low. The detection signal of the toner-concentration detecting sensor 23 is input to a control device 32 shown in FIG. 3. According to the detection signal, a motor 25 for driving the developer supply roller 21 is driven, the developer supply roller 21 in the developer supply unit 20 is rotated, and the developer D is supplied to the developer container 16.

The amount of developer D supplied to the developer container 16 is controlled by the rotation time of the developer supply roller 21.

The control device 32 is connected to an alarm lamp 39 as warning means made of a light emitting diode. When a sensor, not shown, detects that the developing device 8 tilts by a degree which is out of the permissible tilt limit, the alarm lamp 39 informs about the tilted state.

Next, a copying operation performed in a copying machine having the above-mentioned structure is discussed below.

When an electric power switch (not shown) is turned on, a warm-up operation is performed. When a copying start switch 31, to be described later, is turned on after the warm-up operation, the light source lamp 3 of the exposure optical system 2 scans a document on the document platen 1. At this time, reflected light from the document is directed to the photoreceptor 4 by the reflecting mirrors 5 and the lens unit 6, and an electrostatic latent image is formed on the surface of the photoreceptor 4 which has been charged to a predetermined potential by the charger 7. Then, the electrostatic latent image is developed by the toner supplied from the developing device 8. The toner image on the surface of the photoreceptor 4 is transferred by the transfer charger 9 to a sheet supplied from the sheet feed cassette 13, and then fused onto the sheet by the fixing device 15. Accordingly, the image on the document is copied onto the sheet.

Figure 3:
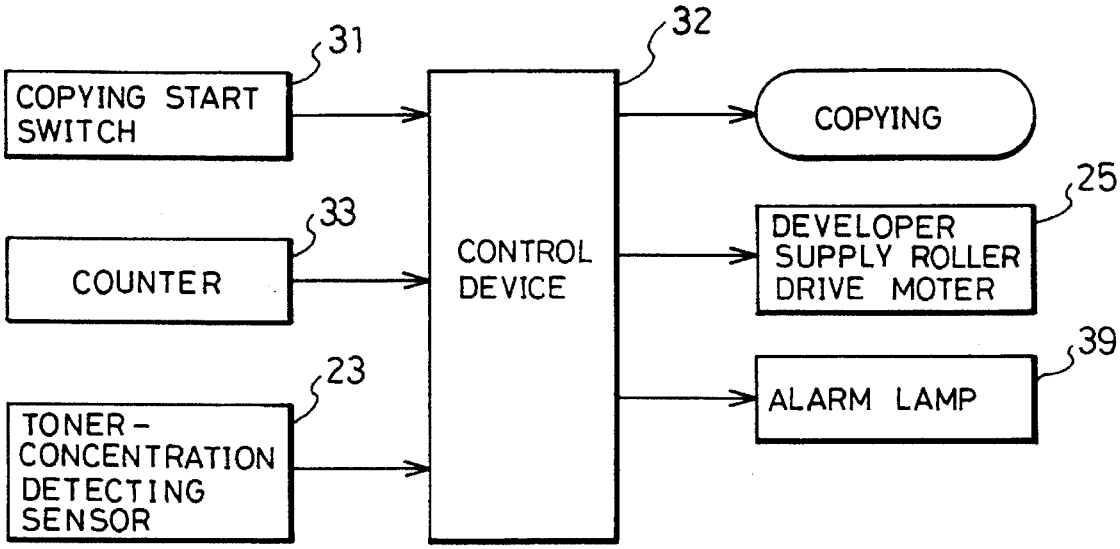
FIG. 3 is a control block diagram of a control device in the copying machine.

In order to control such a sequence of copying operation, as illustrated in FIG. 3, the control device 32 including a microcomputer is incorporated into the copying machine, and a signal for turning on the copying start switch 31 is input to the control device 32. A counter 33 for counting the total number of copying operations performed is provided. A value n counted by the counter 33 (hereinafter just referred to as the copy count) is also input to the control device 32.

When such a copying operation is repeatedly performed, the toner in the developer stored in the developer container 16 of the developing device 8 is gradually consumed. Then, the ratio of toner to carrier, i.e., the toner concentration decreases. In this embodiment, the toner-concentration detecting sensor 23 for detecting a change in the toner concentration is included in the developer container 16 as shown in FIG. 1. The developer supply roller 21 is driven in a manner described below under the control of the control device 32 according to the output of the toner-concentration detecting sensor 23. When a signal detected by the toner-concentration detecting sensor 23 indicates that the toner concentration is lowered to the lower limit of an appropriate development range, the motor 25 is driven. Then, the developer supply roller 21 is rotated. Thus, the developer D in the developer supply unit 20 is supplied into the developer container 16, and the toner concentration in the developer container 16 is increased. When the toner concentration reaches the upper limit of the appropriate range, the developer supply roller 21 is stopped rotating. With this control, the toner concentration in the developer container 16 is maintained within the appropriate range.

When the developer D in the developer unit 20 is supplied to the developer container 16 as described above, the deteriorated carrier whose charging performance has been degraded overflows through the developer output opening 16*c* and is collected in the developer collecting container 27. Since the developer D in the developer supply unit 20 contains carrier as well as toner mixed in a predetermined ratio, when the developer D is supplied to the developer container 16, the deteriorated carrier whose charging performance has been degraded is replaced with new carrier in the developer D. Since the deteriorated carrier is always replaced with new carrier, it is possible to prevent the deteriorated carrier from degrading the charging performance. Consequently, unsatisfactory charging resulted from the degraded charging performance of the carrier is prevented.

As described above, in this embodiment, when suppling the developer D to the developer container 16 from the developer supply unit 20 at the time the toner concentration is lowered, the toner and the carrier in a predetermined ratio are stably supplied to the developer container 16 by the developer supply roller 21. This structure prevents sudden increases in the toner concentration and in the amount of the carrier in the developer in the developer container 16. It is thus possible to prevent toner spots and unexpected density decreases in some areas, thereby maintaining satisfactory copy quality.

In this embodiment, the developer supply roller 21 is arranged so that the central angles of the roller with respect to the magnet member 21*a* and the sponge member 21*b* become 1 to 3. However, if the toner and the carrier are mixed in an appropriate ratio, the ratio of the magnet member 21*a* to the sponge member 21*b* may be suitably changed according to, for example, a magnetic force of the magnet member 21*a*.

Moreover, although a permanent magnet is used as the magnet member 21*a* in this embodiment, it is also possible to use an electromagnet. In this case, since the magnetic force is varied by changing the value of electric power to be supplied to the electromagnet, the amount of carrier to be attracted to the magnet member 21*a* is easily adjusted.

Figure 4:
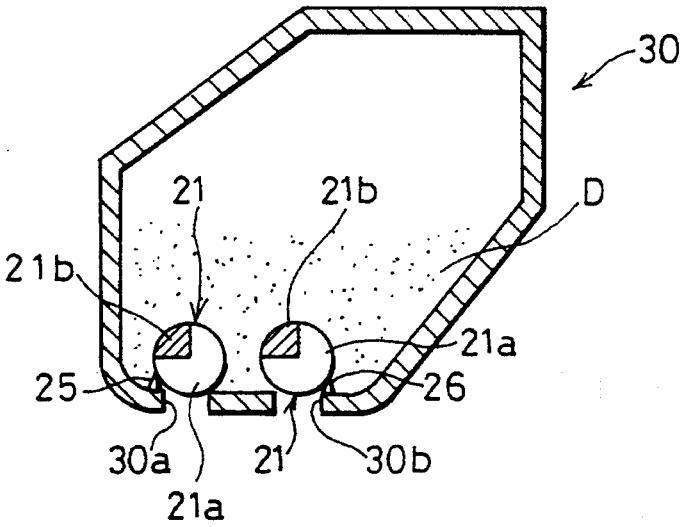
FIG. 4 is a schematic cross section of a modified example of a developer supply unit in the developing device of FIG. 1.

Furthermore, in this embodiment, the developer supply unit 20 includes one developer supply roller 21. However, it is possible to install a plurality of the developer supply rollers 21 in the developer supply unit 20. For instance, when two developer supply rollers 21 are included in the developer supply unit 20 as illustrated in FIG. 4, the toner and the carrier attracted to the roller surface are scraped by the developer scraper sections 25 and 26 in contact with the two developer supply rollers 21, and the developer D is discharged from the openings 30*a* and 30*b*. Consequently, the supply amount of the developer D is more easily adjusted compared to the former structure in which the developer D is discharged using a single developer supply roller 21. Accordingly, the developer D including toner and carrier in an approximate ratio is accurately supplied. As a result, the toner concentration in the developer container 16 becomes uniform, the amount of developer therein is stabilized, and satisfactory copy quality is maintained.

As described above, the developing device of this embodiment includes:

- a developer container for storing a developer including toner and carrier;
- agitating means for agitating the developer in the developer container;
- a developing roller for bringing the developer in the developer container agitated by the agitating means into contact with the electrostatic latent image;
- developer supply means for successively supplying a supply developer including toner and carrier to the developer container; and
- developer discharge means for discharging the developer in the developer container as the supply developer is supplied to the developer container by the developer supply means, the developer supply means including:

- a supply-developer storage section, disposed above the developer container, for storing the supply developer including a mixture of toner and carrier;
- a toner attracting member, disposed in a bottom portion of the supply-developer storage section, for selectively attracting toner to a surface thereof;
- a carrier attracting member, disposed in a bottom portion of the supply-developer storage section, for selectively attracting carrier to a surface thereof; and
- scraper means for scraping and bringing the toner and the carrier from the surfaces of the toner attracting member and the carrier attracting member into the developer container.

With this structure, since a uniform amount of toner is attracted to the toner attracting member and a uniform amount of carrier is attracted to the carrier attracting member irrespective of the mixing state of toner and carrier in the supply-developer storage section, the toner and the carrier in a uniform ratio are stably supplied to the developer container. As a result, satisfactory development continues.

Additionally, in the developing device of this embodiment having the above-mentioned structure, the toner attracting member and the carrier attracting member are formed as a single rotatable roller.

With this structure, if the ratio of the toner attracting member to the carrier attracting member on the roller surface is appropriately set, the toner and the carrier in an appropriate ratio are stably supplied to the developer container.

[Embodiment 2]

Figure 5:
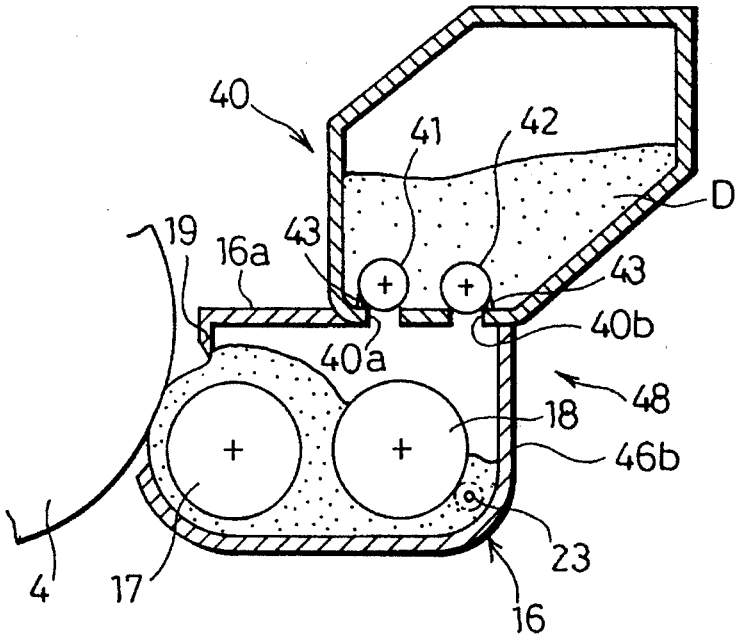
FIG. 5 is a schematic cross section of a developing device according to Embodiment 2 of the present invention.
Figure 6:
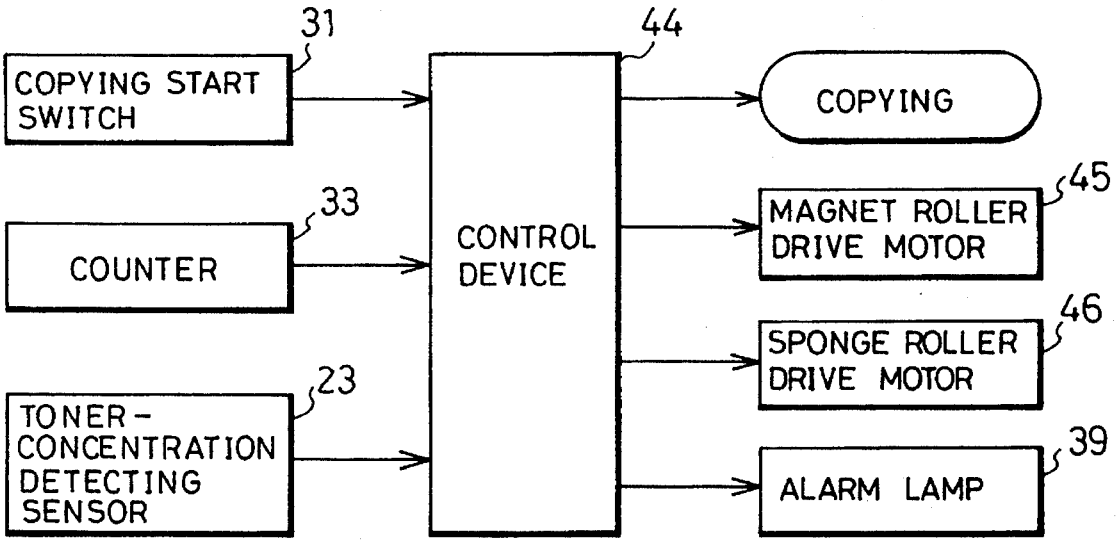
FIG. 6 is a control block diagram of a copying machine incorporating the developing device shown in FIG. 5.

The following description discusses a second embodiment of the present invention with reference to FIGS. 5 and 6.

The members having the same structure and function as in the above-mentioned embodiments will be designated by the same reference numerals and their description will be omitted.

As illustrated in FIG. 5, a developing device 48 of this embodiment includes a developer supply unit 40 instead of the developer supply unit 20 in the developing device 8 of Embodiment 1.

A magnet roller 41 and a sponge roller 42 as developer supply means are rotatably mounted on the bottom of the developer supply unit 40. As the magnet roller 41 and the sponge roller 42 are rotated, the developer D stored in the developer supply unit 40 is supplied to the developer container 16 through openings 40*a* and 40*b*. The openings 40*a* and 40*b* are connected to developer supply openings (not shown) formed in the upper surface of the developer container 16.

In addition, scrapers 43 as developer scraping means are mounted at the openings 40*a* and 40*b* of the developer supply unit 40 so as to be in contact with the surfaces of the magnet roller 41 and the sponge roller 42. The toner attracted to the sponge roller 42 is scraped by the scraper 43 and supplied to the developer container 16 as the sponge roller 42 is rotated. Meanwhile the carrier attracted to the magnet roller 41 is scraped by the scraper 43 and supplied to the developer container 16 as the magnet roller 41 is rotated.

The magnet roller 41 and the sponge roller 42 are driven under the control of a magnet-roller drive motor 45 and a sponge-roller drive motor 46 connected to a control device 44 shown in FIG. 6. The ratio of toner to carrier to be supplied to the developer container 16 is controlled by changing the ratio of rotation speed between the magnet roller 41 and the sponge roller 42.

In general, a suitable rotation speed ratio between the magnet roller 41 and the sponge roller 42 is about 1 to 3. With such a ratio, the ratio of toner to carrier becomes appropriate. This value is obtained based on the formation ratio 1 to 3 of the magnet member 21*a* and the sponge member 21*b* of the developer supply roller 21 of Embodiment 1. In this embodiment, a developer including toner and carrier in an appropriate ratio is obtained by controlling the magnet roller 41 and the sponge roller 42 to be rotated between 5 rpm and 10 rpm and between 10 rpm and 30 rpm, respectively.

As described above, with the structure of the developing device 48, since the developer supply means includes the magnet roller 41 and the sponge roller 42, the developer including toner and carrier in an appropriate ratio is stably supplied to the developer container 16 by adjusting the rotation speed ratio between the magnet roller 41 and the sponge roller 42.

Since the developer including sufficiently mixed toner and carrier in an appropriate ratio is supplied according to a toner concentration in the developer container 16, the toner concentration in the developer container 16 and the amount of developer therein are always maintained uniform. It is thus possible to prevent copy quality from being degraded due to insufficient agitation of toner and carrier in the developer container 16, maintaining satisfactory copy quality.

Although a set of the magnet roller 41 and the sponge roller 42 are used in this embodiment, it is possible to use a plurality sets of the magnet roller 41 and the sponge roller 42. If the plurality sets of the magnet roller 41 and the sponge roller 42 are used, the mixing ratio of toner to carrier is more precisely adjusted.

As described above, the developing device of this embodiment is constructed based on the structure of Embodiment 1, and includes a sponge roller as the toner attracting member and a magnet roller as the carrier attracting member, the sponge roller being formed by shaping a sponge member into a rotatable roll, the magnet roller being formed by shaping a magnet member which attracts the carrier by a magnetic force into a rotatable roll.

With this structure, if the ratio of the rotation speed of the sponge roller to that of the magnet roller is appropriately set, the toner and the carrier in an appropriate ratio are stably supplied to the developer container.

[Embodiment 3]

Figure 7:
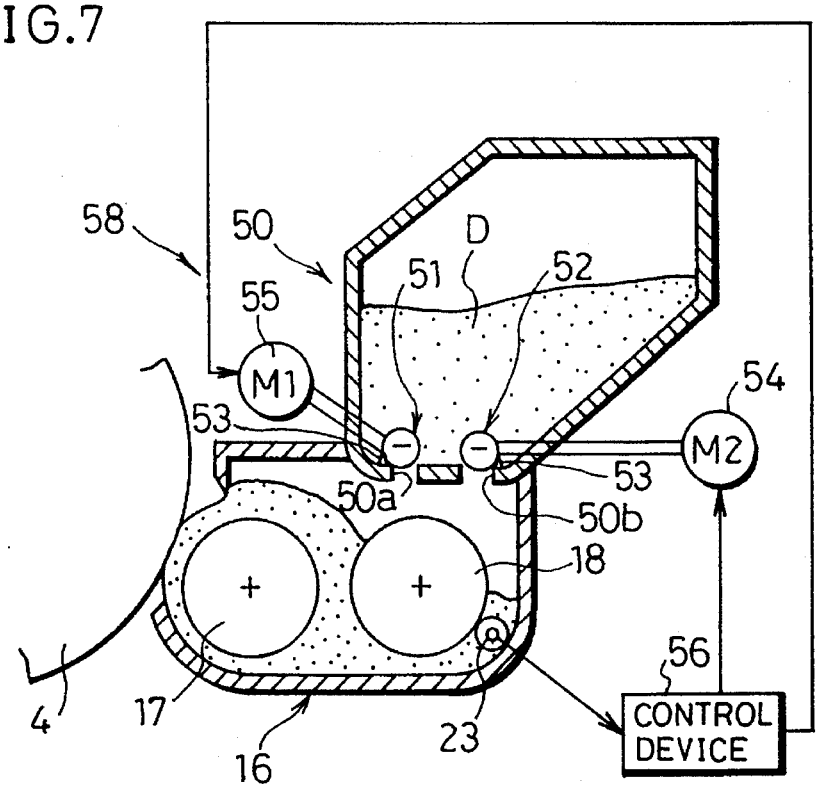
FIG. 7 is a schematic cross section of a developing device according to Embodiment 3 of the present invention.
Figure 8:
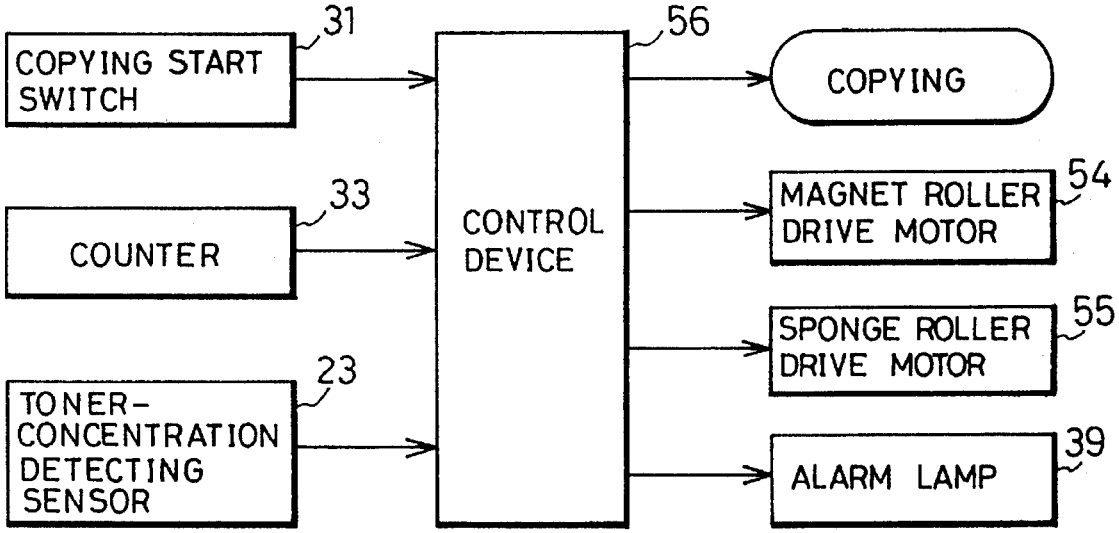
FIG. 8 is a control block diagram of a copying machine incorporating the developing device shown in FIG. 7.
Figure 9:
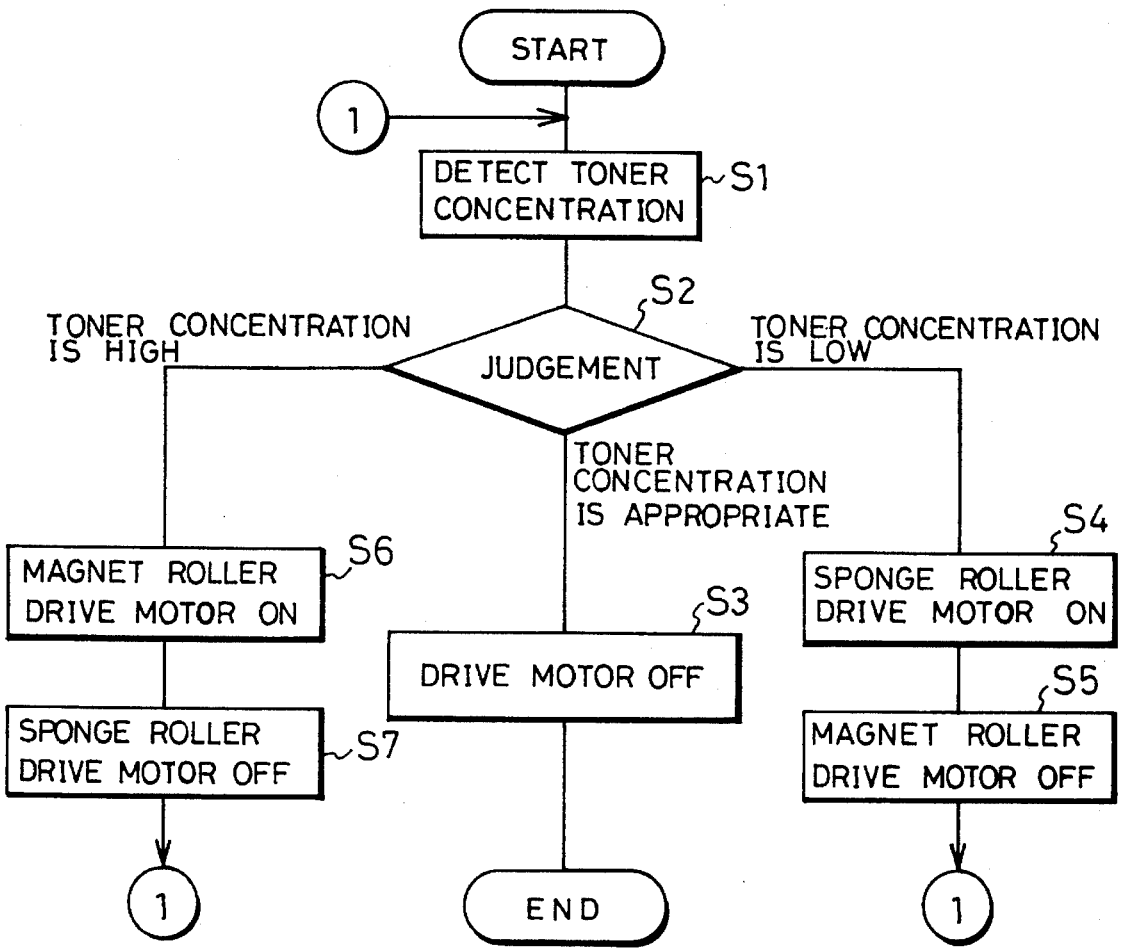
FIG. 9 is a flowchart showing how the supply of developer is controlled in the developing device of FIG. 7.

The following description discusses a third embodiment of the present invention with reference to FIGS. 7 to 9.

The members having the same structure and function as in the above-mentioned embodiments will be designated by the same code and their description will be omitted.

As illustrated in FIG. 7, a developing device 58 of this embodiment includes a developer supply unit 50 instead of the developer supply unit 20 of Embodiment 1.

A magnet roller 51 and a sponge roller 52 as developer supply means are rotatably mounted on the bottom of the developer supply unit 50. As the magnet roller 51 and the sponge roller 52 are rotated, the developer D stored in the developer supply unit 50 is supplied to the developer container 16 through openings 50*a* and 50*b*. The openings 50*a* and 50*b* are connected to developer supply openings formed in the upper surface of the developer container 16.

In addition, scrapers 53 as developer scraping means are attached at the openings 50*a* and 50*b* of the developer supply unit 50 so as to be in contact with the surfaces of the magnet roller 51 and the sponge roller 52. The toner attracted to the sponge roller 52 is scraped by the scraper 53 and supplied to the developer container 16 as the sponge roller 52 is rotated. Meanwhile, the carrier attracted to the magnet roller 51 is scraped by the scraper 53 and supplied to the developer container 16 as the magnet roller 51 is rotated.

The magnet roller 51 and the sponge roller 52 are driven under the control of a magnet-roller drive motor 54 (first driving means) and a sponge-roller drive motor 55 (second driving means) connected to a control device 56 shown in FIG. 8. The ratio of toner to carrier to be discharged is controlled by changing the ratio of rotation speed between the magnet roller 51 and the sponge roller 52.

In this embodiment, the rotation speed ratio the magnet roller 51 and the sponge roller 52 is set 1 to 3, and the values of the rotation speeds are the same as in Embodiment 2.

The magnet-roller drive motor 54 and the sponge-roller drive motor 55 are rotated according to a detection signal of a toner-concentration detecting sensor 23 for detecting a toner concentration in the developer container 16.

For instance, when the toner concentration in the developer container 16 is judged to be low by the toner-concentration detecting sensor 23, the control device 56 controls the magnet-roller drive motor 54 so that the magnet roller 51 is stopped rotating or rotated at a lower speed and for a shorter time, and controls the sponge-roller drive motor 55 so that the sponge roller 52 is rotated at a higher speed and for a longer time. On the other hand, when the toner concentration in the developer container 16 is judged to be high by the toner-concentration detecting sensor 23, the control device 56 controls the magnet-roller drive motor 54 so that the magnet roller 51 is rotated at a higher speed or for a longer time, and controls the sponge-roller drive motor 55 so that the sponge roller 52 is stopped rotating or rotated at a lower speed or for a shorter time.

When the toner concentration in the developer container 16 is low, the ratio of toner to carrier is low. In this case, as described above, the ratio of toner to carrier in the developer container 16 is relatively increased by stopping the rotation of the magnet roller 51 or rotating the magnet roller 51 at a lower speed and for a shorter time to reduce the supply amount of the carrier while rotating the sponge roller 52 at a higher speed and for a longer time to increase the supply amount of the toner.

On the other hand, when the toner concentration in the developer container 16 is high, the ratio of toner to carrier is high. In this case, as described above, the ratio of toner to carrier in the developer container 16 is relatively decreased by rotating the magnet roller 51 at a higher speed and for a longer time to increase the supply amount of the carrier while stopping the rotation of the sponge roller 52 or rotating the sponge roller 52 at a lower speed and for a shorter time to reduce the supply amount of the toner.

The developer supply control performed by the control device 56 is explained below with reference to the flowchart shown in FIG. 9.

First, a toner concentration in the developer container 16 is detected by the toner-concentration detecting sensor 23 (Step 1). Second, whether the toner concentration is appropriate or not is judged by an output voltage of the toner-concentration detecting sensor 23 (Step 2). If the value of the output voltage is in a suitable range, the toner concentration in the developer container 16 is judged to be appropriate, and the magnet-roller drive motor 54 and the sponge-roller drive motor 55 are turned off (Step 3).

On the other hand, if the value of the output voltage of the toner-concentration detecting sensor 23 is out of the suitable range, for example, higher than the suitable range in Step 2, the toner concentration in the developer container 16 is judged lower than a predetermined value. In this case, the sponge-roller drive motor 55 is turned on to rotate the sponge roller 52 (Step 4), and the magnet-roller drive motor 54 is turned off (Step 5). Then, the process moves to step 1 to again detect a toner concentration in the developer container 16.

If the value of the output voltage of the toner-concentration detecting sensor 23 is out of the suitable range, for example, lower than the suitable range in Step 2, the toner concentration in the developer container 16 is judged higher than the predetermined value. In this case, the magnet-roller drive motor 54 is turned on to rotate the magnet roller 51 (Step 6), and the sponge-roller drive motor 55 is turned off (Step 7). Then, the process moves to step 1 to again detect a toner concentration in the developer container 16.

Moreover, when the toner concentration is low, it is also possible to adjust the ratio of toner to carrier to be supplied by rotating the magnet roller 51 at a lower speed and a shorter time while rotating the sponge roller 52 at a higher speed and for a longer time according to the value of the output voltage of the toner-concentration detecting sensor 23 in Steps 4 and 5. On the other hand, when the toner concentration is high, the ratio of toner to carrier to be supplied may be adjusted by rotating the sponge roller 52 at a lower speed or for a shorter time while rotating the magnet roller 51 at a higher speed or for a longer time according to the value of the output voltage of the toner-concentration detecting sensor 23 in Steps 6 and 7.

As described above, with the structure of the developing device 58, since the magnet roller 51 and the sponge roller 52 are separately driven according to the toner concentration in the developer container, the developer including toner and carrier in an appropriate ratio is stably supplied to the developer container 16. Namely, the developer having a toner concentration required by the developer container 16 is suitably supplied. Therefore, sudden increases in the toner concentration and in the amount of carrier in the developer in the developer container 16 are avoided. It is thus possible to prevent toner spots and unexpected density decreases in some areas, thereby maintaining satisfactory copy quality.

Additionally, the amount of carrier to be supplied is adjusted by controlling the rotation speed and rotation time of the magnet roller 51 according to the output voltage of the toner-concentration detecting sensor 23. Similarly, the amount of toner to be supplied is adjusted by controlling the rotation speed and rotation time of the sponge roller 52 according to the output voltage of the toner-concentration detecting sensor 23.

In short, by controlling the driving of the sponge roller 52 and the magnet roller 51 in the above-mentioned manner, the developer including toner and carrier in an appropriate ratio is supplied, and thereby maintaining satisfactory copy quality.

Furthermore, since the control is performed in accordance with the value of the output voltage of the toner-concentration detecting sensor 23, it is possible to easily carry out the present invention using a conventional device, achieving a reduction in the manufacturing costs.

As described above, the developing device of this embodiment is constructed based on the structure of Embodiment 2, and includes:

toner-concentration detecting means for detecting a toner concentration in the developer in the developer container;

first driving means for driving the magnet roller;

second driving means for driving the sponge roller; and controlling means for controlling the first and second driving means according to a detection signal of the toner-concentration detecting means. With this structure, the toner and the carrier in an appropriate ratio corresponding to a toner concentration in the developer container are supplied to the developer container.

[Embodiment 4]

Figure 10:
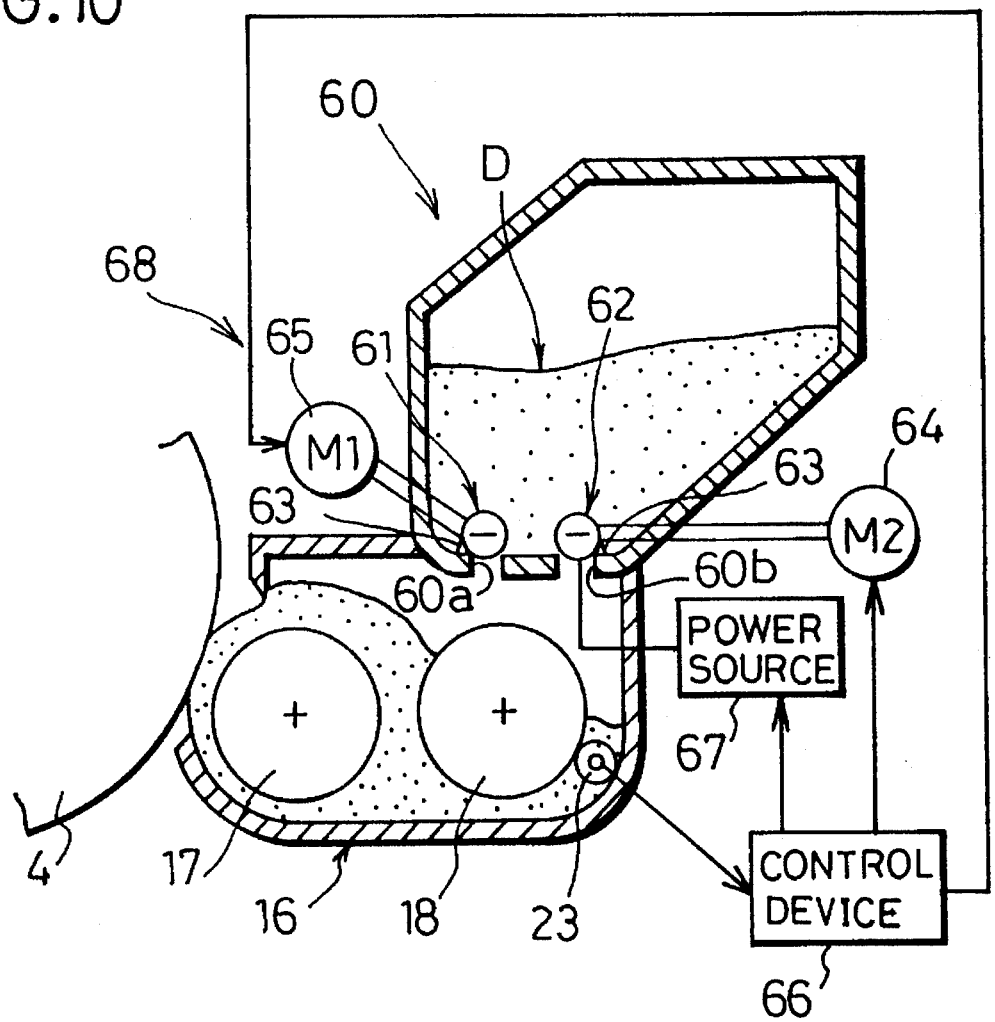
FIG. 10 is a schematic cross section of a developing device according to Embodiment 4 of the present invention.
Figure 11:
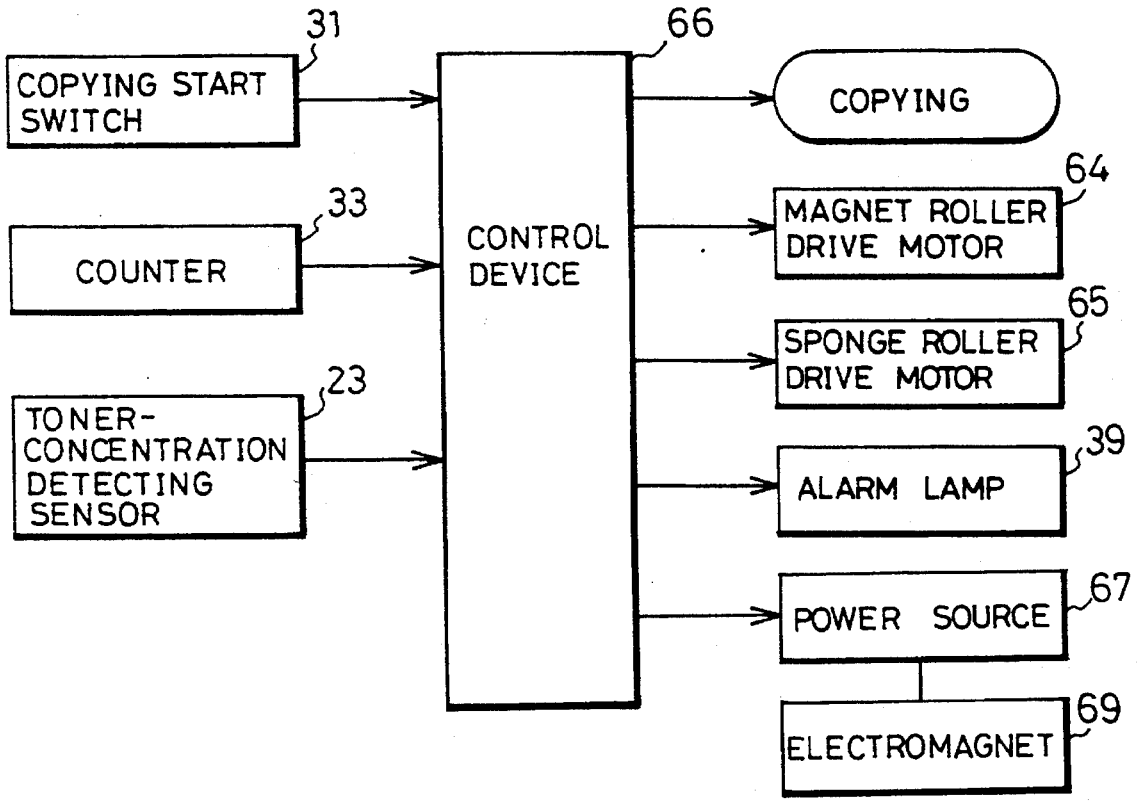
FIG. 11 is a control block diagram of a copying machine incorporating the developing device shown in FIG. 10.
Figure 12:
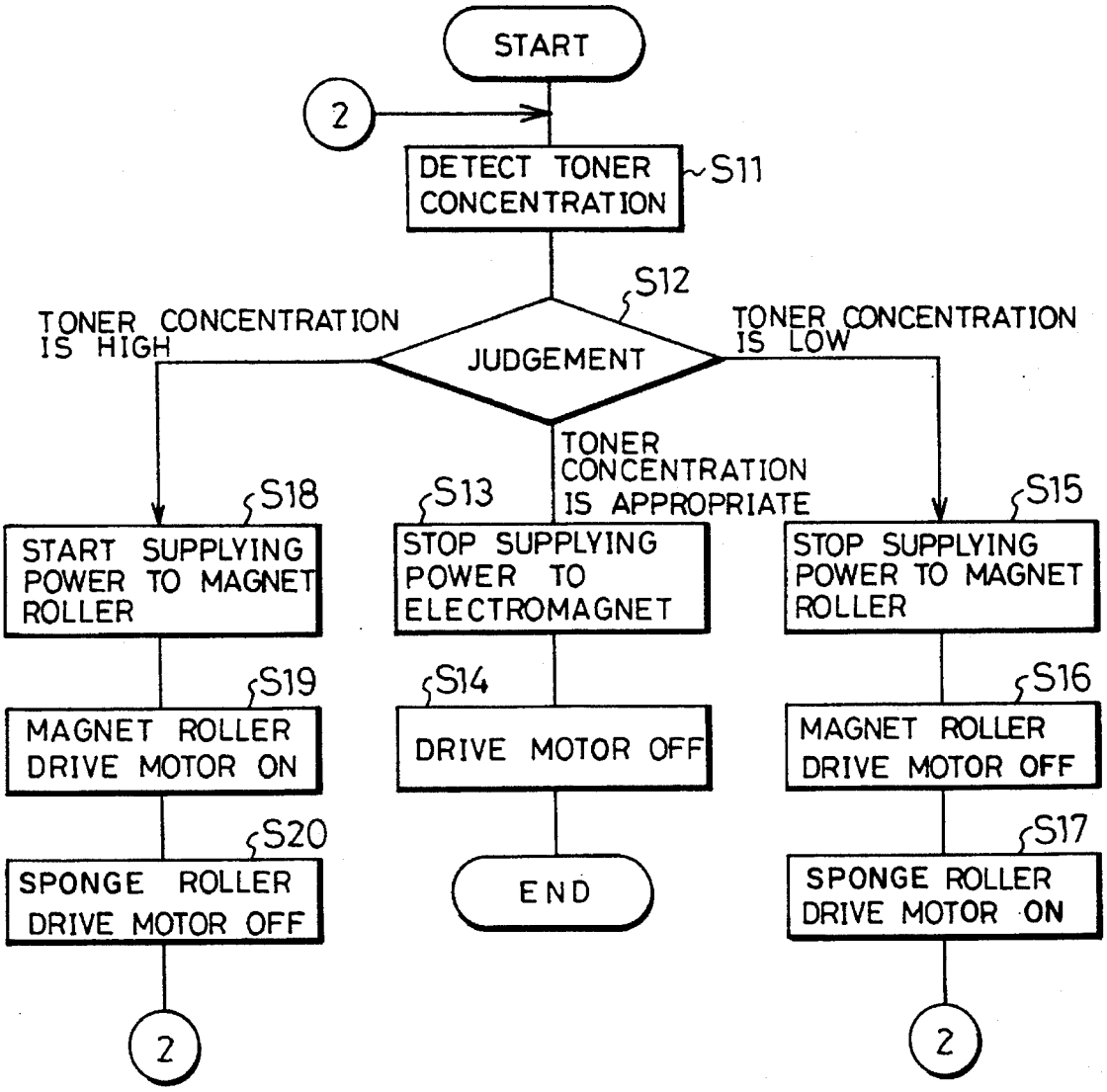
FIG. 12 is a flowchart showing how the supply of developer is controlled in the developing device of FIG. 10.

The following description discusses a fourth embodiment of the present invention with reference to FIGS. 10 to 12.

The members having the same structure and function as in the above-mentioned embodiments will be designated by the same code and their description will be omitted.

As illustrated in FIG. 10, a developing device 68 of this embodiment includes a developer supply unit 60 instead of the developer supply unit 20 in the developing device 8 of Embodiment 1.

A magnet roller 61 and a sponge roller 62 as developer supply means are rotatably mounted on the bottom of the developer supply unit 60. As the magnet roller 61 and the sponge roller 62 are rotated, the developer D stored in the developer supply unit 60 is supplied to the developer container 16 through openings 60*a* and 60*b*. The openings 60*a* and 60*b* are connected to developer supply openings formed in the upper surface of the developer container 16.

In addition, scrapers 63 as developer scraping means are attached at the openings 60*a* and 60*b* of the developer supply unit 60 so as to be in contact with the surfaces of the magnet roller 61 and the sponge roller 62. The toner attracted to the sponge roller 62 is scraped by the scraper 63 and supplied to the developer container 16 as the sponge roller 62 is rotated. Meanwhile, the carrier attracted to the magnet roller 61 is scraped by the scraper 63 and supplied to the developer container 16 as the magnet roller 61 is rotated.

The magnet roller 61 and the sponge roller 62 are driven under the control of a magnet-roller drive motor 64 (first driving means) and a sponge-roller drive motor 65 (second driving means) connected to a control device 66 shown in FIG. 11. The ratio of toner to carrier to be discharged is controlled by changing the rotation speed ratio between the magnet roller 61 and the sponge roller 62 in the same manner as in Embodiment 2.

In this embodiment, the rotation speed ratio between. the magnet roller 61 and the sponge roller 62, and the values of the rotation speeds are the same as in Embodiment 2.

The magnet roller 61 is formed by an electromagnet, and electric power is supplied thereto by an power source 67. Therefore, the amount of carrier to be attracted to the magnet roller 61 is adjusted by changing the value of electric power to be supplied to the electromagnet so as to change magnetic force of the magnet roller 61.

The value of electric power to be supplied to the electromagnet of the magnet roller 61 is controlled according to the detection signal of the toner-concentration detecting sensor 23 for detecting a toner concentration in the developer container 16.

For instance, when the toner concentration in the developer container 16 is judged to be low by the toner-concentration detecting sensor 23, the control device 66 controls the power source 67 so that the supply of electric power to the magnet roller 61 is stopped or the value of electric power is decreased. On the other hand, when the toner concentration in the developer container 16 is judged to be high by the toner-concentration detecting sensor 23, the control device 66 controls the power source 67 so that the value of electric power to be supplied to the magnet roller 61 is increased.

Thus, when the toner concentration in the developer container 16 is low, the ratio of toner to carrier is low. In this case, as described above, the amount of carrier to be attracted to the magnet roller 61 is reduced and the supply amount of carrier is decreased by stopping the supply of electric power to the magnet roller 61 or decreasing the value of electric power. Consequently, the ratio of toner to carrier in the developer container 16 is relatively increased.

On the other hand, when the toner concentration in the developer container 16 is high, the ratio of toner to carrier is high. In this case, as described above, by increasing the value of electric power to be supplied to the magnet roller 62, the magnetic force of the magnet roller 61 is increased and the amount of carrier to be attracted to the magnet roller 62 is increased, and thereby increasing the supply amount of carrier. As a result, the ratio of toner to carrier in the developer container 16 is relatively decreased.

The developer supply control performed by the control device 66 is explained below with reference to the flowchart shown in FIG. 12.

First, a toner concentration in the developer container 16 is detected by the toner-concentration detecting sensor 23 (Step 11). Second, whether the toner concentration is appropriate or not is judged by an output voltage of the toner-concentration detecting sensor 23 (Step 12). If the value of the output voltage is in a suitable range, the toner concentration in the developer container 16 is judged to be appropriate, and the supply of electric power to the magnet roller 61 is stopped (Step 13). Then, the magnet-roller drive motor 64 and the sponge-roller drive motor 65 are turned off (Step 14).

On the other hand, if the value of the output voltage of the toner-concentration detecting sensor 23 is out of the suitable range, for example, higher than the suitable range in Step 12, the toner concentration in the developer container 16 is judged lower than a predetermined value and the supply of electric power to the magnet roller 61 is stopped (Step 15). Then, the magnet-roller drive motor 64 is turned off (Step 16), and the sponge-roller drive motor 65 is turned on to rotate the sponge roller 62 (Step 17). Thereafter, the process moves to step 11 to again detect a toner concentration in the developer container 16.

If the value of the output voltage of the toner-concentration detecting sensor 23 is out of the suitable range, for example, lower than the suitable range in Step 12, the toner concentration in the developer container 16 is judged higher than the predetermined value, and electric power is supplied to the magnet roller 61 (Step 18). In this case, the magnet-roller drive motor 64 is turned on to rotate the magnet roller 61 (Step and the sponge-roller drive motor 65 is turned off (Step 20). Then, the process moves to step 1 to again detect a toner concentration in the developer container 16.

In this embodiment, when the toner concentration is low, the supply of electric power to the magnet roller 61 is stopped in Step 15. However, it is also possible to adjust the supply amount of carrier by changing the magnetic force of the magnet roller 61 while changing the value of electric power and by rotating the magnet roller 61 according to the output voltage of the toner-concentration detecting sensor 23. It is also possible to adjust the supply amount of carrier by changing the value of electric power to be supplied to the magnet roller 61 and varying the magnetic force of the magnet roller 61 according to the output voltage of the toner concentration in Step 18.

As described above, with the structure of the developing device 68, since the magnetic force of the magnet roller 61 is varied by changing the value of electric power to be supplied to the electromagnet of the magnet roller 61, the amount of carrier to be attracted to the magnet roller 61 is easily changed. With this structure, the amount of carrier to be attracted to the magnet roller 61 is more easily adjusted compared to the case where a permanent magnet is used for the magnet roller 61, and the developer including toner and carrier in an appropriate ratio is stably supplied to the developer container 16.

Additionally, since the amount of carrier to be attracted to the magnet roller 61 is changed by varying the value of electric power to be supplied to the electromagnet according to the detection signal of the toner-concentration detecting sensor 23, the ratio of toner to carrier is made appropriate according to the toner concentration in the developer container 16. As a result, the developer including toner and carrier in an appropriate ratio is stably supplied to the developer container 16 in accordance with toner concentration in the developer container 16. Thus, the amount of developer and the toner concentration in the developer container 16 are maintained uniform. Accordingly, it is possible to prevent toner spots and unexpected density decreases in some areas, thereby maintaining satisfactory copy quality.

Since the above-mentioned control is performed according to the output voltage of the toner-concentration detecting sensor 23, it is possible to easily execute the present invention using a conventional device, resulting in a reduction in the manufacturing costs.

As described above, the developing device of this embodiment is constructed based on the structure of Embodiment 2, and wherein the magnet roller includes an electromagnet, and the developing device further includes:

a power source for supplying electric power to the electromagnet;

toner-concentration detecting means for detecting a toner concentration in the developer in the developer container; and controlling means for controlling the power source to change a value of electric power to be supplied to the electromagnet according to a detection signal of the toner-concentration detecting means.

With this structure, since the amount of carrier to be supplied to the developer container is easily adjusted by changing the value of electric power to be supplied to the electromagnet, the toner and the carrier in an appropriate ratio corresponding to a toner concentration in the developer container are supplied to the developer container.

[Embodiment 5]

The following description discusses a fifth embodiment of the present invention with reference to FIGS. 13 to 16.

The members having the same structure and function as in the above-mentioned embodiments will be designated by the same code and their description will be omitted.

Figure 13:
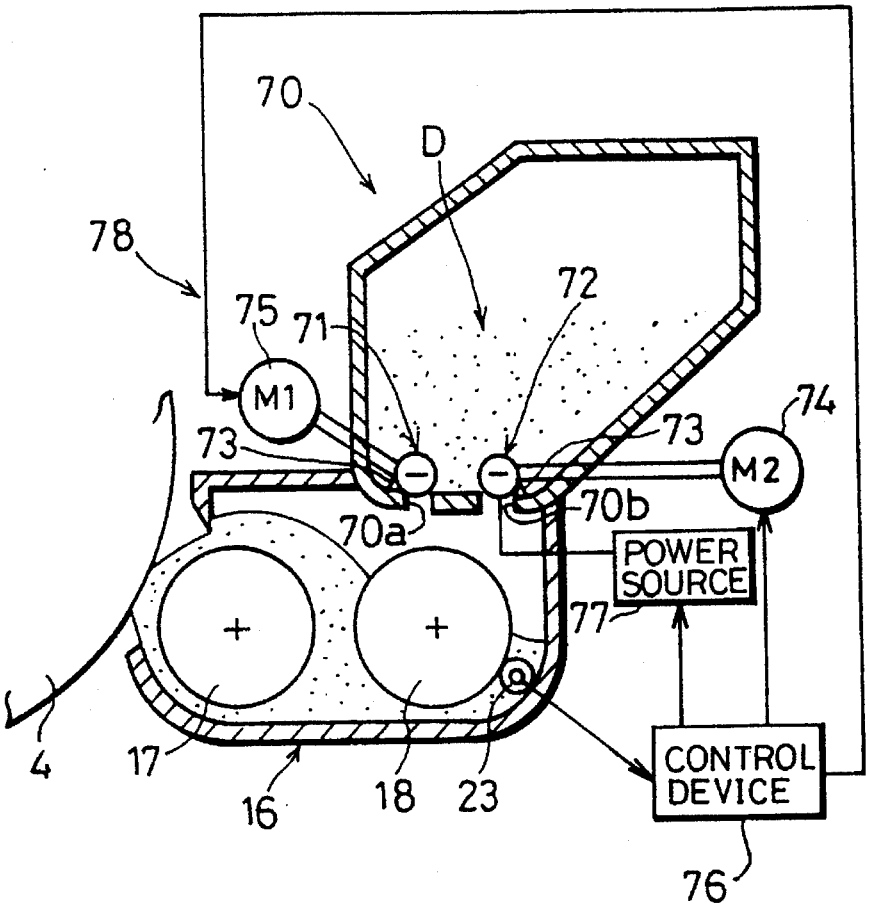
FIG. 13 is a schematic cross section of a developing device according to Embodiment 5 of the present invention.

As illustrated in FIG. 13, a developing device 78 of this embodiment includes a developer supply unit 70 instead of the developer supply unit 20 in the developing device 8 of Embodiment 1.

A magnet roller 72 and a sponge roller 71 as developer supply means are rotatably mounted on the bottom of the developer supply unit 70. As the magnet roller 72 and the sponge roller 71 are rotated, the developer D stored in the developer supply unit 70 is supplied to the developer container 16 through openings **70*a* and 70*b*. The openings 70*a* and 70*b* are connected to developer supply openings formed in the upper surface of the developer container 16**.

In addition, scrapers 73 as developer scraping means are mounted at the openings **70*a* and 70*b* of the developer supply unit 70 so as to be in contact with the surfaces of the magnet roller 72 and the sponge roller 71. The toner attracted to the sponge roller 71 is scraped by the scraper 73, and supplied to the developer container 16 as the sponge roller 71 is rotated. The carrier attracted to the magnet roller 72 is scraped by the scraper 73, and supplied to the developer container 16 as the magnet roller 72** is rotated.

Figure 15:
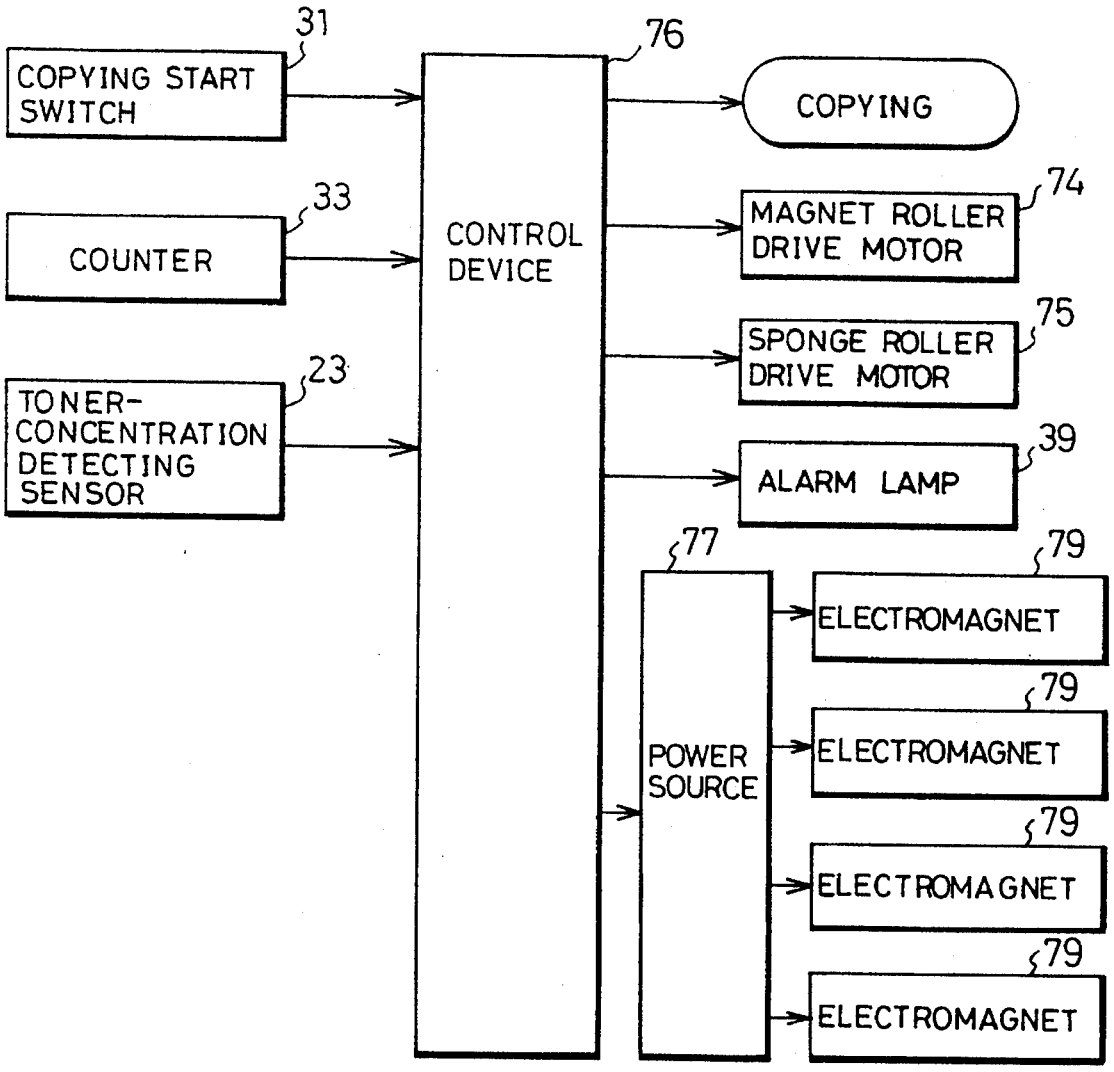
FIG. 15 is a control block diagram of a control device in a copying machine incorporating the developing device of FIG. 13.

The magnet roller 72 and the sponge roller 71 are driven under the control of a magnet-roller drive motor 74 (first driving means) and a sponge-roller drive motor 75 (second driving means), respectively, connected to a control device 76 shown in FIG. 15. The ratio of toner to carrier to be discharged is controlled by changing the rotation speed ratio between the magnet roller 71 and the sponge roller 71 in the same manner as in Embodiment 2.

In this embodiment, the rotation speed ratio between the magnet roller 72 and the sponge roller 71, and the values of the rotation speeds are the same as in Embodiment 2.

Figure 14:
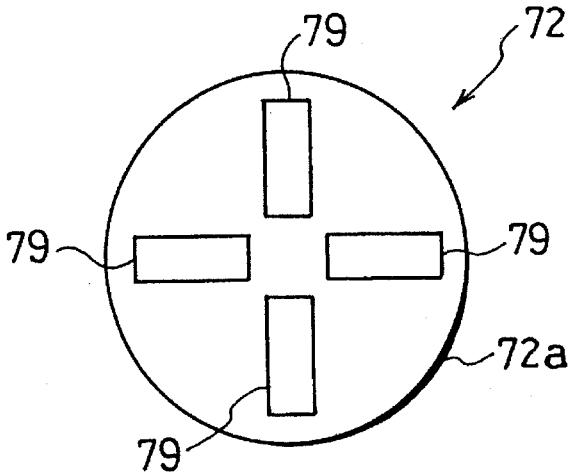
FIG. 14 illustrates a schematic structure of a magnet roller for supplying developer, incorporated in the developing device of FIG. 13.

The magnet roller 72 includes four electromagnets 79 placed in a longitudinal direction of a roller sleeve 72*a* with a uniform space from the center axis of the roller as shown in FIG. 14. As illustrated in FIG. 15, each of the electromagnets 79 is connected to an power source 77. Thus, the power source 77 can separately supply electric power to each of the electromagnets 79. The number of electromagnets 79 to which electric power is to be supplied from the power source 77 is determined according to a detection signal of the toner-concentration detecting sensor 23 for detecting a toner concentration in the developer container 16.

For instance, when the toner concentration in the developer container 16 is judged to be low by the toner-concentration detecting sensor 23, the control. device 76 controls the power source 77 so that the supply of electric power to all of the electromagnets 79 is stopped or the number of electromagnets 79 to which electric power is to be supplied is reduced. On the other hand, when the toner concentration in the developer container 16 is judged to be high by the toner-concentration detecting sensor 23, the control device 76 controls the power source 77 so that electric power is supplied to all of the electromagnets 79 or the number of electromagnets 79 to which electric power is to be supplied is increased.

Thus, when the toner concentration in the developer container 16 is low, the ratio of toner to carrier is low. In this case, as described above, the magnetic force of the magnet roller 72 is decreased by stopping the supply of electric power to all of the electromagnets 79 or reducing the number of the electromagnets 79 to which electric power is to be supplied. With this arrangement, the amount of carrier to be attracted to the magnet roller 72 is decreased, and the supply amount of carrier is reduced. Consequently, the ratio of toner to carrier in the developer container 16 is relatively increased.

On the other hand, when the toner concentration in the developer container 16 is high, the ratio of toner to carrier is high. In this case, as described above, the magnetic force of the magnet roller 72 is increased by supplying electric power to all of the electromagnets 79 or increasing the number of the electromagnets 79 to which electric power is to be supplied. With this arrangement, the amount of carrier to be attracted to the magnet roller 72 is increased, and the supply amount of carrier is raised. Consequently, the ratio of toner to carrier in the developer container 16 is relatively decreased.

Figure 16:
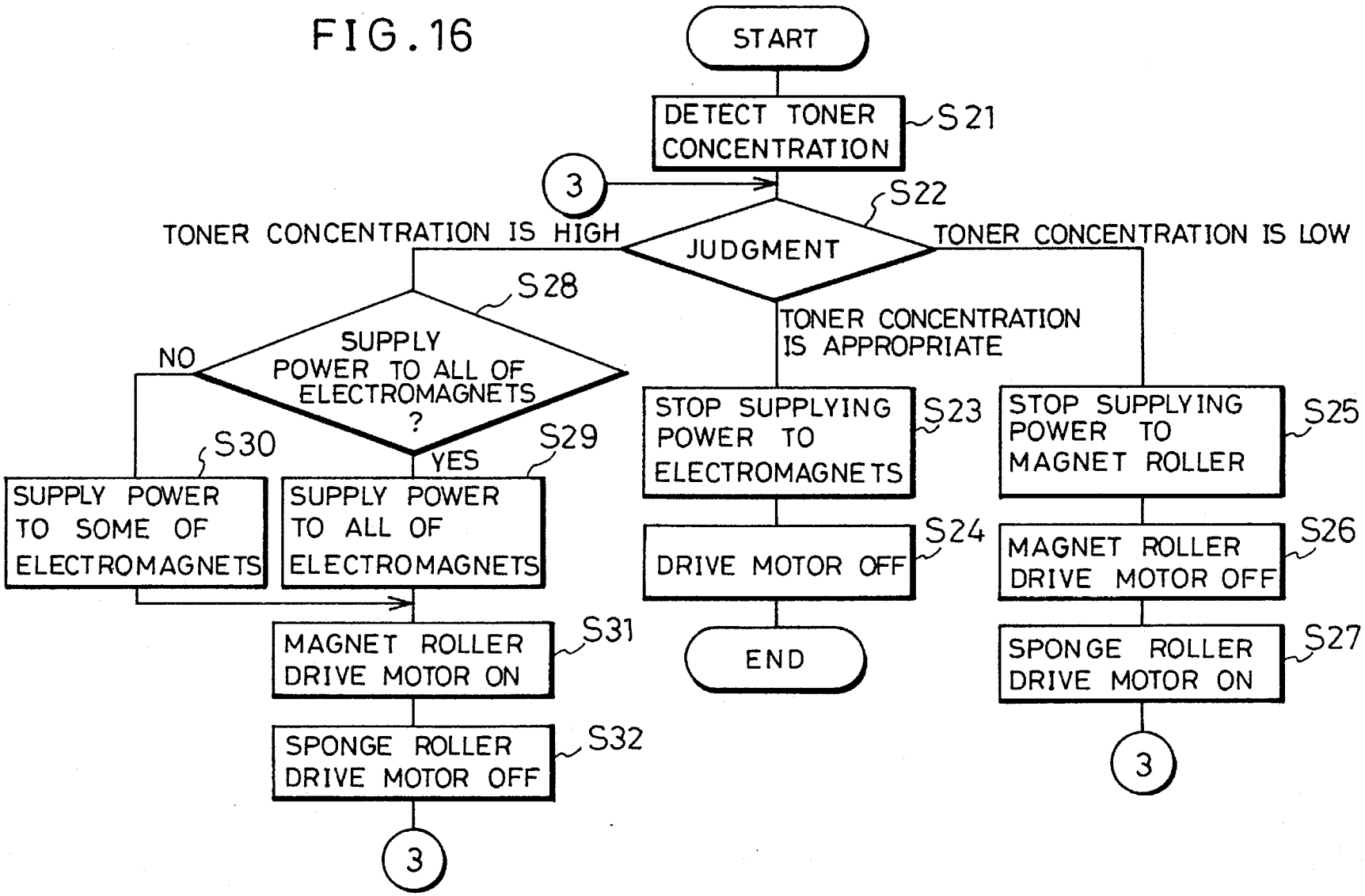
FIG. 16 is a flowchart showing how the supply of developer is controlled in the developing device of FIG. 13.

The developer supply control performed by the control device 76 is explained below with reference to the flowchart shown in FIG. 16.

First, a toner concentration in the developer container 16 is detected by the toner-concentration detecting sensor 23 (Step 21). Second, whether the toner concentration is appropriate or not is judged by an output voltage of the toner-concentration detecting sensor 23 (Step 22). If the value of the output voltage is in a suitable range, the toner concentration in the developer container 16 is judged to be appropriate, and the supply of the electric power to the magnet roller 72 is stopped (Step 23). Then, the magnet-roller drive motor 74 and the sponge-roller drive motor 75 are turned off (Step 24).

On the other hand, if the value of the output voltage of the toner-concentration detecting sensor 23 is out of the suitable range, for example, higher than the suitable range in Step 22, the toner concentration in the developer container 16 is judged lower than a predetermined value and the supply of electric power to the magnet roller 72 is stopped (Step 25). Then, the magnet-roller drive motor 74 is turned off (Step 26), and the sponge-roller drive motor 75 is turned on to rotate the sponge roller 71 (Step 27). Thereafter, the process moves to step 21 to again detect a toner concentration in the developer container 16.

If the value of the output voltage of the toner-concentration detecting sensor 23 is out of the suitable range, for example, lower than the suitable range in Step 22, the toner concentration in the developer container 16 is judged higher than the predetermined value. Then, whether electric power is to be supplied to all of the electromagnets 79 in the magnet roller 72 is judged (Step 28). At this time, if the output voltage of the toner-concentration detecting sensor 23 is smaller than a predetermined reference value, electric power is supplied to all of the electromagnets 79 (Step 29). Subsequently, the magnet-roller drive motor 74 is turned on to rotate the magnet roller 72 (Step 31), and the sponge-roller drive motor 75 is turned off (Step 32). Then, the process moves to step 21 to again detect a toner concentration in the developer container 16.

Meanwhile, when it is judged in Step 28 that electric power is not to be supplied to all of the electromagnets 79, electric power is supplied to the number of electromagnets 79 corresponding to the value of the output of the toner-concentration detecting sensor 23 (Step 30). Then, the process moves to step 31 for turning on the magnet-roller drive motor 74 to rotate the magnet roller 72, and to step 32 for turning off the sponge-roller drive motor 75.

As described above, with the structure of the developing device 78, since the magnetic force of the magnet roller 72 is varied by changing the number of electromagnets 79 to which electric power is to be supplied, the amount of carrier to be attracted to the magnet roller 71 is adjusted. With this structure, the amount of carrier to be attracted to the magnet roller 72 is more easily adjusted compared to the case where a permanent magnet is used for the magnet roller 72, and the developer including toner and carrier in an appropriate ratio is stably supplied to the developer container 16.

Additionally, since the amount of carrier to be attracted to the magnet roller 72 is changed by varying the number of electromagnets 79 to which electric power is to be supplied in accordance with a signal detected by the toner-concentration detecting sensor 23, it is possible to supply a developer including toner and carrier in an appropriate ratio according to the toner concentration in the developer container 16. As a result, the amount of developer and the toner concentration in the developer container 16 are maintained uniform. It is therefore possible to prevent toner spots and unexpected density decreases in some areas, thereby maintaining satisfactory copy quality.

Since the above-mentioned control is performed according to the output voltage of the toner-concentration detecting sensor 23, it is possible to easily execute the present invention using a conventional device, resulting in a reduction in the manufacturing costs.

As described above, the developing device of this embodiment is constructed based on the structure of Embodiment 4, wherein the magnet roller includes a plurality of electromagnets, and the developing device further includes:

a power source for supplying electric power to the electromagnets;

toner-concentration detecting means for detecting a toner concentration in the developer in the developer container; and controlling means for controlling the power source to change the number of the electromagnets to which electric power is to be supplied according to a detection signal of the toner-concentration detecting means.

With this structure, since the magnetic force of the magnet roller is varied by changing the number of the electromagnets to which electric power is to be supplied, it is possible to vary the amount of carrier to be attracted to the magnet roller. Thus, the amount of carrier to be attracted to the magnet roller is more easily adjusted compared to the case where a permanent magnet is used as the magnet roller. Also, toner and carrier in an appropriate ratio corresponding to a toner concentration in the developer in the developer container is supplied to the developer container.

[Embodiment 6]

Figure 17:
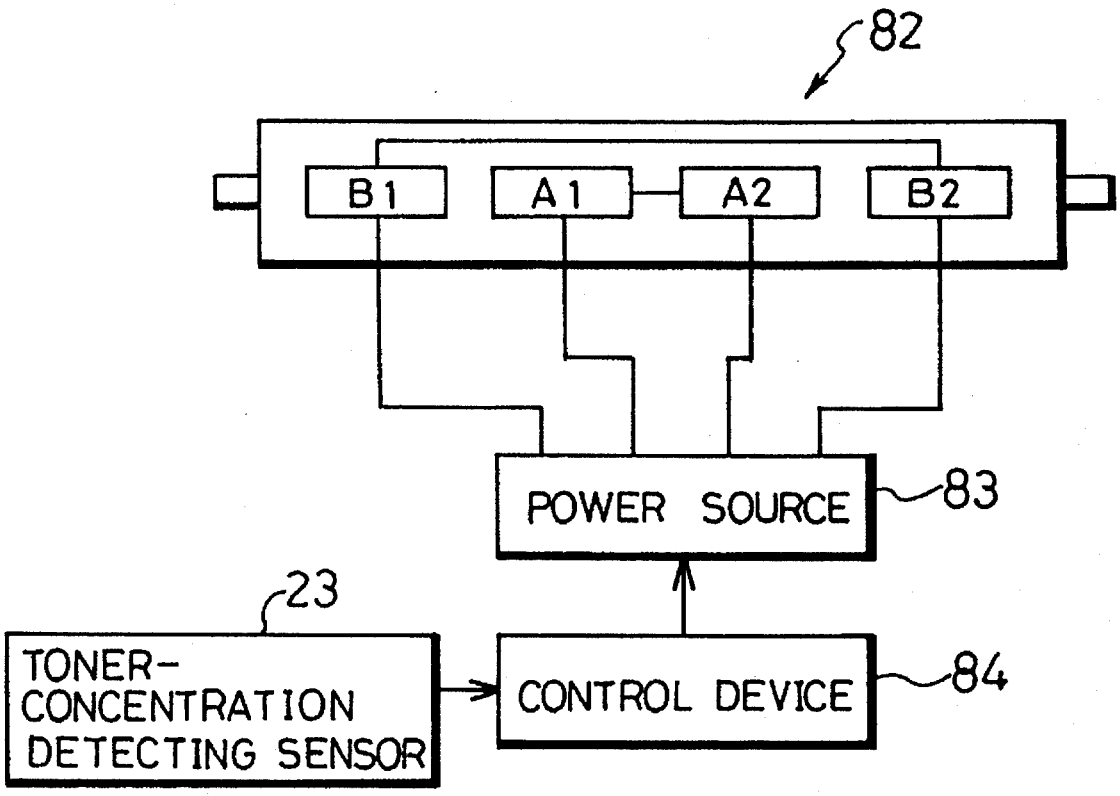
FIG. 17 illustrates a schematic structure of a magnet roller for supplying developer, incorporated in a developing device according to Embodiment 6 of the present invention.

The following description discusses a sixth embodiment of the present invention with reference to FIG. 17.

The members having the same structure and function as in the above-mentioned embodiments will be designated by the same code and their description will be omitted.

A developing device of this embodiment includes a magnet roller 82 shown in FIG. 17 instead of the magnet roller 72 in the developing device 78 of Embodiment 5.

As illustrated in FIG. 17, the magnet roller 82 has electromagnets B1, A1, A2 and B2 arranged in this order in a longitudinal direction of the roller. The electromagnets A1 and A2 are connected in series, and the electromagnets B1 and B2 are connected in series. The electromagnets A1, A2, B1, and B2 are respectively connected to a power source 83. The power source 83 supplies electric power to the electromagnets A1 and A2, and the electromagnets B1 and B2 separately. Therefore, by changing the number of electromagnets to which electric power is to be supplied and changing the value of electric power, the magnetic force of the magnet roller 82 is varied and the amount of carrier to be attracted to the magnet roller 82 is adjusted.

The number of electromagnets to which electric power is to be supplied and the value of electric power to be supplied in the magnet roller 82 are controlled according to a detection signal of the toner-concentration detecting sensor 23 for detecting a toner concentration in the developer container 16.

For instance, when the toner concentration in the developer container 16 is judged to be low by the toner-concentration detecting sensor 23, the control. device 84 controls the power source 83 so that the supply of electric power to all of the electromagnets is stopped or electric power is supplied only to the electromagnets A1 and A2. When electric power is supplied only to the electromagnets A1 and A2, it is necessary to decrease the value of electric power to be supplied. On the other hand, when the toner concentration in the developer container 16 is judged to be high by the toner-concentration detecting sensor 23, the control device 84 controls the power source 83 so that electric power is supplied to the electromagnets A1 and A2 and the electromagnets B1 and B2, or the value of electric power to be supplied to these electromagnets is increased.

Thus, when the toner concentration in the developer container 16 is low, the ratio of toner to carrier is low. In this case, as described above, the magnetic force of the magnet roller 82 is decreased by stopping the supply of electric power to all of the electromagnets in the magnet roller 82, or supplying the electric power only to the electromagnets A1 and A2 and decreasing the value of electric power to be supplied. With this arrangement, the amount of carrier to be attracted to the magnet roller 82 is decreased, and thus the supply amount of carrier is decreased. Consequently, the ratio of toner to carrier in the developer container 16 is relatively increased.

On the other hand, when the toner concentration in the developer container 16 is high, the ratio of toner to carrier is high. In this case, as described above, the magnetic force of the magnet roller 82 is increased by supplying electric power to all of the electromagnets in the magnet roller 82 and increasing the value of electric power to be supplied. With this arrangement, the amount of carrier to be attracted to the magnet roller 82 is increased, and thus the supply amount of carrier is increased. Consequently, the ratio of toner to carrier in the developer container 16 is relatively decreased.

As described above, with the developing device of this embodiment, a more appropriate amount of carrier is attracted to the magnet roller 82 by changing the value of electric power to be supplied to the electromagnets in the magnet roller 82 and changing the number of the electromagnets to which electric power is to be supplied. With this structure, the amount of carrier to be attracted to the magnet roller 82 is more easily and precisely adjusted compared to the case where a permanent magnet is used for the magnet roller 82, and the developer including toner and carrier in an appropriate ratio is stably supplied to the developer container 16.

Additionally, since the amount of carrier to be attracted to the magnet roller 82 is changed by varying the electric power to be supplied to the electromagnets and the number of the electromagnets to which the electric power is to be supplied in accordance with a signal detected by the toner-concentration detecting sensor 23, it is possible to supply a developer including toner and carrier in an appropriate ratio in accordance with the toner concentration in the developer container 16. As a result, the amount of developer and the toner concentration in the developer container 16 are maintained uniform. It is therefore possible to prevent copy quality from being degraded due to toner spots and unexpected density decreases in some areas, thereby maintaining satisfactory copy quality.

Furthermore, since the above-mentioned control is performed according to the output voltage of the toner-concentration detecting sensor 23, it is possible to easily execute the present invention using a conventional device, resulting in a reduction in the manufacturing costs.

As described above, the developing device of this embodiment is constructed based on the structure of Embodiment 4, wherein the magnet roller includes a plurality of electromagnets, and the developing device further includes:

a power source for individually supplying electric power to each of the electromagnets;

toner-concentration detecting means for detecting a toner concentration in the developer in the developer container; and controlling means for controlling the power source to change the number of the electromagnets to which electric power is to be supplied and a value of electric power to be supplied to electromagnets selected according to a detection signal of the toner-concentration detecting means.

With this structure, an appropriate amount of carrier is attracted to the magnet roller by changing the value of electric power to be supplied to the electromagnets of the magnet roller and changing the number of electromagnets to which electric power is to be supplied. Accordingly, the amount of carrier to be attracted to the magnet roller is more easily adjusted compared to the case where a permanent magnet is used for the magnet roller. As a result, the toner and the carrier in an appropriate ratio corresponding to a toner concentration in the developer container are supplied to the developer container.

[Embodiment 7]

The following description discusses a seventh embodiment of the present invention with reference to FIGS. 18 to 23(*d*).

The members having the same structure and function as in the above-mentioned embodiments will be designated by the same code and their description will be omitted.

Figure 18:
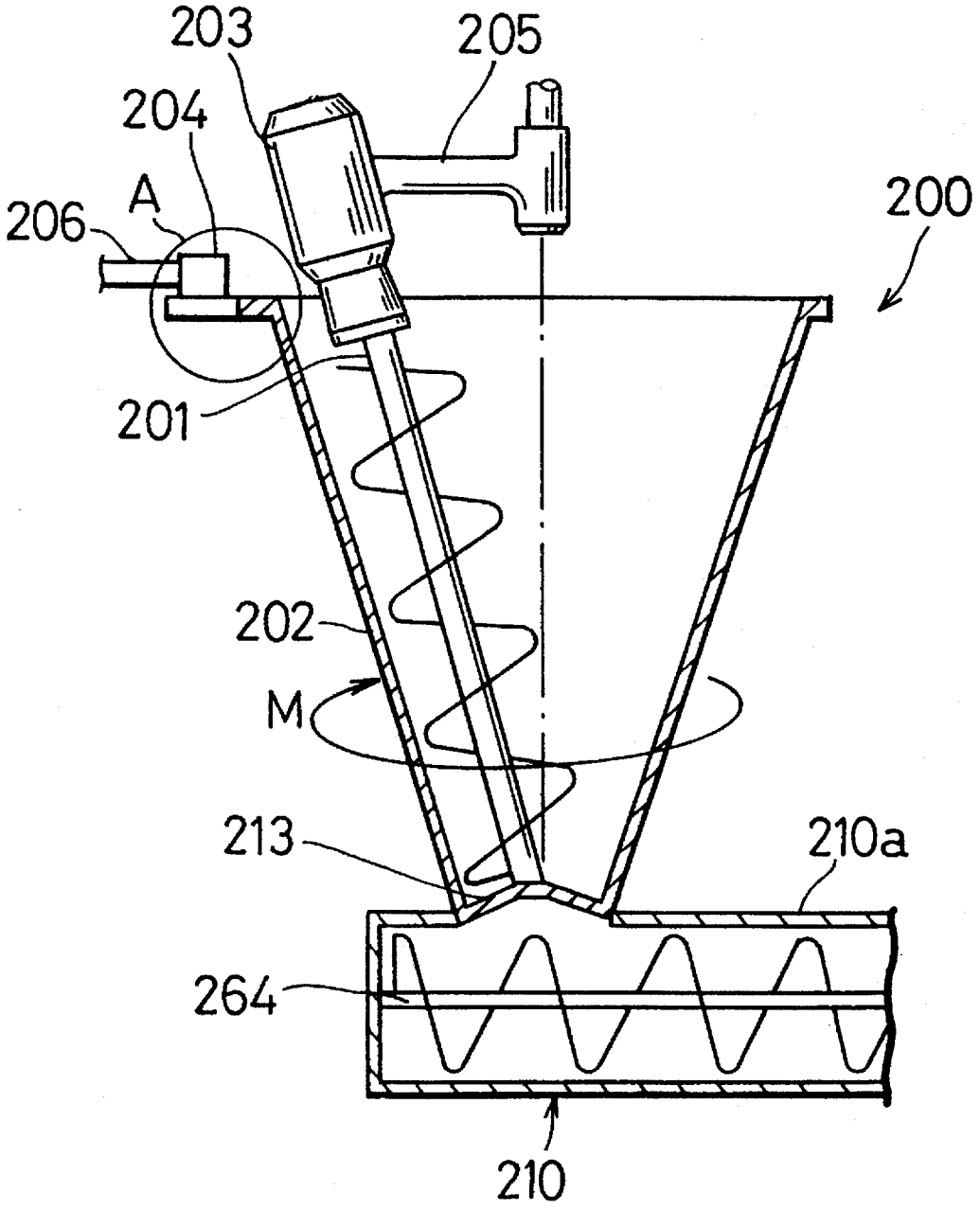
FIG. 18 is a schematic cross section of a developer supply section in a developing device according to Embodiment 7 of the present invention.

As illustrated in FIG. 18, a developing device of this embodiment includes a developer supply section 200 (developer supply means) mounted upon a developer container 210.

The developer supply section 200 includes an agitating screw 201 (transporting means), a hopper main body 202 (supply-developer storage section), an agitating-screw driving section 203 (transporting means), and a hopper driving section 204 (driving means).

The hopper main body 202 is an inverted-cone-shaped container, and stores a developer including. a mixture of toner and carrier. The bottom section of the hopper main body 202 is attached rotatably to a top wall 210*a* of the developer container 210. The bottom section of the hopper main body 202 has a developer outlet 213 connected to the developer container 210. The developer in the hopper main body 202 falls down into the developer container 210 through the developer outlet 213.

The agitating screw 201 is installed in the hopper main body 202 to lean along a wall surface of the hopper main body 202. The agitating screw 201 extends substantially from the bottom to the top of the hopper main body 202, and agitates the developer therein by moving the developer upward. The top end of the agitating screw 201 is connected to the agitating-screw driving section 203. Namely, the agitating screw 201 is rotated by the agitating-screw driving section 203.

Figure 19:
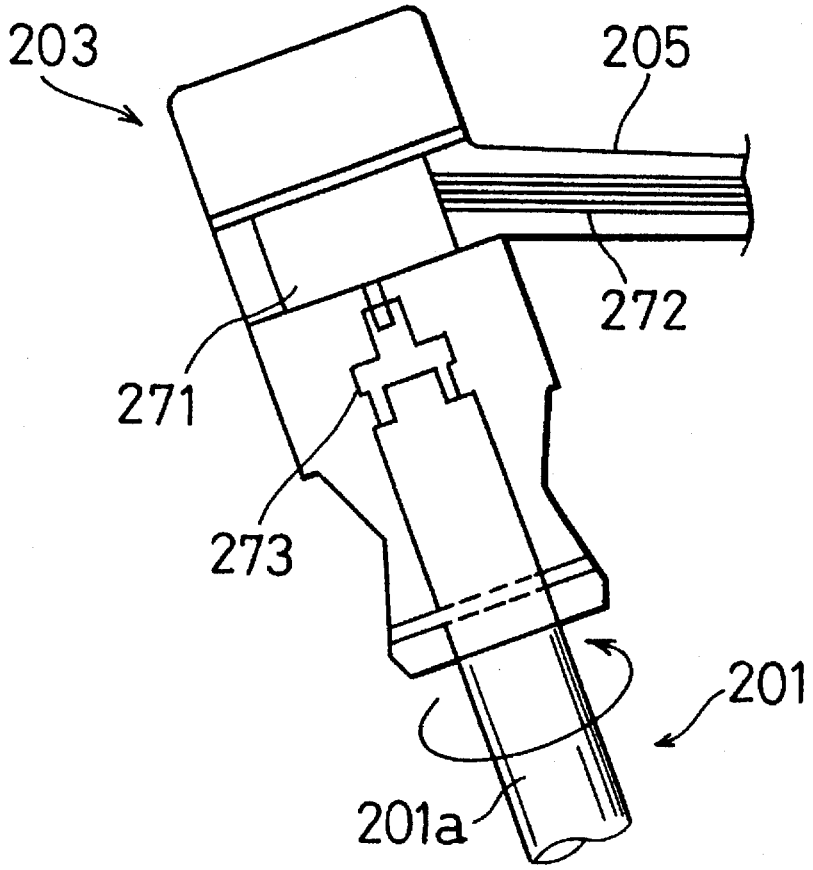
FIG. 19 is a detail internal view of an agitating-screw driving section in the developing device of FIG. 18.

The agitating-screw driving section 203 is supported by a supporting member 205 attached to the main body of a copying machine. As illustrated in FIG. 19, the agitating screw 203 includes a drive motor 271, and a connecting member 273 for connecting a drive shaft of the drive motor 271 to a rotation shaft 201*a* of the agitating screw 201 so as to transmit a rotation driving force of the drive motor 271 to the rotation shaft 201*a*. The supporting member 205 is hollow, and includes therein an electric power cord 272 through which electric power is supplied to the drive motor 271.

Figure 20:
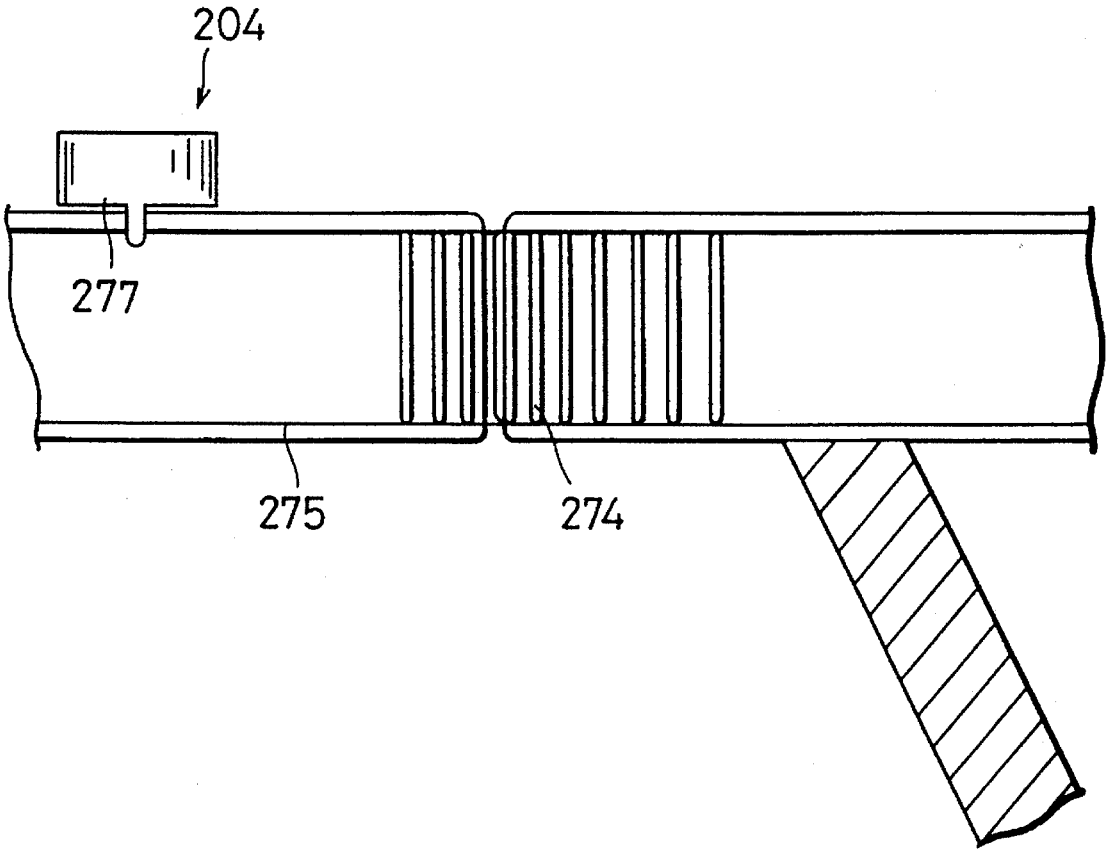
FIG. 20 is an enlarged view illustrating in detail an upper part of a hopper main body and a hopper driving section as essential sections of the developing device of FIG. 18.

FIG. 20 illustrates in detail the upper part of the hopper main body 202 and the hopper driving section 204 enclosed by a circle A in FIG. 18. A gear 274 is attached to the periphery of the top of the hopper main body 202. The hopper driving section 204 includes a drive motor 277, and a gear 275 attached to the drive shaft of the drive motor 277. The gear 275 meshes with the gear 274 attached to the hopper main body 202. As the drive motor 277 is rotated, the hopper main body 202 is rotated in the direction of arrow M shown in FIG. 18 (rotated around the center axis of the hopper main body 202).

Figure 21A:
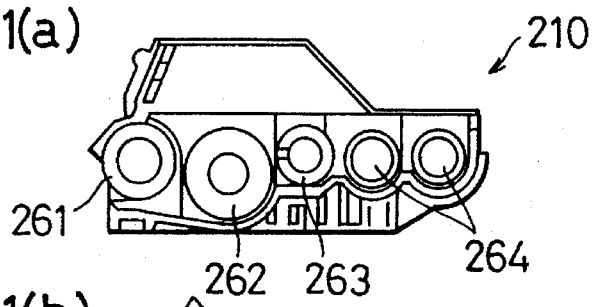
FIGS. 21(*a*) and 21(*b*) illustrate an internal structure of a developer container in the developing device of FIG. 18, FIG. 21(*a*) being a schematic side view of the developing device, FIG. 21(*b*) being a schematic plan view thereof.
Figure 21B:
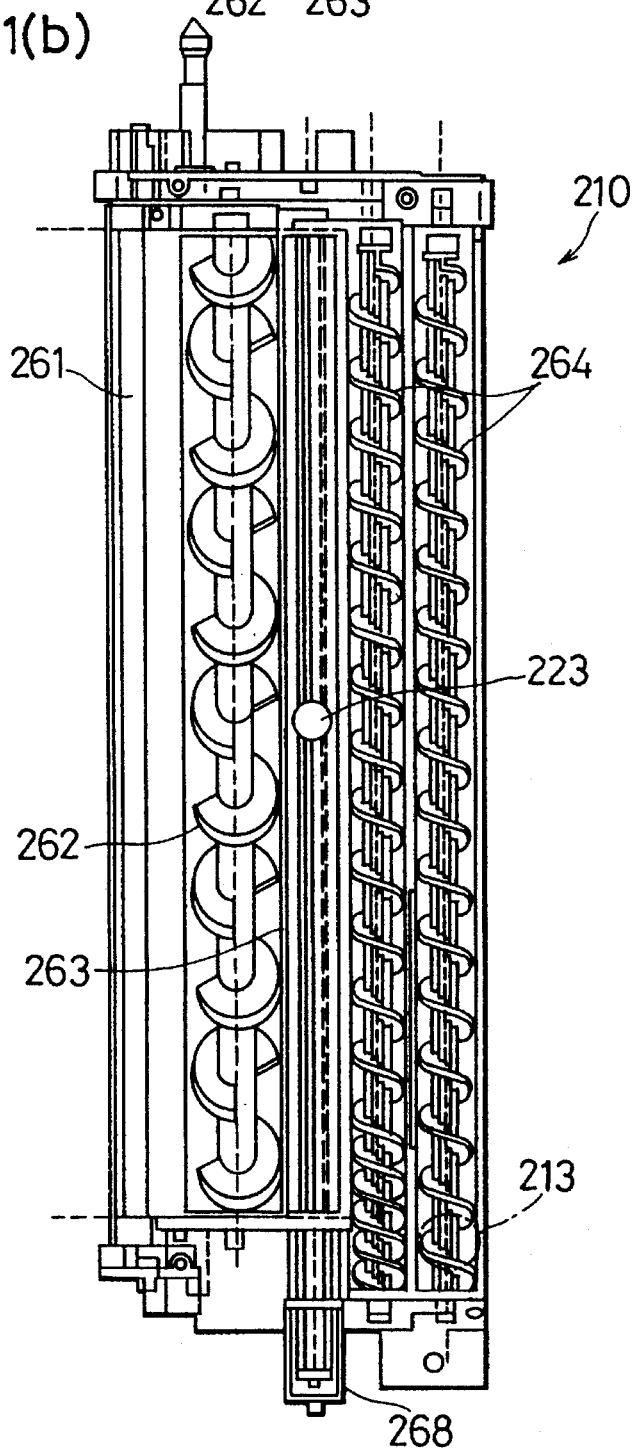

As illustrated in FIGS. 21(*a*) and 21(*b*), the developer container 210 includes a developing roller 261 formed by a magnet roller, an agitating roller 262 and an agitator 263 as an agitating member, and two transport rollers 264. These members are rotatably mounted.

The developer container 210 also includes the toner-concentration detecting sensor 23 for detecting a toner concentration. A detection signal of the toner-concentration detecting sensor 23 is input to a control device. The control device controls the agitating-screw driving section 203 of the developer supply section 200 and the hopper driving section 204 shown in FIG. 18 according to the detection signal so as to rotate the agitating screw 201 and the hopper main body 204. As a result, the developer in the hopper main body 202 is supplied to the developer container 210 through a developer outlet 213 while being agitated.

As illustrated in FIG. 21(*a*), the developer container 210 includes a developer discharge opening 268 through which deteriorated carrier in the developer container 210 is discharged.

Figure 22:
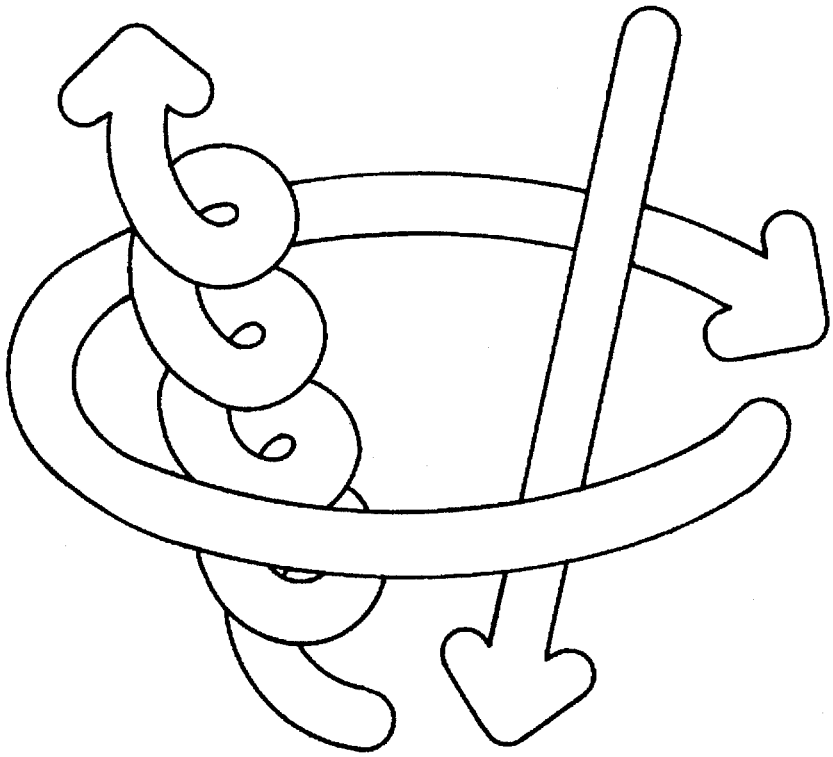
FIG. 22 is a depiction showing a mixing state of toner and carrier in the hopper main body in the developing device of FIG. 18.
Figure 23A:
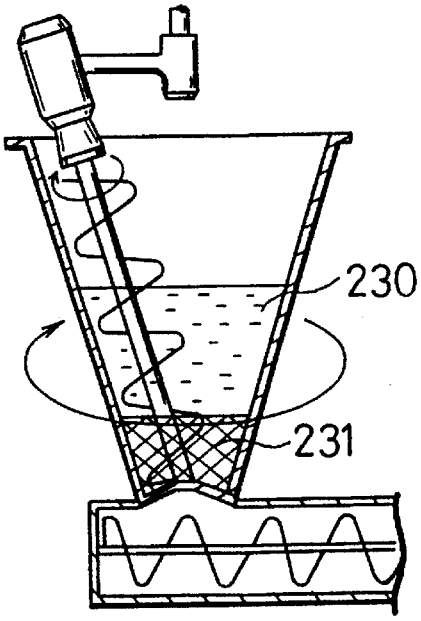
FIGS. 23(*a*) to 23(*d*) are schematic cross sections of the developer supply section showing a mixing state of toner and carrier in the hopper main body in the developing device of FIG. 18.
Figure 23B:
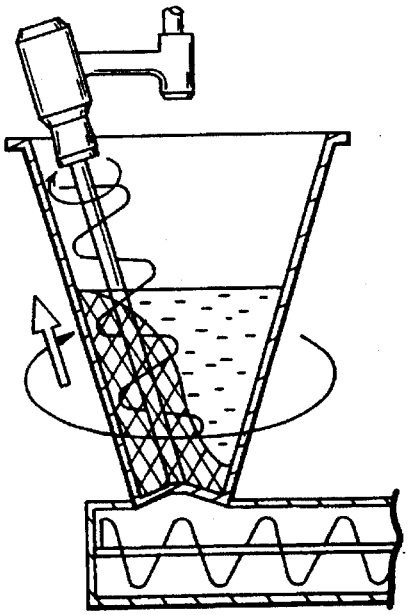
Figure 23C:
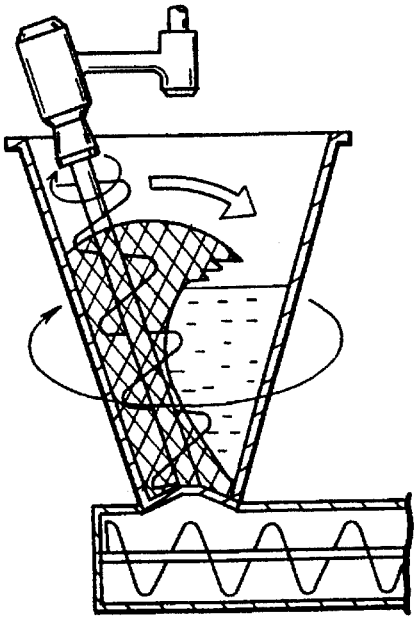
Figure 23D:
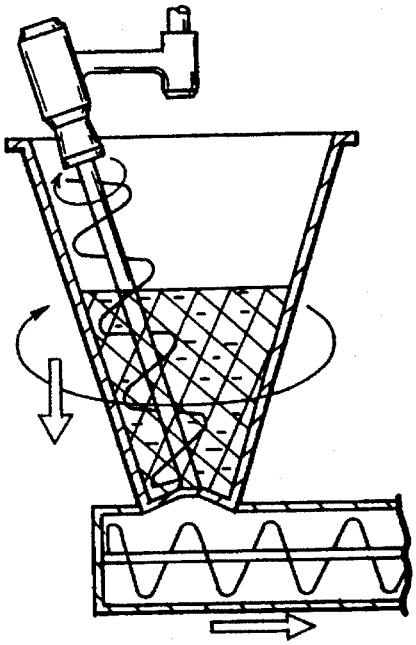

FIG. 22 is a depiction showing a mixing state of toner and carrier as a fundamental action of the present invention. Specifically, FIG. 22 shows a state in which a substance staying in a lower part of the hopper main body 202 is moved upward in a spiral course by the rotation of the agitating screw 201 and evenly mixed with a substance staying in an upper part thereof by the rotation of the hopper main body 202.

FIGS. 23(*a*) and 23(*d*) show a cross section to explain a mixing state of the toner and the carrier in the hopper main body 202 of this embodiment. When a developer including toner and carrier is actually introduced in the hopper main body 202, carrier with a larger specific gravity is piled up in the lower part, while toner with a smaller specific gravity stands in the upper part as shown in FIG. 23(*a*). Consequently, the toner and the carrier in the developer in the hopper main body 202 are not evenly mixed, and the toner concentration in a lower part 231 (indicated by hatching in FIG. 23(*a*)) becomes lower than that in a upper part 230.

Then, by rotating the agitating screw 201 and the hopper main body 202 as shown in FIG. 23(*b*), a developer with a lower toner concentration in a lower part is moved upward to an upper part in an upward rotating direction of the agitating screw 201. At this time, as shown in FIG. 23(*c*), a developer with the lower toner concentration is moved downward and falls onto a developer with a higher toner concentration. This process is repeated many times in the hopper main body 202. As a result, the toner and the carrier are evenly mixed as shown in FIG. 23(*d*).

When the agitating screw 201 is rotated as described above, a pressure is applied around the developer outlet 213, and the developer in the hopper main body 202 is supplied to the developer container 210 through the developer outlet 213. The developer supplied to the developer container 210 is transported toward the agitating roller 262 and the agitator 263 by the transport rollers 264 shown in FIGS. 21(*a*) and 21(*b*), and mixed by the agitating roller 262 and the agitator 263.

Until the supply of the developer from the hopper main body 202 to the developer container 210 is completed, the agitating screw 201 and the hopper main body 202 continue to be rotated. When stopping the supply of the developer, the agitating screw 201 is stopped rotating. Namely, the rotation of the agitating screw 201 is repeatedly started and stopped according to the need for the supply of developer.

[Embodiment 8]

Figure 24:
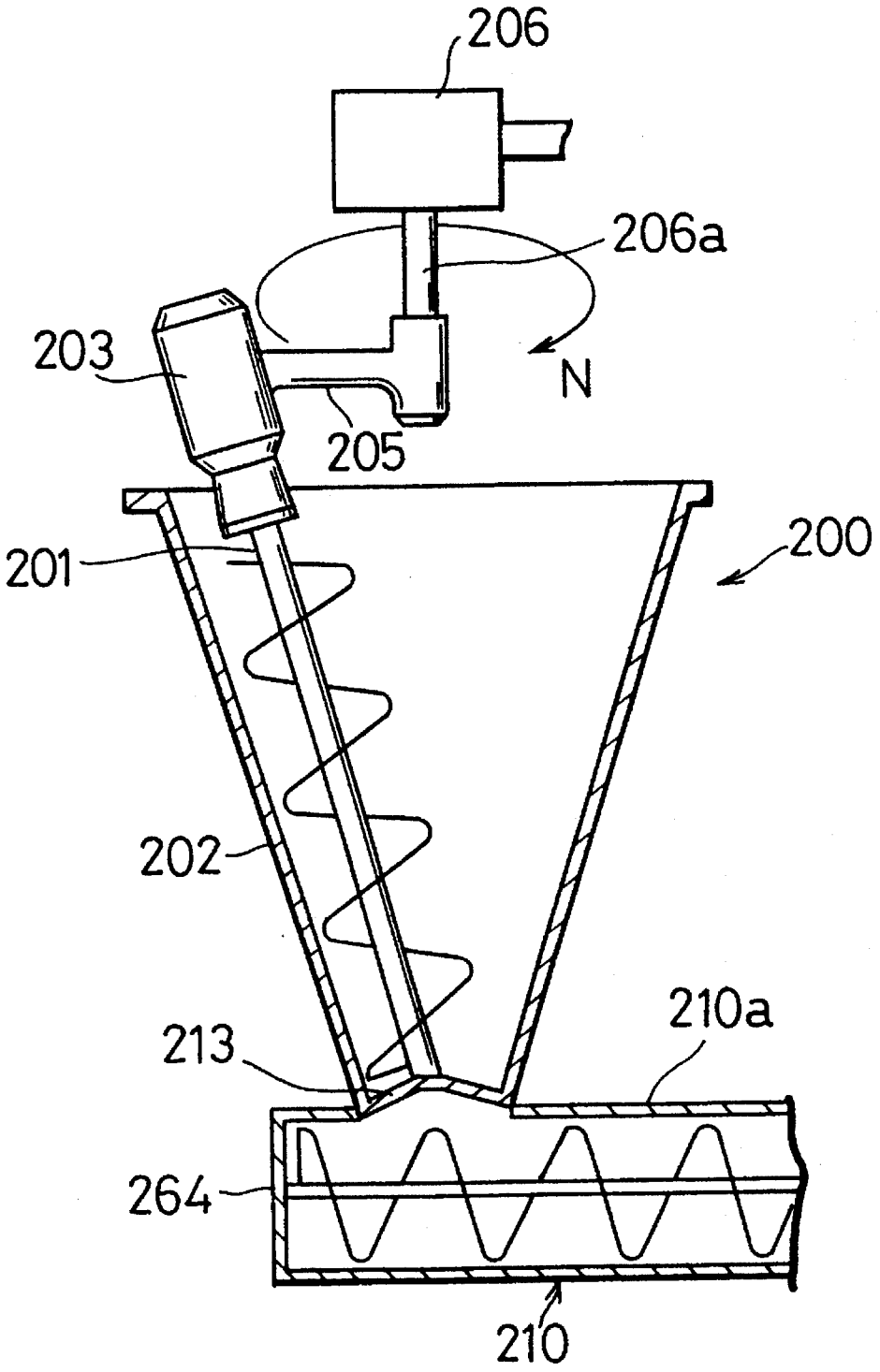
FIG. 24 is a schematic cross section showing a structure of a developer supply section in a developing device according to Embodiment 8 of the present invention.

The following description discusses an eighth embodiment of the present invention with reference to FIG. 24.

The members having the same structure and function as in the above-mentioned embodiments will be designated by the same code and their description will be omitted.

As illustrated in FIG. 24, the developer supply section 200 of a developing device of this embodiment includes a drive motor 206 for rotating an agitating screw 201 in the direction of arrow N in the hopper main body 202. An end of a drive shaft 206*a* of the drive motor 206 is connected to the supporting member 205 for supporting the agitating-screw driving section 203. As the driving shaft 206*a* rotates, the agitating-screw driving section 203 orbits in a circle having a radius corresponding to the length of the supporting member 205. As a result, the agitating screw 201 connected to the agitating-screw driving section 203 revolves in a predetermined orbit in the hopper main body 202.

The hopper main body 202 is fixed to an top wall 210*a* of the developer container 210. The hopper driving section 204 mentioned in Embodiment 7 is not used in this embodiment.

Except for the above-mentioned differences, the structure of the developing device of this embodiment is the same as that in Embodiment 7.

The developing device of this embodiment produces the same effects as Embodiment 7 due to the following reasons. In Embodiment 7, the hopper main body 202 is rotated. Whereas, in this embodiment, the hopper main body 202 is not rotated, but the agitating screw 201 revolves in the predetermined orbit in the hopper main body 202. The differences between these two embodiments are the rotation of the hopper main body 202 and the revolution of the agitating screw 201. Considering relative movements of the hopper main body 202 and the agitating screw 201, a common characteristic in these embodiments is the movement of the agitating screw 201 in the hopper main body 202.

Therefore, similar to Embodiment 7, in this embodiment, as illustrated in FIG. 22, a substance (a developer with a lower toner concentration) standing in the lower part of the hopper main body 202 is moved upward in a spiral course with the rotation of the agitating screw 201, and evenly mixed with a substance (a developer with a higher toner concentration) in the upper part thereof as the agitating screw 201 revolves in the hopper main body 202. It is thus possible to supply a developer of a uniform toner concentration into the developer container 210

[Embodiment 9]

Figure 25:
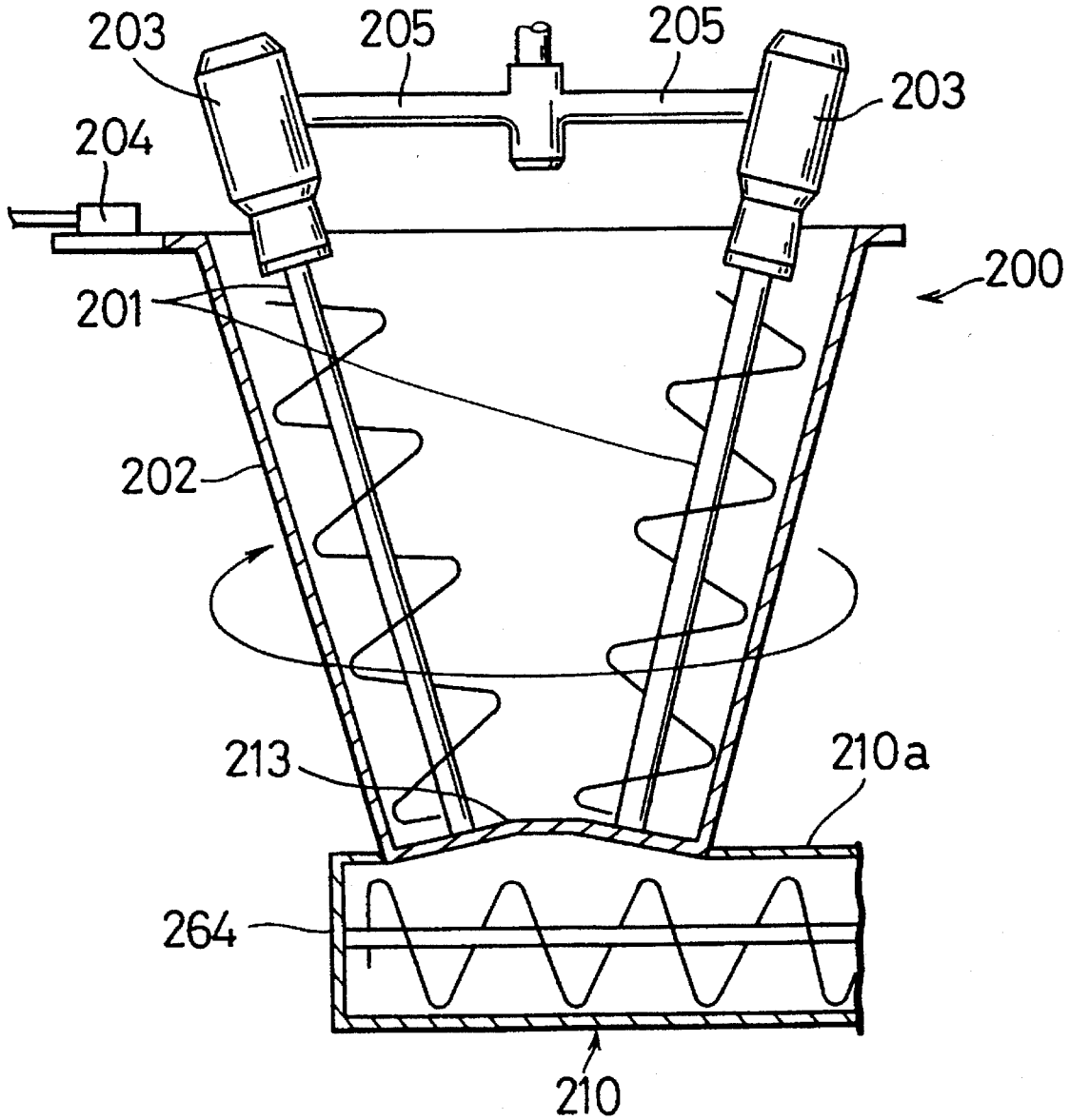
FIG. 25 is a schematic cross section showing a structure of a developer supply section in a developing device according to Embodiment 9 of the present invention.
Figure 26A:
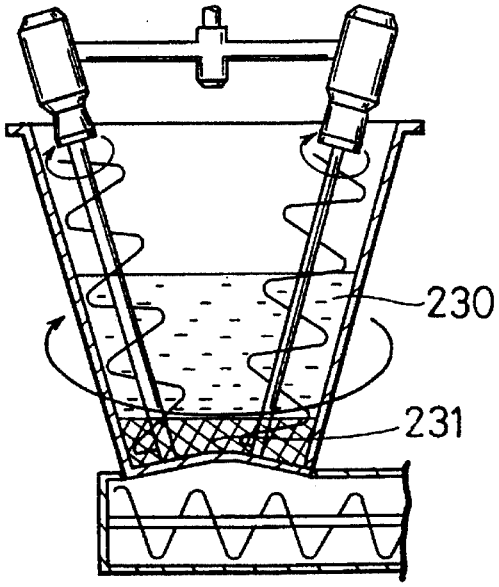
FIGS. 26(*a*) to 26(*d*) are schematic cross sections of the developer supply section showing a mixing state of toner and carrier in a hopper main body in the developing device of FIG. 25.
Figure 26B:
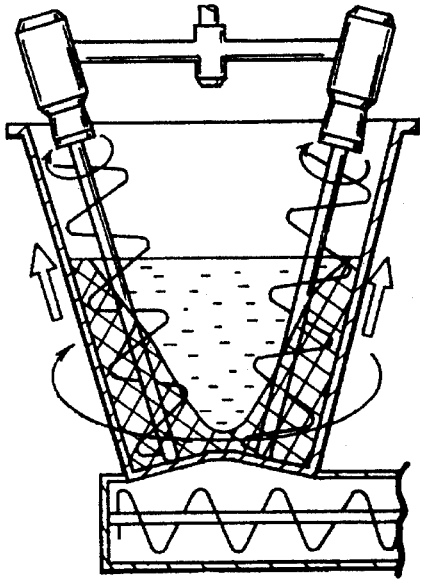
Figure 26C:
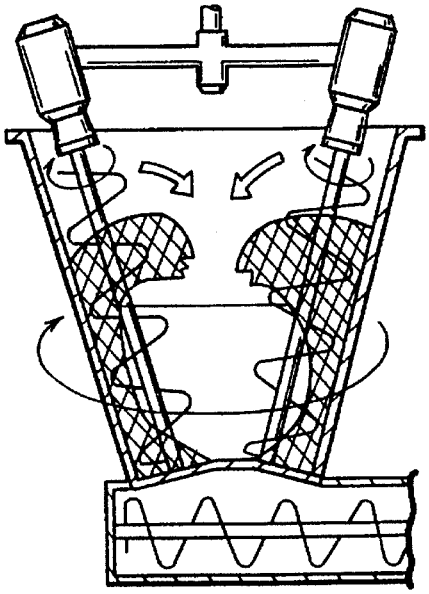
Figure 26D:
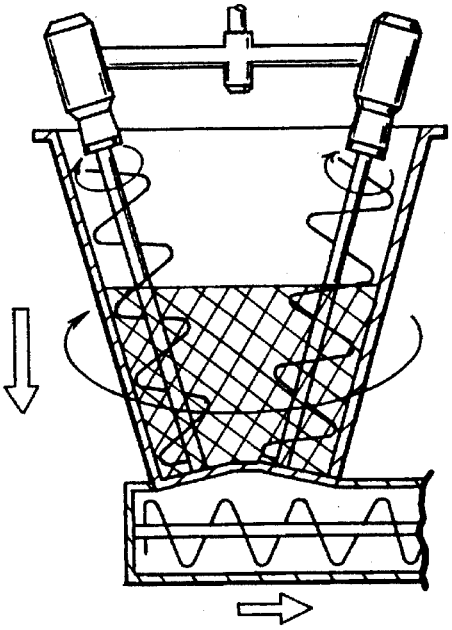
Figure 27:
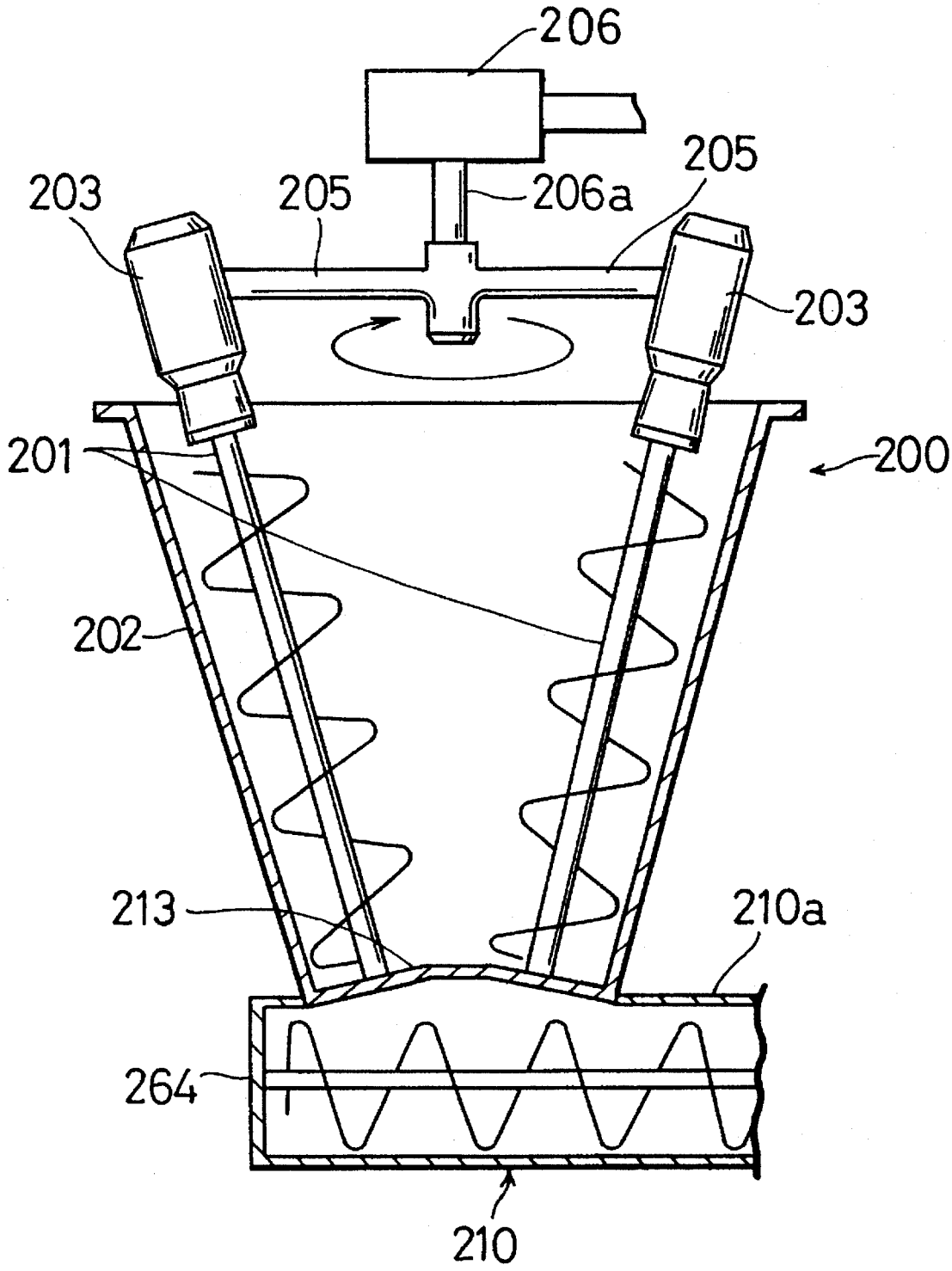
FIG. 27 is a schematic cross section of a modified example of the developing device according to Embodiment 9 of the present invention.

The following description discusses a ninth embodiment of the present invention with reference to FIGS. 25 to 27.

The members having the same structure and function as in the above-mentioned embodiments will be designated by the same code and their description will be omitted.

As illustrated in FIG. 25, the developer supply section 200 includes two agitating screws 201 in the hopper main body 202. The agitating screws 201 are connected to the agitating-screw driving sections 203 for rotating the agitating screws 201.

Except for the above-mentioned differences, the structure of the developing device of this embodiment is the same as that in Embodiment 7.

FIGS. 26(*a*) to 26(*d*) show a cross section to explain a mixing state of toner and carrier in the hopper main body 202 of this embodiment. When a developer including toner and carrier is actually introduced into the hopper main body 202, carrier with a larger specific gravity is piled up in the lower part of the hopper main body 202, while carrier with a smaller specific gravity stands in the upper part thereof as shown in FIG. 26(*a*). Consequently, the toner and the carrier in the developer in the hopper main body 202 are not evenly mixed, and the toner concentration in the lower part 231 (indicated by hatching in FIG. 26(*a*)) becomes lower than that in the upper part 232.

Then, by rotating both the agitating screws 201 and the hopper main body 202 as shown in FIG. 26(*b*), the developer with a lower toner concentration in the lower part is moved upward to the upper part in an upward rotating direction of the agitating screws 201. At this time, as shown in FIG. 26(*c*), the developer with the lower toner concentration is moved downward and falls onto the developer with a higher toner concentration. This process is repeated many times in the hopper main body 202. As a result, the toner and the carrier are evenly mixed as shown in FIG. 26(*d*). Since the developer in the hopper main body 202 is agitated by the two agitating screws 201, agitation is carried out more efficiently compared to Embodiment 7.

As described above, when the agitating screws 201 are rotated, a pressure is applied around the developer outlet 213, and the developer in the hopper main body 202 is supplied to the developer container 210 through the developer outlet 213. Until the supply of the developer from the hopper main body 202 to the developer container 210 is completed, the agitating screws 201 and the hopper main body 202 continue to be rotated. When stopping the supply of the developer, the agitating screws 201 are stopped rotating. Namely, the rotations of the agitating screws 201 are started and stopped repeatedly according to the need for the supply of developer.

Additionally, it is also possible to arrange the agitating screws 201 to revolve in the hopper main body 202 as shown in FIG. 27 instead of rotating the hopper main body 202.

As described above, a developing device according to Embodiments 7 to 9 includes:

a developer container for storing a developer including toner and carrier;

agitating means for agitating the developer in the developer container;

a developing roller for bringing the developer in the developer container agitated by the agitating means into contact with the electrostatic latent image;

developer supply means for successively supplying a supply developer including toner and carrier to the developer container; and developer discharge means for discharging the developer in the developer container as the supply developer is supplied to the developer container by the developer supply means, the developer supply means including:

a supply-developer storage section for storing the supply developer including a mixture of toner and carrier;

at least one transporting means, disposed in the supply-developer storage section, for transporting the developer deposited in a lower part of the supply-developer storage section toward an upper part thereof; and driving means for changing relative positions of the transporting means in the supply-developer storage section and the supply-developer storage section by driving at least one of the supply-developer storage section and the transporting means, for agitating the supply developer in the supply-developer storage section, wherein the toner and the carrier in the supply-developer storage section are evenly mixed by changing the relative positions of the transporting means and the supply-developer storage section by the driving means while transporting the developer deposited in the lower part of the supply-developer storage section toward the upper part thereof by the transporting means.

With this structure, since the toner and the carrier in the supply-developer storage section are evenly mixed, the developer is supplied to the developer container while maintaining a uniform toner concentration. It is thus possible to maintain a uniform replacement ratio of the developer in the developer container and to continue satisfactory development.

[Embodiment 10]

The following description discusses a tenth embodiment of the present invention with reference to FIGS. 28 to 37.

The members having the same structure and function as in the above-mentioned embodiments will be designated by the same code and their description will be omitted.

Figure 31:
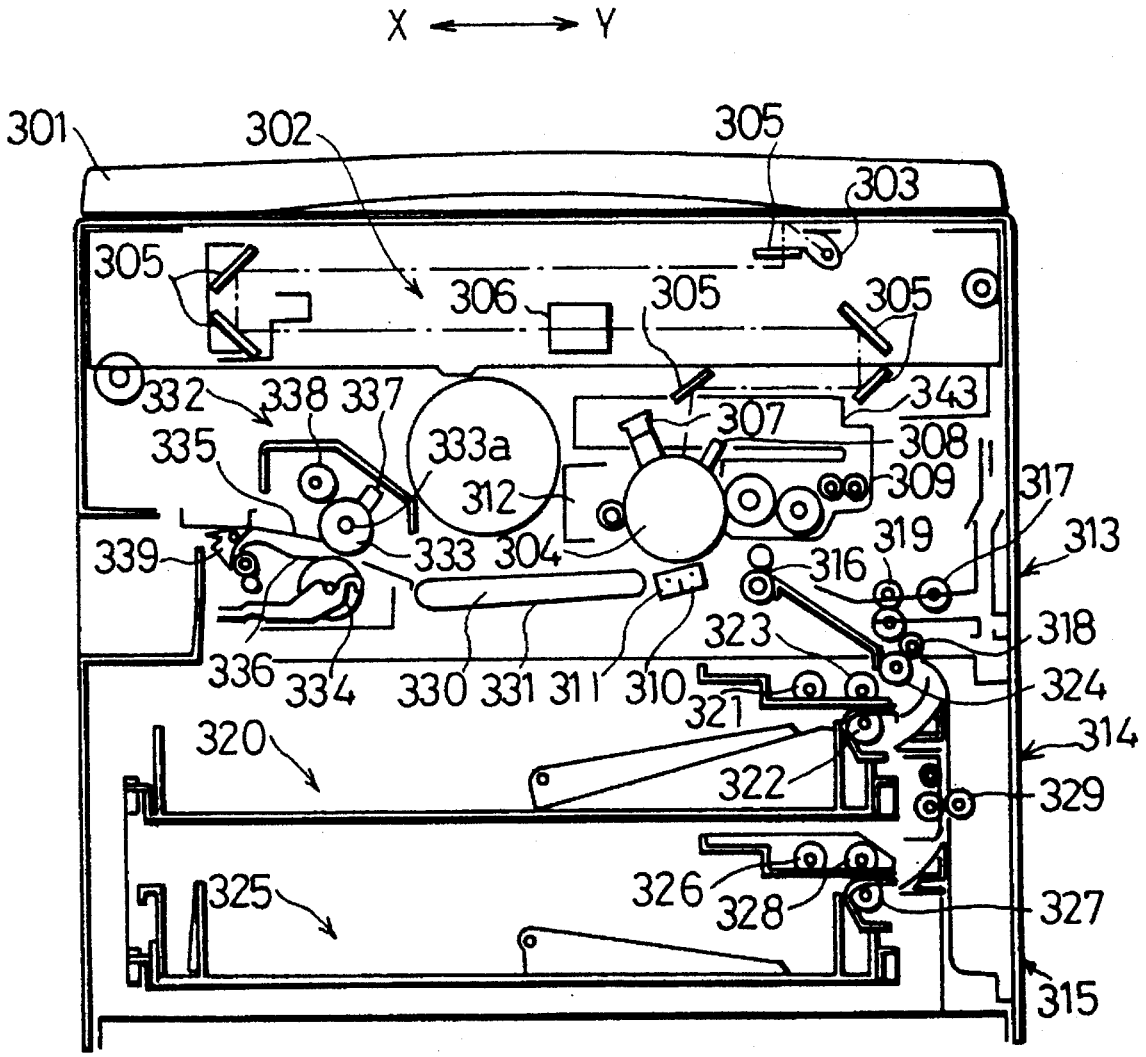
FIG. 31 illustrates a schematic structure of a copying machine incorporating the developing device of FIG. 28.

As illustrated in FIG. 31, a copying machine constructed using the present invention includes a document platen 301 located on an upper surface thereof, and an exposure optical system 302 disposed below the document platen 301. The exposure optical system 302 is formed by a light source lamp 303 which scans a document. (not shown) placed on the document platen 301 while applying light to the document, a plurality of reflecting mirrors 305 for directing reflected light from the document toward a photoreceptor 4, and a lens unit 306 disposed on the light path of the reflected light. The size of the toner image to be transferred to a sheet is changed by moving the lens unit 306 in the directions of arrows X and Y.

Disposed around the photoreceptor drum 304 are a charger 307 for charging the surface of the photoreceptor drum 304 to a predetermined potential, a blank lamp 308 for removing residual charges on the surface of the photoreceptor drum 304, an eraser (not shown), a developing device 309 for developing an electrostatic latent image formed on the surface of the photoreceptor drum 304, a transfer charger 310 for transferring the toner image from the surface of the photoreceptor drum 304 to a sheet, a separating charger 311 for separating the sheet from the photoreceptor drum 304, and a cleaner unit 312 for collecting residual toner on the surface of the photoreceptor drum 304. Register rollers 316 for timely supplying a sheet are positioned on one side of the photoreceptor drum 304 from which a sheet is fed toward the photoreceptor drum 304. A manual feed section 313, an upper cassette section 314 and a lower cassette section. 315 as sheet feeding means are disposed on one side of the register rollers 316 from which a sheet is fed toward the register rollers 316.

The manual feed section 313 includes an opening (not shown) into which a sheet is manually inserted, and a manual feed-use pull-in roller 317, a manual feed-use separating roller 318 and manual feed roller 319 arranged in this order from an upstream portion of a sheet transport path. Specifically, as the pull-in roller 317 is rotated, a sheet inserted from the opening is transported to the separating roller 318 and the manual feed roller 319, and then to the register roller 316.

The upper cassette section 314 includes an upper cassette 320, and an upper pull-in roller 321, an upper inverting roller 322, an upper feed roller 323 and an upper transport roller 324 for transporting the sheet from the upper cassette 320 to the register roller 316. These rollers are arranged in this order from an upstream portion of a sheet transport path. Specifically, as the upper pull-in roller 321 is rotated, a sheet fed from the upper cassette 320 is transported to the upper inverting roller 322 and the upper feed roller 323, and then to the register roller 316 by the upper transport roller 324.

The lower cassette section 315 includes a lower cassette 325, and a lower pull-in roller 326, a lower inverting roller 327, a lower feed roller 328 and a lower transport roller 329 for transporting the sheet from the lower cassette 325 to the register roller 316. These rollers are arranged in this order from an upstream. portion of a sheet transport path. Specifically, as the lower pull-in roller 326 is rotated, a sheet fed from the lower cassette 325 is transported to the lower inverting roller 327 and the lower feed roller 328, and then to the register roller 316 through the lower transport roller 329 and the upper transport roller 324.

A sheet fed from the manual feed section 313, the upper cassette section 314, and the lower cassette section 315 stands by at the position of the register roller 316, and then transported in synchronism with the start of reading a document, i.e., the start of development.

A suction unit 330 for transporting the sheet onto which the toner image has been transferred is disposed on the other side of the photoreceptor drum 304 from which the sheet is discharged. The suction unit 330 transports the sheet to a fixing unit 332 by a rotating movement of a suction belt 331.

The fixing unit 332 includes an upper heat roller 333 having therein a heater lamp 333a and a lower heat roller 334. The upper heat roller 333 and the lower heat roller 334 are disposed to be pressed against each other. Provided on the sheet discharging side of the upper heat roller 333 and the lower heat roller 334 are an upper separating claw 335 and a lower separating claw 336.

Positioned above the upper heat roller 333 are a fixing thermistor 337 for controlling the temperature of the heater lamp 333a and an upper cleaning roller 338 for removing toner remaining on the surface of the upper heat roller 333.

Formed on the sheet discharging side of the fixing unit 332 is a sheet separating gate 339 for discharging a sheet carrying images fused thereon after separating it for a tray.

Figure 28:
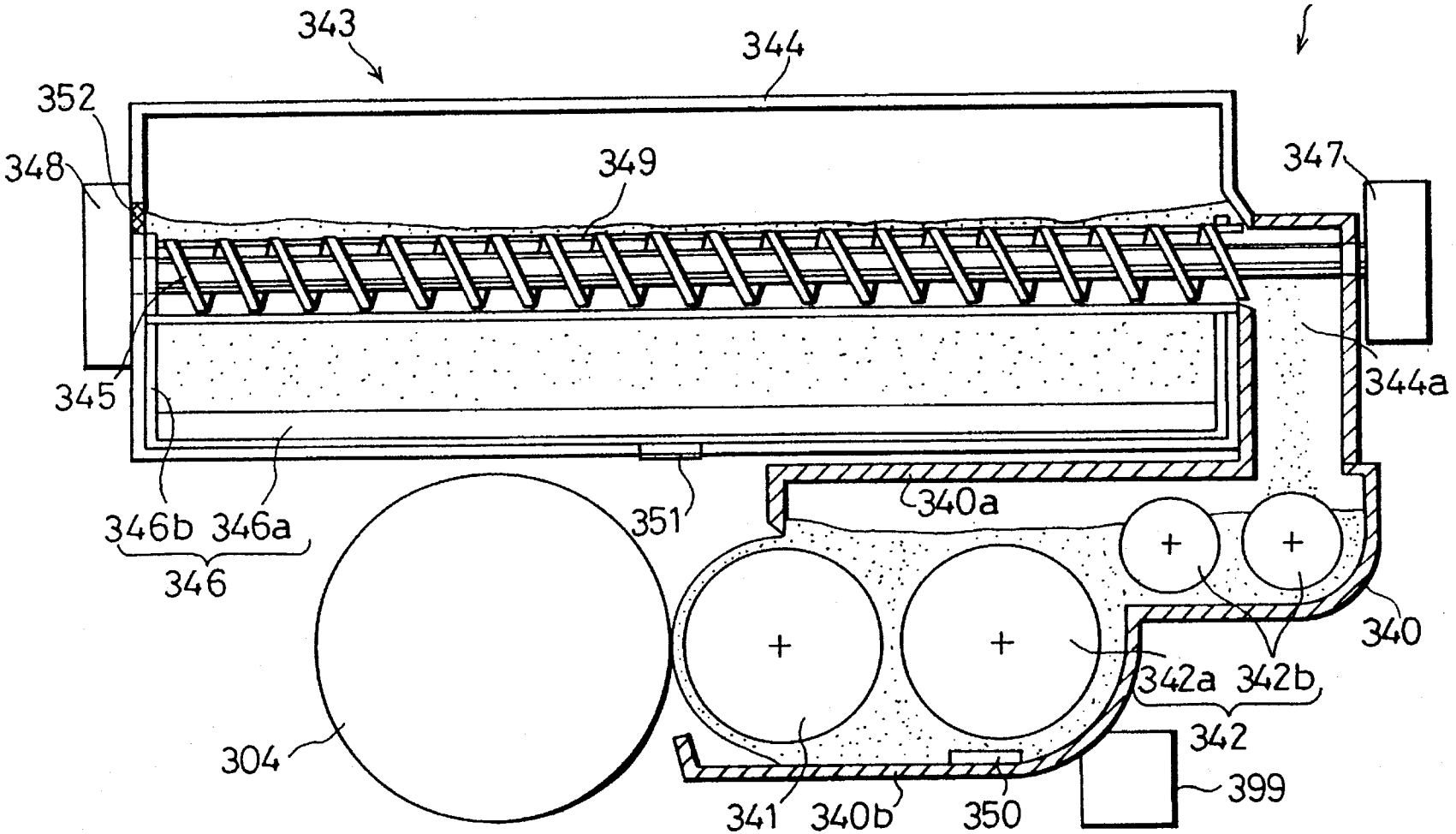
FIG. 28 is a schematic structure of a developing device according to Embodiment 10 of the present invention.
Figure 29:
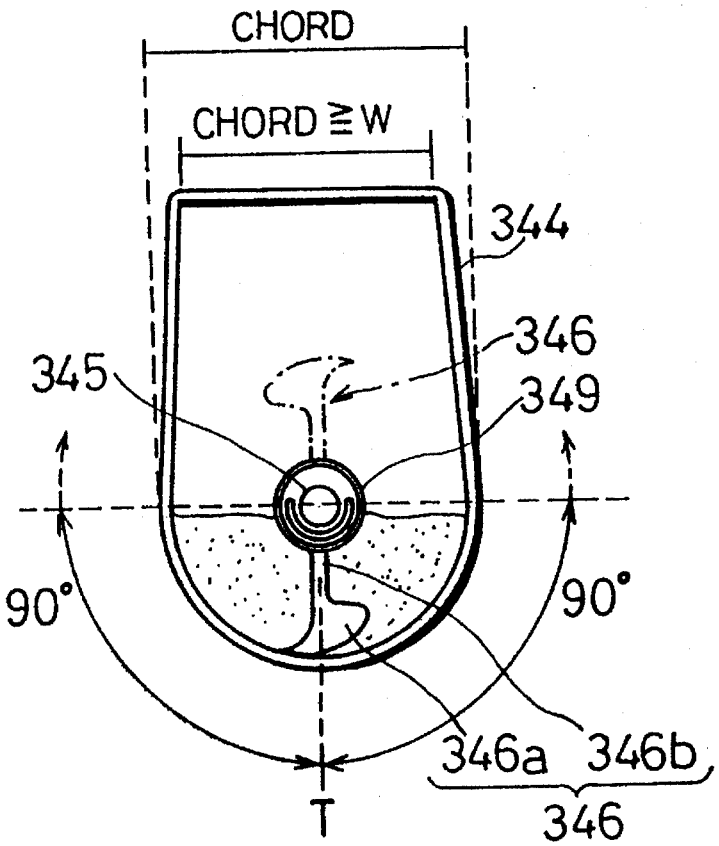
FIG. 29 is a side view of a developer hopper in the developing device of FIG. 28.
Figure 30:
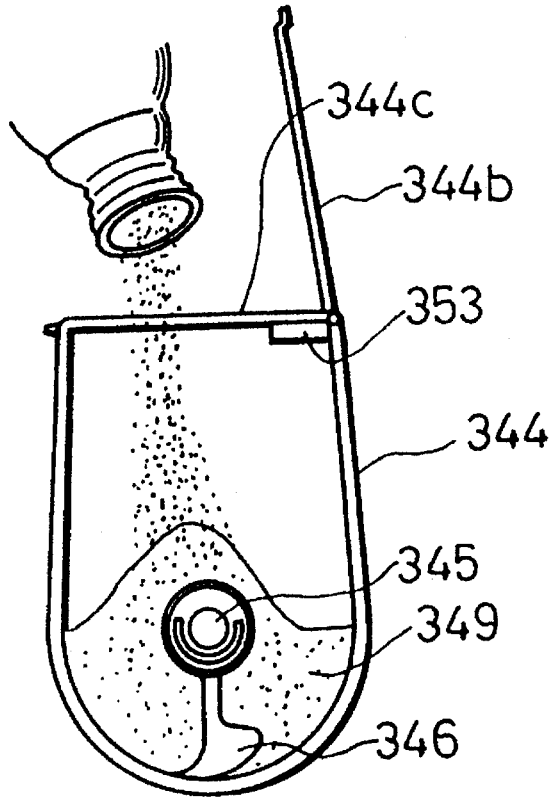
FIG. 30 is an explanatory view showing a state in which the developer is supplied by opening a door of the developer hopper in the developing device of FIG. 28.

Referring now to FIGS. 28 to 30, the following description explains the developing device 309 incorporated in a copying machine having the above-mentioned structure.

As illustrated in FIG. 28, the developing device 309 includes a developer container 340 having therein a developing roller 341 formed by a magnet roller, and an agitating roller 342 (agitating means). The developing roller 341 and the agitating roller 342 are rotatably mounted. A developer stored in the developer container 340 includes carrier and toner. The carrier made of a magnetic substance has a resin coat layer for restraining the toner from adhering to the carrier surface. When the carrier and the toner are agitated by the agitating roller 342, the toner is charged by friction. The developing roller 341 transports the carrier by attracting the carrier with a magnetic force and forming a magnetic brush. At this time, developing is performed by supplying the toner adhering to the carrier due to the Coulomb force to the photoreceptor drum 304 and attracting the toner to the electrostatic latent image on the photoreceptor drum 304.

The agitating roller 342 has a big agitating roller 342*a* positioned near the developing roller 341, and two small agitating rollers 342*b* disposed near a position where the developer is supplied from a developer supply unit 343 as to be described later. The small agitating rollers 342*b* transport the supplied developer toward the big agitating roller 342*a* while agitating the developer. The developer in the developer container 340 is thus sufficiently charged, and the charging performance thereof is maintained.

A developer supply opening is formed in a top wall 340*a* of the developer container 340. The developer supply unit (developer supply section) 343 is positioned above the developer supply opening to fit into the opening. The developer supply unit 343 stores a developer including a mixture of toner and carrier (hereinafter just referred to as the developer), and supplies the developer to the developer container 340. Mounted on a bottom wall 340*b* of the developer container 340 is a discharging mechanism 399 (discharging section) for forcefully discharging deteriorated developer from the developer container 340. The developer container 340 includes therein a toner-concentration detecting sensor 350, mounted on the bottom wall 340*b*, for detecting a toner concentration in the developer in the developer container 340.

The developer supply unit 343 includes a developer hopper 344 (developer storage section) in the shape of a container. The developer hopper 344 stores a developer whose toner concentration is higher than a toner concentration in the developer stored in the developer container 340. The reason for this is that the amount of toner consumed is larger than an amount of carrier replaced in the developer container 340.

The developer hopper 344 has a transport screw 345 (developer transporting section) for transporting the developer, and a collecting member 346 (developer collecting section) for collecting the developer from the bottom of the developer hopper 344. The transport screw 345 and the collecting member 346 are rotatably mounted.

The transport screw 345 is substantially centered in a substantially U-shaped toner receiving section 349 (developer receiving section shown in FIG. 29) which is placed in a longitudinal direction of the developer hopper 344 at the substantially center thereof. The transport screw 345 transports the developer which has been shovelled into the toner receiving section 349 by the collecting member 346. The developer collected in the toner receiving section 349 is discharged through a discharge opening 344*a* formed at an end of the developer hopper 344 by the transport screw 345. The discharge opening 344*a* is connected to the developer supply opening of the developer container 340.

The collecting member 346 includes a shovelling section 346*a* of a length substantially equal to that of the toner receiving section 349, and supporting shafts 346*b* attached to both the ends of the shovelling section 346*a* to support the shovelling section 346*a*. As illustrated in FIG. 29, the supporting shafts 346*b* are freely rotatable around the toner receiving section 349.

Moreover, by shaping the bottom section of the developer hopper 344 into an arc corresponding to a rotating movement of the collecting member 346 as shown in FIG. 29, the efficiency of collecting the developer in the developer hopper 344 is improved.

More specifically, the overall shape of the developer hopper 344 is arranged such that the bottom section forms an arc of at least 180° with a reference point T shown in FIG. 29 as the midpoint of the arc and that an upper section above the bottom section has a width W which is not larger than the chord of the arc (chord≧W). With this arrangement, unless the bottom section of the developer hopper 344 has a steep stair-stepped shape, the carrier in the developer staying on the bottom section of the developer hopper 344 due to its own weight is agitated together with the toner by the rotation of the collecting member 346. As a result, the mixture having a uniform toner concentration is shovelled into the toner receiving section 349, and transported to the developer container 340 by the transport screw 345. It is thus possible to transport the whole developer in the developer hopper 344 to the developer container 340.

As illustrated in FIG. 28, the transport screw 345 and the collecting member 346 are driven by a transport-screw drive motor 347 and a collecting-member drive motor 348, respectively. These drive motors 347 and 348 are controlled by a control device 354 (see FIG. 32), to be described later.

In addition, in the developer hopper 344, as illustrated in FIG. 28, a remaining-developer detecting sensor 351 is mounted on the bottom section, and a developer-level detecting sensor 352 is installed on a position of a side wall higher than the transport screw 345. The remaining-developer detecting sensor 351 detects a remaining amount of developer in the developer hopper 344. When the control device 354 judges from a detection signal of the remaining-developer detecting sensor 351 that the remaining amount is less than a predetermined amount, it turns on a warning lamp 357 (see FIG. 32) on a control panel (not shown) so as to inform a user a need of the supply of developer, and stops the rotation of the collecting member 346. The developer-level detecting sensor 352 detects if the level of the developer in the developer hopper 344 becomes lower than the upper edge of the transport screw 345. When the control device 354 judges from a detection signal of the developer-level detecting sensor 352 that the amount of developer is less than a predetermined amount, it starts the rotation of the collecting member 346.

As illustrated in FIG. 30, the developer hopper 344 includes a developer supply opening 344*c* formed in a top section thereof, and a door 344*b* for opening and closing the developer supply opening 344*c*. Disposed in the vicinity of the developer supply opening 344*c* is a door-movement detecting sensor 353 for detecting if the door 344*c* is opened or closed. When the control device 354 detects from a detection signal of the door-movement detecting sensor 353 that the door 344*b* is open, it starts the rotation of the collecting member 346.

Next, a copying operation performed in a copying machine having the above-mentioned structure is discussed below with reference to FIG. 31.

When an electric power switch (not shown) is turned on, a warm-up operation is performed. When a copying start switch 355 shown in FIG. 32, to be described later, is turned on after the warm-up operation, the light source lamp 303 of the exposure optical system 302 scans a document on the document platen 301. At this time, reflected light from the document is directed to the photoreceptor drum 304 by the reflecting mirrors 305 and the lens unit 306, and an electrostatic latent image is formed on the surface of the photoreceptor drum 304 which has been charged to a predetermined potential by the charger 307.

Then, the electrostatic latent image is developed by the toner supplied from the developing device 309. The toner attracted to the surface of the photoreceptor drum 304 is put on a sheet supplied from the manual feed section 313, the upper cassette section 314 or the lower cassette section 315, and transferred by the transfer charger 310. The sheet carrying the transferred toner image thereon is separated from the photoreceptor drum 304 by the separating charger 311.

After the transfer of the electrostatic latent image, toner remaining on the surface of the photoreceptor drum 304 is removed by the cleaner unit 312. Also, the blank lamp 308 removes from the surface of the photoreceptor drum 304 residual charges which would cause adverse effects on the contrast when copying is performed, repeatedly.

The sheet carrying the transferred toner image thereon is separated from the photoreceptor drum 304, transported to the fixing unit 332 by the movement of the suction belt 331 upon the suction unit 330, and sandwiched by the upper and lower heat rollers 333 and 334 so as to fuse the toner image on the sheet. Through this process, images corresponding to the document images are formed on the sheet.

Figure 32:
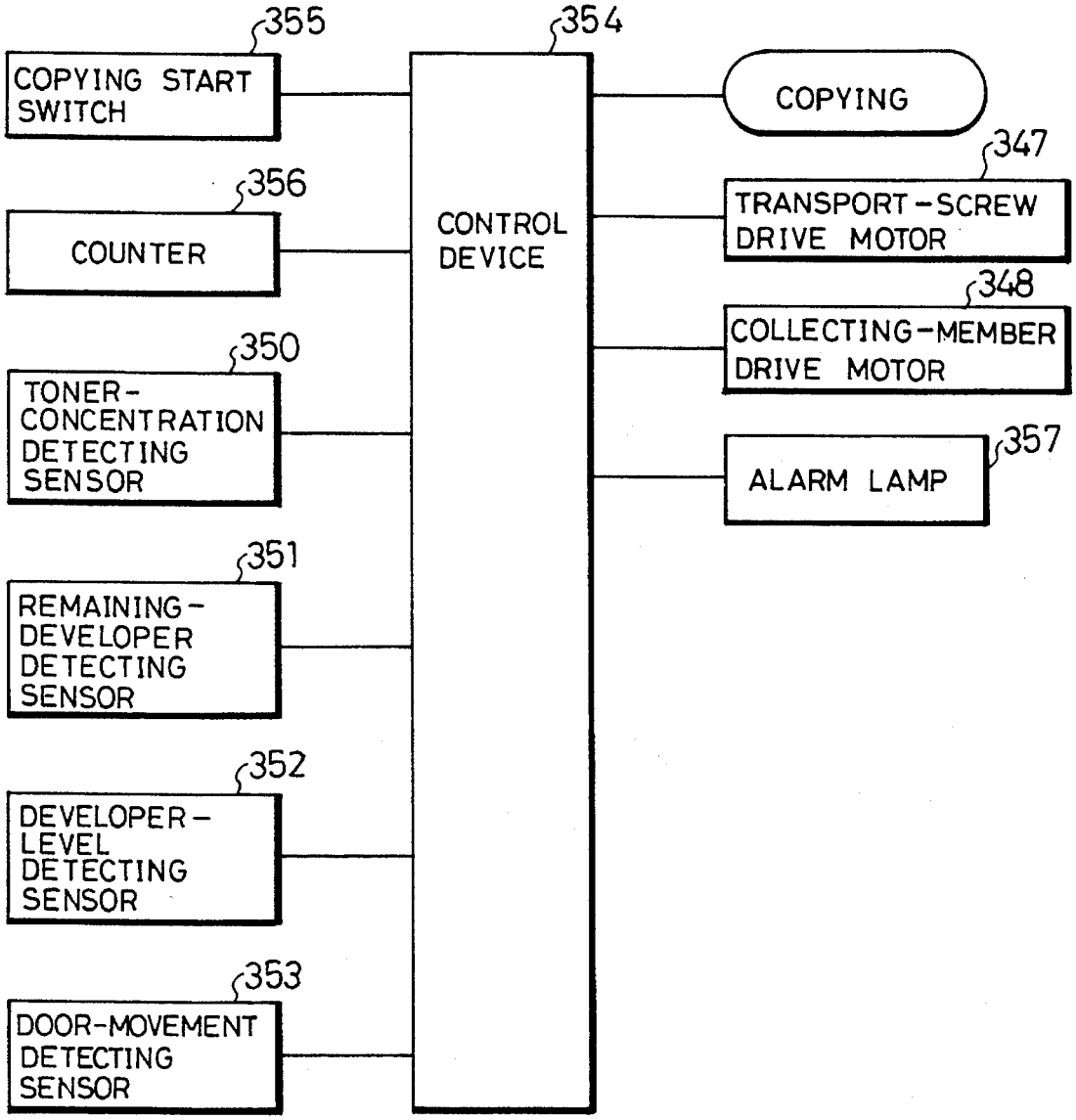
FIG. 32 is a control block diagram of a control device in the copying machine of FIG. 31.

In order to control such a sequence of copying operations, as illustrated in FIG. 32, the control device 354 including a microcomputer is incorporated into the copying machine, and a signal for turning on the copying start switch 355 is input to the control device 354. A counter 356 for counting the total number of copying operations performed is provided. A value n counted by the counter 356 (hereinafter just referred to as the copy count) is also input to the control device 354.

When such a copying operation is repeatedly performed, the toner in the developer stored in the developer container 340 of the developing device 309 is gradually consumed. Then, the ratio of toner to carrier, i.e., the toner concentration decreases. A change in the toner concentration is detected by the toner-concentration detecting sensor 350, and the transport screw 345 is controlled by the control device 354. More specifically, when a signal detected by the toner-concentration detecting sensor 350 indicates that the toner concentration is lowered to the lower limit of an appropriate development range, the transport screw 354 is started to rotate by the detection signal from the toner-concentration detecting sensor 350. Then, the developer in the developer hopper 344 is supplied into the developer container 340, and the toner concentration in the developer container 340 is increased. When the toner concentration reaches the upper limit of the appropriate range, the transport screw 345 is stopped by the detection. signal of the toner-concentration detecting sensor 350. With this control, the toner concentration in the developer container 340 is maintained within the appropriate range. The control device 354 compares a value (hereinafter referred to as TC signal value) detected by the toner-concentration detecting sensor 350 and a predetermined reference value, and controls the rotation speed of the transport screw 345 according to a difference between the TC signal value and the reference value, i.e., a change in the TC signal value.

The supplied developer is agitated together with the developer in the developer container 340 so as to be charged to a uniform level, and supplied to the developer container 340 for use in development. Meanwhile, the carrier in the developer does not decrease and repeatedly used. Therefore, as the frequency that the carrier is agitated by the developing roller 341 and the agitating roller 342 and brought into contact with the photoreceptor drum 304 increase, the carrier deteriorates gradually. If the carrier deteriorates, the toner can not be charged to a predetermined level, resulting in degraded copy quality. Degradation of the charging performance is avoided by newly supplying carrier to replace the deteriorated carrier in the developer container 340. In order to achieve this object, the control device 354 controls the discharging mechanism 399 mounted on the bottom wall **340*b* of the developer container 340 to forcefully discharge the deteriorated carrier. Namely, the control device 354** functions as supply and discharge controlling means.

Figure 33:
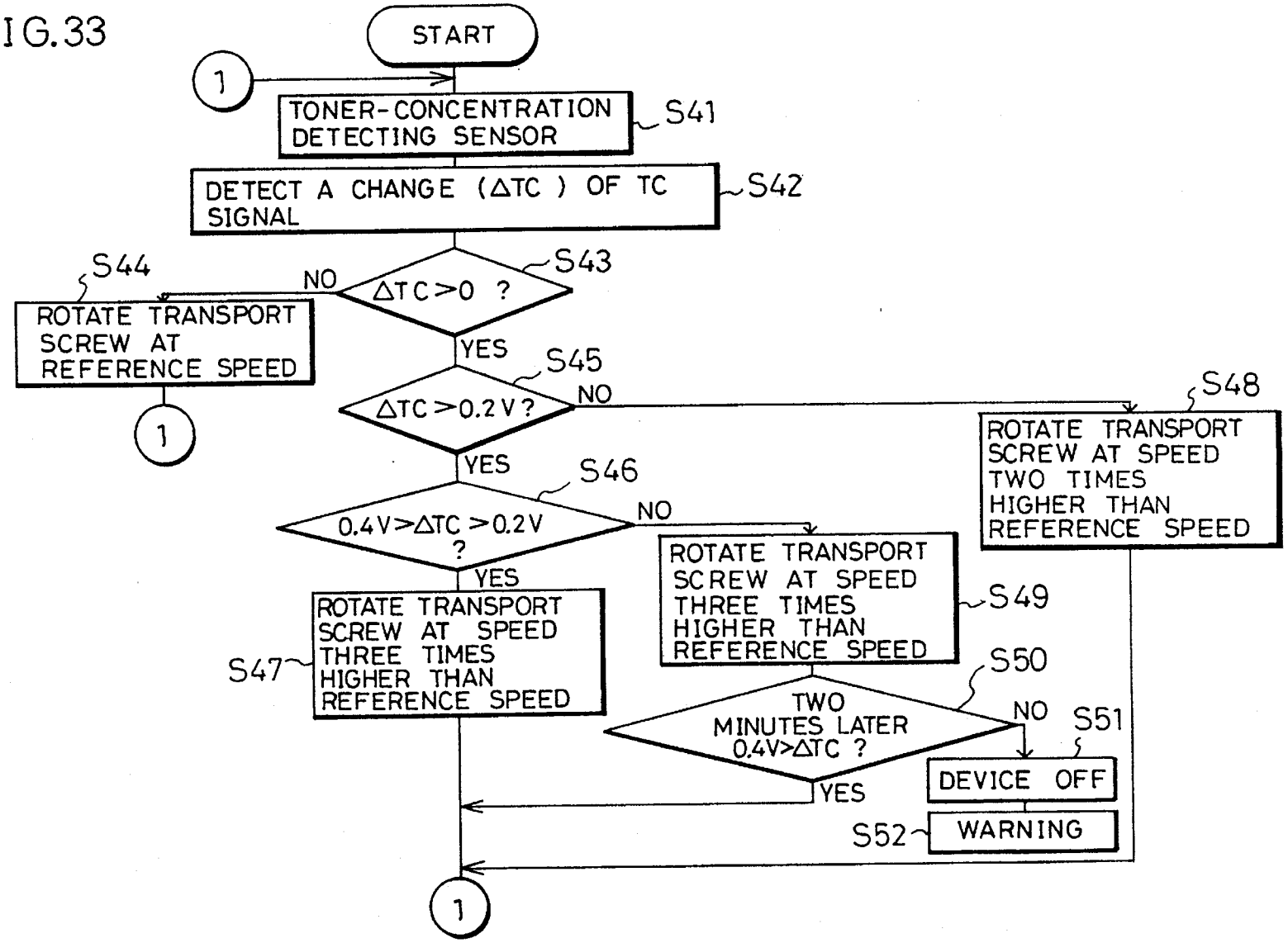
FIG. 33 is a flowchart showing how the control device of FIG. 32 controls the supply of developer from a developer supply unit.

The control process carried out by the control device 354 as the supply and discharge controlling means is explained below with reference to the flowchart of FIG. 33. The control is actually executed during a development operation performed by the developing device. The TC signal value is determined beforehand.

First, a toner concentration in the developer container 340 is detected by the toner-concentration detecting sensor 350 (Step 41). The control device 354 detects a change (ΔTC) in the TC signal value based on the reference signal (Step 42).

Next, whether ΔTC detected in Step 42 is larger than zero or not is judged (Step 43). When the toner concentration in the developer in the developer container 340 is lower than a reference concentration, ΔTC representing the difference between the TC signal value and the reference value is positive. On the other hand, when the toner concentration is higher than the reference concentration, ΔTC is negative.

In Step 43, when ΔTC is not larger than zero (i.e., when the toner concentration in the developer in the developer container 340 is not lower than the reference toner concentration), the transport screw 345 is rotated at a predetermined reference rotation speed (Step 44) and the operation moves to Step 41.

On the contrary, in Step 43, when ΔTC is larger than zero (i.e., when the toner concentration in the developer in the developer container 340 is lower than the reference toner concentration), whether ΔTC detected in Step 42 is larger than 0.2 V or not is judged (Step 45). If ΔTC is larger than 0.2 V, whether ΔTC is in a range of 0.4 V>ΔTC>0.2 V or not is judged (Step 46). If ΔTC is in a range of 0.4 V>ΔTC>0.2 V, the transport screw 345 is rotated at a speed which is linearly three times higher than the predetermined reference rotation speed so as to quickly supply the developer to the developer container 340 (Step 47). Then, the operation again moves to step 41 to detect a toner concentration in the developer container 340.

When ΔTC is smaller than 0.2 V in Step 45, the transport screw 345 is rotated at a speed which is linearly two times higher than the predetermined reference rotation speed so as to supply the developer to the developer container 340 (Step 48). Then, the operation again moves to step 41 to detect a toner concentration in the developer container 340.

In step 46, if ΔTC is out of a range of 0.4 V>ΔTC>0.2 V, the transport screw 345 is rotated at a speed which is linearly three times higher than the predetermined reference rotation speed so as to quickly supply the developer to the developer container 340 (Step 49). Two minutes later, whether ΔTC is smaller than 0.4 V or not is judged (Step 50). If ΔTC is smaller than 0.4 V, the transport screw 345 continues to be rotated, and the operation returns to Step 1.

On the other hand if ΔTC is not larger than 0.4 V, the operation of the copying machine is stopped (Step 51). Specifically, when the toner concentration is lowered to such a level that ΔTC does not become smaller than 0.4 V, even if the developer is supplied to the developer container for two minutes by rotating the transport screw 345 at a speed which is linearly three times higher than the predetermined reference rotation speed, satisfactory developing can hardly be achieved and thus the whole machine is stopped by interlocking. At this time, warning is given, for example, by displaying an error message to indicate a lowering of the toner concentration (Step 52).

Referring now to the flowcharts shown in FIGS. 34 to 36, how the control device 354 controls the rotation of the collecting means 346 in the developer supply unit 343 is explained below.

Figure 34:
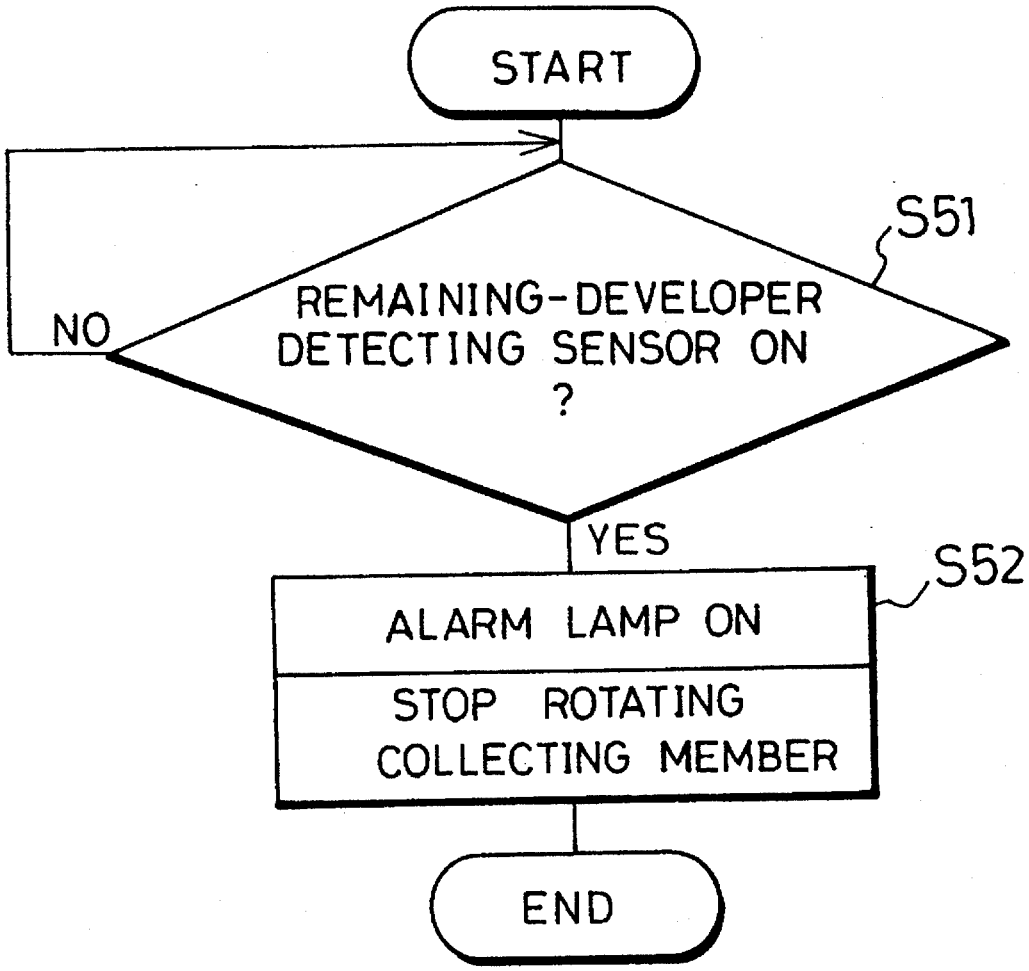
FIG. 34 is a flowchart showing how the control device of FIG. 32 controls the rotation of a collecting member according to an output of a remaining-developer detecting sensor.

As illustrated in FIG. 34, when the remaining-developer detecting sensor 351 on the bottom section of the developer hopper 344 is turned on (Step 51), it is judged that an amount of developer in the developer hopper 344 becomes lower than a predetermined amount. Then, the warning lamp 357 (see FIG. 32) is turned on to inform the user of the need of the supply of developer, and the rotation of the collecting member 346 is stopped (Step 52).

Namely, if the rotation of the collecting member 346 is stopped when the amount of developer in the developer hopper 344 becomes lower than the predetermined amount, a wasteful movement of the collecting member 346 is prevented, and thus electric power consumption of the machine is reduced. Moreover, since the user is informed of the need of the supply of the developer, it is possible to prevent forgetting the supply of developer.

In short, by controlling the rotation of the collecting member 346 in the above-mentioned manner, it is possible to stop the rotation of the collecting member 346 and inform the user of the need of the supply of developer without varying the toner concentration in the developer container 340. With this structure, it is possible to prevent toner from flying and depositing as toner spots due to an abrupt supply of toner, thereby maintaining satisfactory image quality.

Figure 35:
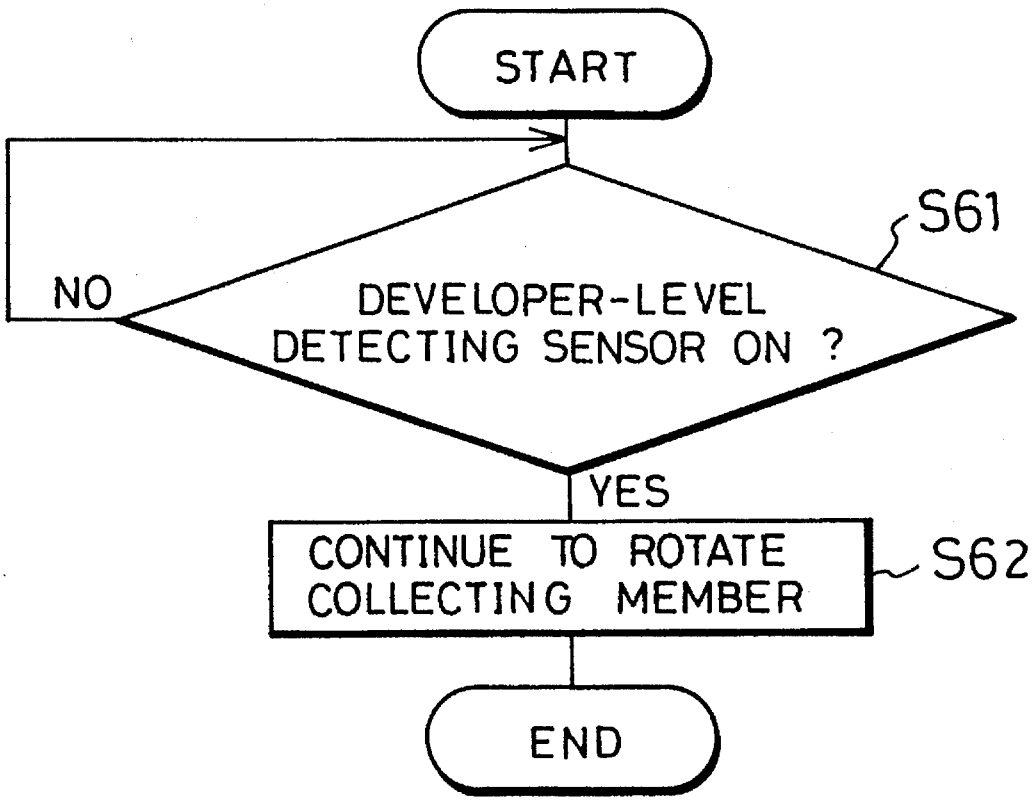
FIG. 35 is a flowchart showing how the control device of FIG. 32 controls the rotation of the collecting member according to an output of a developer-level detecting sensor.

Furthermore, as illustrated in FIG. 35, when the developer-level detecting sensor 352 on the side wall of the developer hopper 344 is turned on (Step 61), the level of the developer in the developer hopper 344 is lower than the installation position of the transport screw 354. In this case, the control device 354 continues to rotate the collecting member 346 until the remaining-developer detecting sensor 351 detects that the amount of developer is equal to or smaller than the predetermined amount (Step 62).

Namely, when the level of the developer in the developer hopper 344 becomes lower than the installation position of the transport screw 345, it is necessary to supply the developer staying below the transport screw 345 to the toner receiving section 349 by the collecting member 346.

When the developer detecting sensor 352 is turned on, the collecting member 346 continues to be rotated until the remaining-developer detecting sensor 351 is turned on. Therefore, the developer in the developer hopper 344 is kept agitated, enabling the developer having sufficiently mixed toner and carrier to be supplied to the developer container 340. Additionally, since the developer is successively supplied to the toner receiving section 349, an appropriate amount of developer is supplied to the developer container 340.

Figure 36:
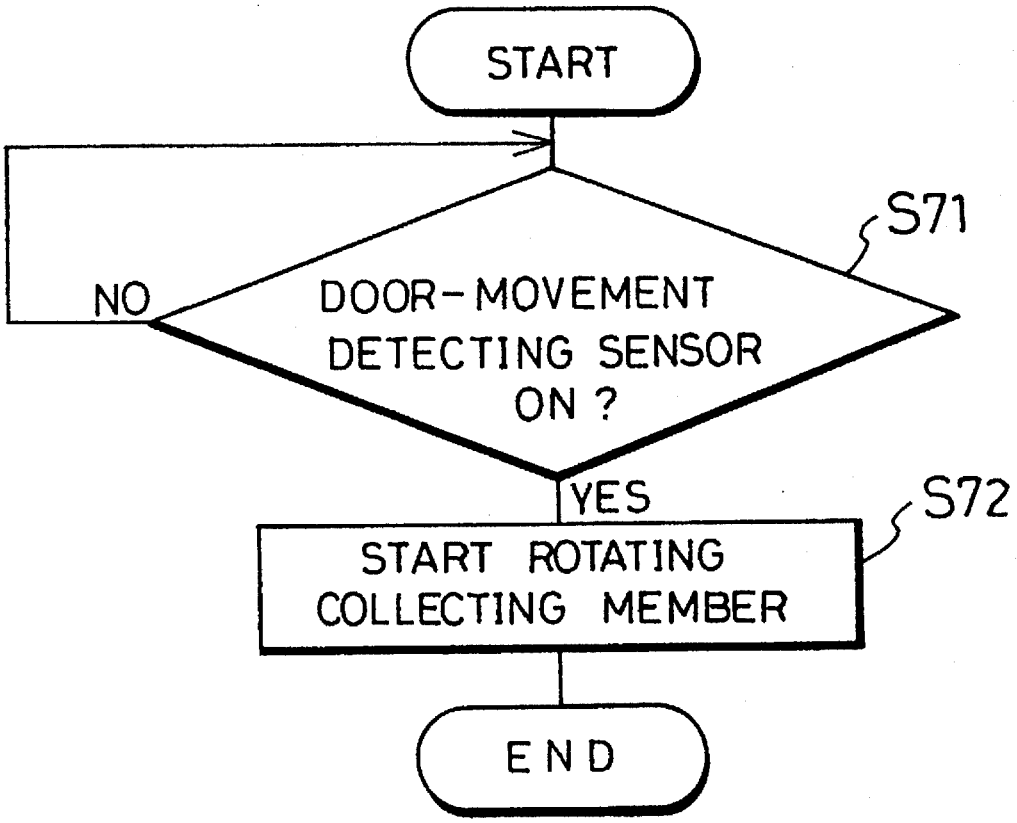
FIG. 36 is a flowchart showing how the control device of FIG. 32 controls the rotation of the collecting member according to an output of a door-movement detecting sensor.

As illustrated in FIG. 36, when the door-movement detecting sensor 353 for detecting whether the door **344*b* mounted on the top of the developer hopper 344 is opened, or closed is turned on (Step 71), the rotation of the collecting member 346 is started (Step 72**).

In general, the developer supply opening **344*c* of the developer hopper 344 is made as small as possible to prevent toner from flying during the supply of developer. Furthermore, since the flowability of the developer is usually small, the developer supplied to the developer hopper 344 is piled up in the shape of a mountain in the vicinity of the supply section. As a result, a pile of developer soon gathers near the developer supply opening 344*c* of the developer hopper 344**, lowering the efficiency of supplying the developer.

However, with the above-mentioned control, since the collecting member 346 is rotated when the door **344*b* is opened, it is possible to evenly supply the developer to the developer hopper 344, thereby improving the efficiency of supplying the developer to the developer hopper 344. With this structure, it is possible to reduce the size of the developer supply opening 344*c***, and prevent the toner from flying during the supply of the developer.

As described above, the toner in the developer container 340 is promptly and properly supplied to the developer supply unit 343 by controlling the rotation speed of the transport screw 345 or the collecting member 346 according to the difference between the detection signal of the toner-concentration detecting sensor 350 and the reference value.

Figure 37:
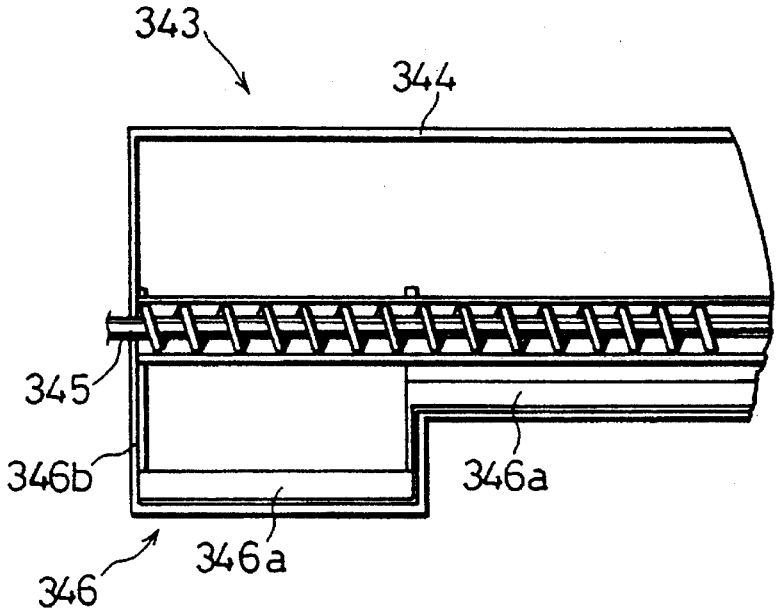
FIG. 37 is a schematic structure of a developer supply unit corresponding to a modified example of the bottom section of the developer hopper of the developing device of FIG. 28.

In this embodiment, as illustrated in FIG. 28, the shovelling section **346*a* of the collecting member 346 in the developer supply unit 343 is arranged so that the bottom section of the developer hopper 344 does not have a stair-stepped shape and is substantially parallel to the transport screw 345. However, for example, even when the bottom section of the developer hopper 344 has a stair-stepped shape as shown in FIG. 37, if the shovelling section 346*a* is formed into a shape corresponding to the shape of the bottom section of the developer hopper 344**, the above-mentioned effects are also produced.

As described above, a developing device of this embodiment includes:

a developer container for storing a developer including toner and carrier;

agitating means for agitating the developer in the developer container;

a developing roller for bringing the developer in the developer container agitated by the agitating means into contact with the electrostatic latent image;

developer supply means for successively supplying a supply developer including toner and carrier to the developer container; and developer discharge means for discharging the developer in the developer container as the supply developer is supplied to the developer container by the developer supply means, the developer supply means including:

a supply-developer storage section for storing the supply developer including a mixture of toner and carrier;

developer transporting means, disposed in the supply-developer storage section, for transporting the developer in the developer storage section to the developer container; and developer providing means for providing the developer in the supply-developer storage section to the developer transporting means while agitating the developer.

With this structure, the toner and the carrier in the supply-developer storage section are evenly mixed, and the developer is supplied to the developer container while maintaining a uniform toner concentration. It is thus possible to keep a replacement ratio of the developer in the developer container, and to continue satisfactory development.

Moreover, the developing device of this embodiment having the above-mentioned structure is arranged such that the developer transporting means includes:

a developer receiving section, disposed in a longitudinal direction of the supply-developer storage section with a predetermined space from the bottom of the supply-developer storage section, for receiving the developer provided by the developer providing means; and a developer transporting section for transporting the developer supplied to the developer receiving section to the developer container, and wherein the developer providing means includes a collecting member having a shovelling section arranged in a longitudinal direction of the supply-developer storage section, the collecting member collecting the developer remaining in a lower part of the supply-developer storage section by the shovelling section and providing the developer to the developer receiving section while rotating around the developer receiving section.

This arrangement prevents the carrier from remaining in the lower part of the supply-developer storage section, thereby achieving sufficient agitation of toner and carrier.

Furthermore, the developing device of this embodiment having the above-mentioned structure is arranged such that the supply-developer storage section is formed so that a cross section of the bottom of the supply-developer storage section cut across a direction orthogonal to a transport direction of developer has a shape of an arc corresponding to an orbit of the collecting member, and the shovelling section of the collecting member is moved along the bottom of the supply-developer storage section.

With this arrangement, the developer remaining in the lower part of the supply-developer storage section is efficiently collected by the shovelling section. Consequently, the developer is more efficiently supplied to the developer transporting means by the collecting member.

[Embodiment 11]

Figure 38:
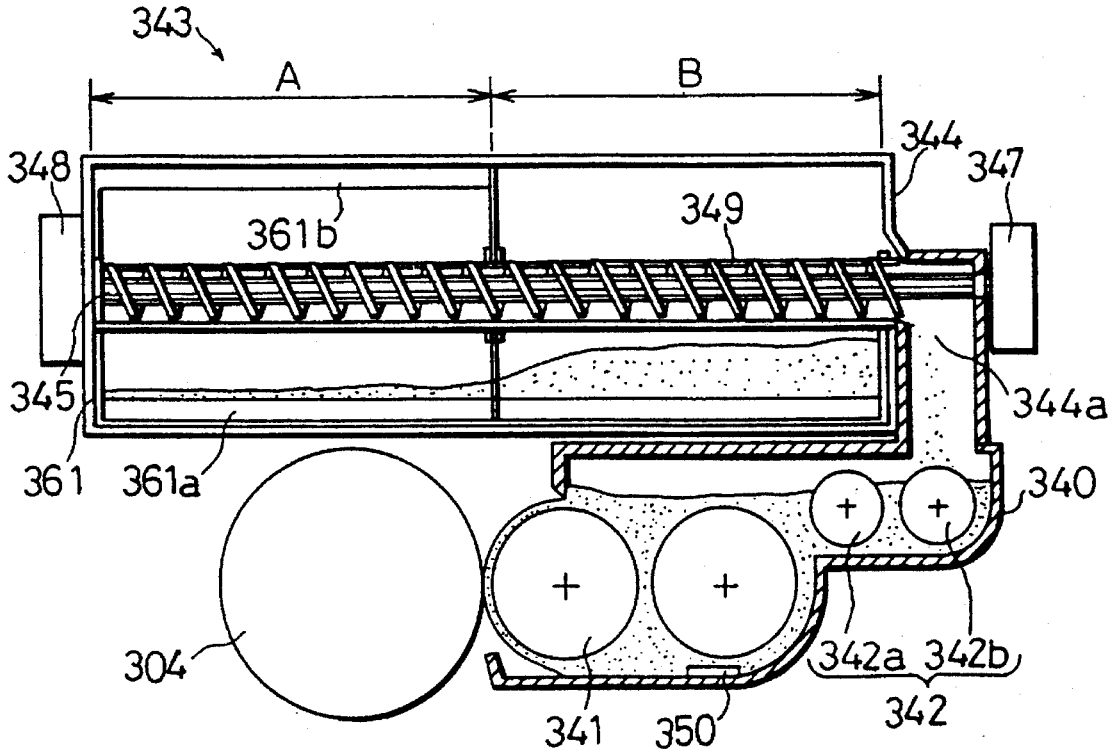
FIG. 38 is a schematic structure of a developing device according to Embodiment 11 of the present invention.
Figure 39:
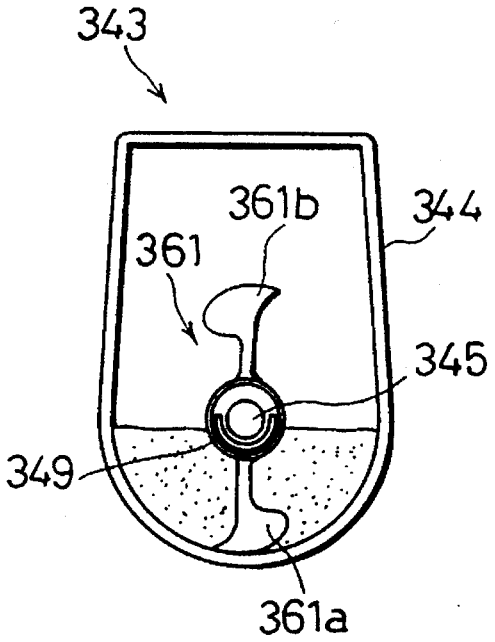
FIG. 39 is a side view of a developer supply unit in the developing device of FIG. 38.

The following description discusses an eleventh embodiment of the present invention with reference to FIGS. 38 and 39.

The members having the same structure and function as in the above-mentioned embodiments will be designated by the same code and their description will be omitted.

A supply device in a developing device of this embodiment includes a collecting member 361 shown in FIG. 38, instead of the collecting member 346 in the developer hopper 344 shown in FIG. 28 of Embodiment 10.

The developer hopper 344 is provided with a first shovelling section 361*a*. Assuming that the first shovelling section 361*a* is divided into two portions A and B having a substantially half a length thereof as shown in FIG. 38. Additionally, a second shovelling section 361*b* is installed in an area corresponding to the portion A of the first shovelling section 361*a*. As illustrated in FIG. 39, the second shovelling section 361*b* is arranged so that, when the first shovelling section 361*a* is positioned. at the bottom of the developer hopper 344, the second shovelling section 361*b* comes just above the first, shovelling section 361*a*.

With this arrangement, the amount of developer collected in the portion A of the developer hopper 344, i.e., in a portion far away from the discharge opening 344*a* is increased by two times. As a result, an increased, amount of developer is supplied to the toner receiving section 349.

Namely, as illustrated in FIG. 38, the amount of developer supplied to the transport screw 345 by the collecting member 361 in the portion A is twice larger than the amount of developer supplied thereto by the transport screw 345 in the portion B, thereby enabling an increased amount of developer to be supplied to the toner receiving section 349.

With this structure, since the developer in the developer hopper 344 is moved toward the discharge opening 344*a*, and the time taken to transport the developer from the developer hopper 344 to the developer container 340 is shortened, thereby improving the efficiency of transporting developer. As a result, the developer is stably supplied to the developer container 340 from the developer hopper 344, and a uniform replacement ratio of the carrier in the developer container 340 is maintained. It is therefore possible to prevent degradation of the charging performance of the carrier and to achieve satisfactory copy quality.

As described above, the developing device of this embodiment is constructed based on the structure of Embodiment 11, wherein the developer supply means is divided into a plurality of portions in a longitudinal direction of the supply-developer storage section, and the number of collecting members for collecting the developer in a downstream portion of a developer transport direction of the developer transporting means is larger than the number of collecting members for collecting the developer in an upstream portion of the developer transport direction.

With this structure, since an increased amount of developer is supplied to the developer transporting means in a location far away from the developer discharge opening in the supply-developer storage section, the time taken from the transport of developer to the discharge of developer is shortened. Additionally, since the developer is continually transported to the developer discharge opening without interruptions, the efficiency of transporting developer is improved.

[Embodiment 12]

Figure 40:
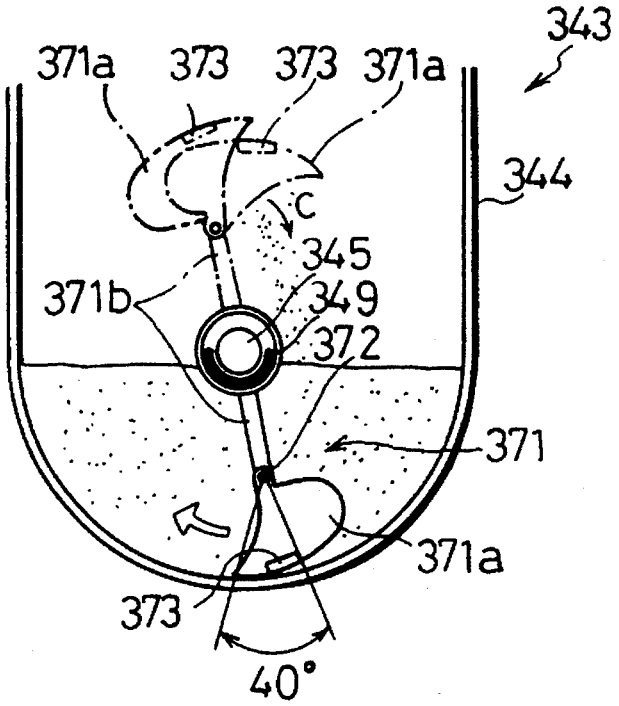
FIG. 40 is a schematic structure of a developer supply unit in a developing device according to Embodiment 12 of the present invention.

The following description discusses a twelfth embodiment of the present invention with reference to FIG. 40.

The members having the same structure and function as in the above-mentioned embodiments will be designated by the same code and their description will be omitted.

A supply device in a developing device of this embodiment includes a collecting member 371 shown in FIG. 40, instead of the collecting member 346 in the developer hopper 344 shown in FIG. 28 of Embodiment 10.

The collecting member 371 includes a shovelling section 371*a*. As illustrated in FIG. 40, the shovelling section 371*a* is attached to an end of a supporting shaft 371*b* with a supporting pin 372 so that it is rotatable at an angle of 40°. The supporting shaft 371*b* is rotatable around the transport screw 345. A weight 373 is fixed to an edge of of the shovelling section 371*a*.

Since the weight 373 is provided, when the shovelling section 371*a* is further lifted from a substantially horizontal position by the rotation of the collecting member 371, the shovelling section 371*a* is rotated downward while keeping its shovelling surface in a substantially horizontal position. Namely, this structure prevents the developer from falling down until the shovelling section 371*a* comes substantially right above the toner receiving section 349. When the shovelling section 371*a* comes substantially right above the toner receiving section 349, the shovelling section 371*a* is rotated in the direction of arrow C so that the developer accurately falls down into the toner receiving section 349.

The shovelling section 371*a* of the collecting member 371 is formed into a shape corresponding to the shape of the bottom section of the developer hopper 344. Thus, the developer in the developer hopper 344 is efficiently collected.

Therefore, in the supply device of the developing device having the above-mentioned structure, the developer in the developer hopper 344 is accurately shovelled into the toner receiving section 349 by simply arranging the shovelling section 371*a* to be rotatable and fixing the weight 373 to the edge thereof. As a result, the efficiency of transporting developer to the developer container 340 is improved.

[Embodiment 13]

Figure 41:
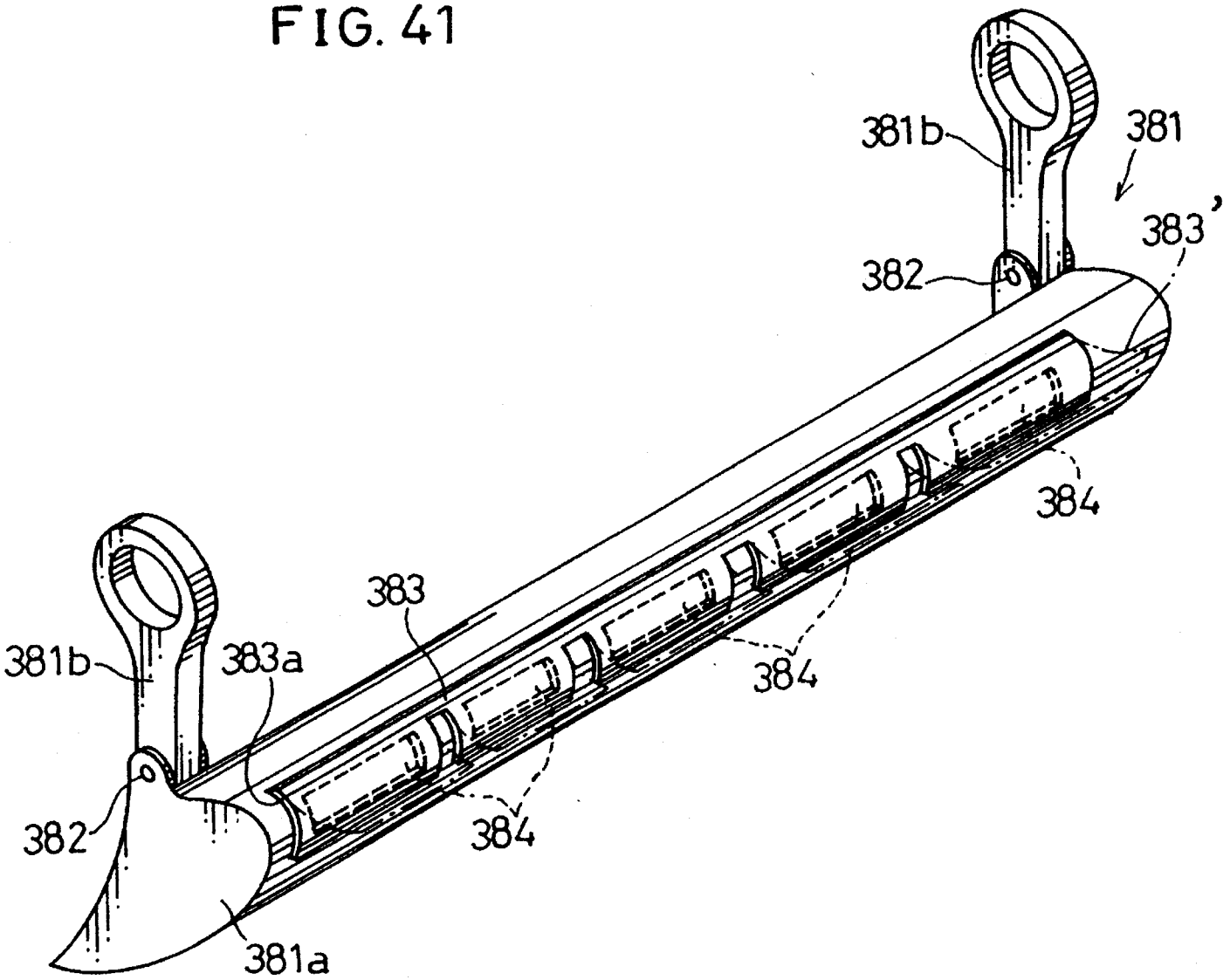
FIG. 41 is a perspective view of a collecting member in a developing device according to Embodiment 13 of the present invention.

The following description discusses a thirteenth embodiment of the present invention with reference to FIG. 41.

The members having the same structure and function as in the above-mentioned embodiments will be designated by the same code and their description will be omitted.

A supply device in a developing device of this embodiment includes a collecting member 381 shown in FIG. 41, instead of the collecting member 346 in the developer hopper 344 shown in FIG. 28 of Embodiment 10.

The collecting member 381 includes a shovelling section 381*a*. As illustrated in FIG. 41, the shovelling section 381*a* is attached to an end of each supporting shaft 381*b* with a supporting pin 382. The supporting shafts 381*b* are rotatable around the transport screw 345 (see FIG. 28).

A front face of the shovelling section 381*a* has rectangular openings 384 which extend to a rear face thereof. Attached to the rear face is a shield member 383 (a shutter member) for covering the respective openings 384. The shield member 383 is formed by a resilient material having a longer fatigue life, such as thin piece of polyethylene terephthalate with a thickness of 1 mm to 3 mm. Only an upper edge 383a of the shield member 383 is bonded to the shovelling section 381*a*.

With this structure, when collecting the developer with the rotation of the collecting member 381, if an excessive pressure is applied to the shovelling section 381*a*, the shield member 383 on the rear face of the shovelling member 381*a* is lifted up like a shield member 383' indicated by a virtual line (alternate long and short. dash line) in FIG. 41. When the shield member 383' is lifted up, the openings 384 of the shovelling section 381*a* are exposed, and the developer is discharged through the rear face thereof from the front face of the shovelling section 381*a*.

Since the shield member 383 is not lifted up by a pressure smaller than a predetermined value, only a predetermined amount of developer is collected. Moreover, since the shield member 383 is lifted up by a pressure larger than the predetermined value, it is possible to decrease the rotation torque of the drive motor 348 (shown in FIG. 28) of the collecting member 381 when the developer hopper 344 shown in FIG. 28 is filled up with the developer.

As a result, stress caused by an increase in the rotation torque of gears which are interacted by the drive motor 348 is prevented. It is therefore possible to extend the life of the drive gears and the life of the overall supply device of the developing device.

Furthermore, since the collecting member 381 is smoothly rotated depending on an amount of developer remaining in the developer hopper 344 without rotation stress, the developer is always supplied to the toner receiving section in a stable manner. It is thus possible to stably supply the developer from the developer supply unit 343 to the developer container 340 and to maintain the charging performance of the developer in the developer container 340, achieving satisfactory image quality.

[Embodiment 14]

Figure 42:
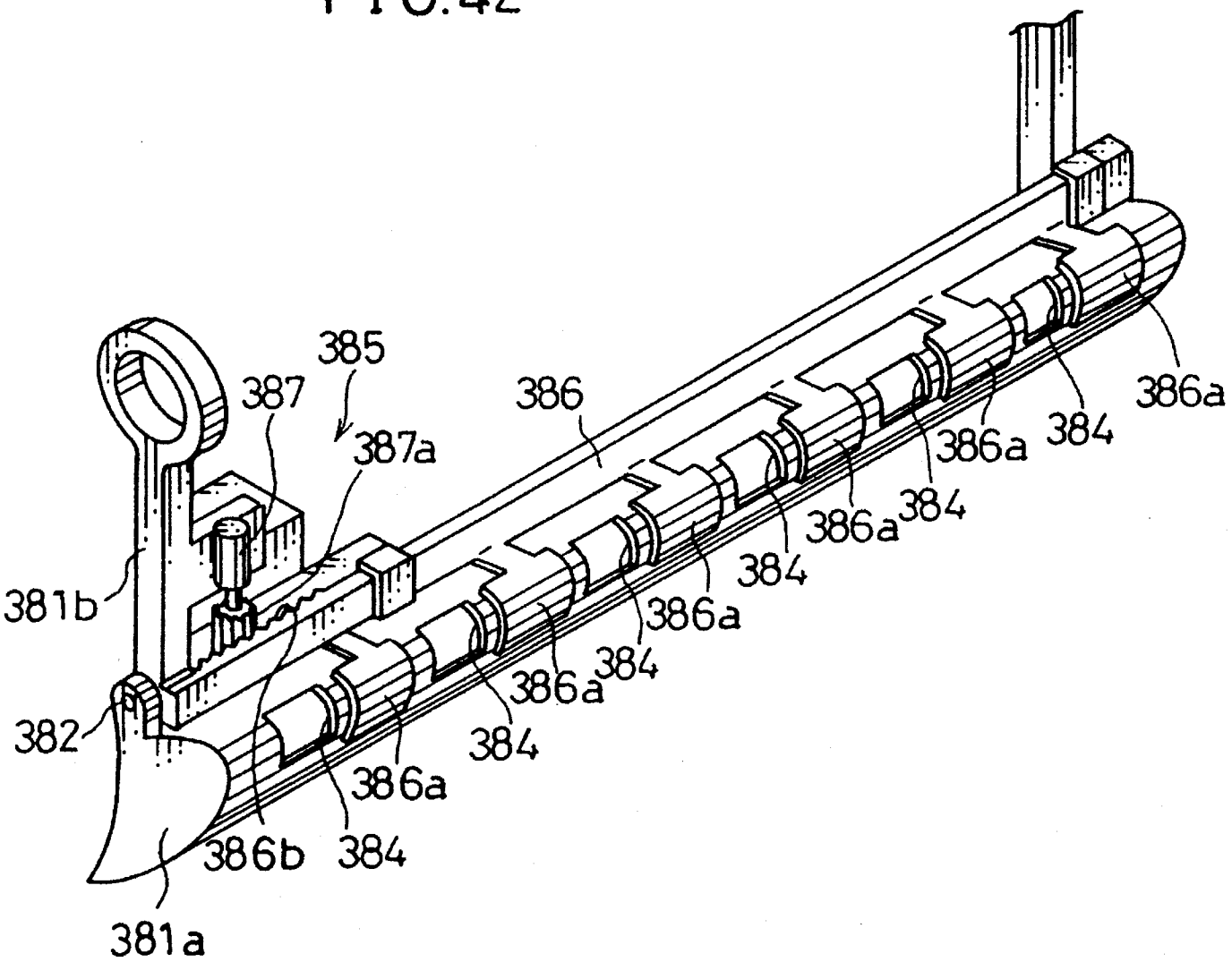
FIG. 42 is a perspective view of a collecting member in a developing device according to Embodiment 14 of the present invention.

The following description discusses a fourteenth embodiment of the present invention with reference to FIG. 42.

The members having the same structure and function as in the above-mentioned embodiments will be designated by the same code and their description will be omitted.

As illustrated in FIG. 42, for example, a supply device in a developing device of this embodiment includes a shutter mechanism 385 for opening and closing the openings 384 of the shovelling section 381*a*, instead of the shield member 383 formed by polyethylene terephthalate for opening and closing the openings 384 of the shovelling section 381*a* shown in FIG. 41 of Embodiment 13.

As shown in FIG. 42, the shutter mechanism 385 includes a shutter member 386 having door members 386*a* for opening and closing the respective openings 384 of the shovelling section 381*a*. The shutter member 386 has a gear 386*b* which meshes with a gear 387*a* of a motor 387 attached to the supporting shaft 381*a*. When the motor 387 is rotated, the shutter member 386 is driven and the openings 384 of the shovelling section 381*a* are exposed.

When the developer detecting sensor 352 shown in FIG. 28 is turned on, the rotation of the motor 387 is controlled by a detection signal thereof so that the shutter member 386 is driven in a direction to close the openings 384.

Consequently, when the amount of developer remaining in the developer hopper 344 becomes lower than a predetermined amount, the shutter member 386 is closed. On the other hand, when the developer detecting sensor 352 is turned off, i.e., when the amount of developer remaining in the developer hopper 344 is not lower than the predetermined amount, the shutter member 385 is kept open. This structure decreases rotation resistance of the collecting member 381 due to the developer.

As a result, stress caused by an increase in the rotation torque of the gears which are interacted by the drive motor 348 is prevented. It is therefore possible to extend the life of the drive gears and the life of the overall supply device of the developing device.

Furthermore, since the collecting member 381 is smoothly rotated depending on an amount of developer remaining in the developer hopper 344 without rotation stress, the developer is always supplied to the toner receiving section in a stable manner. It is thus possible to stably supply the developer from the developer supply unit 343 to the developer container 340 and to maintain the charging performance of the developer in the developer container 340, achieving satisfactory image quality.

[Embodiment 15]

Figure 43:
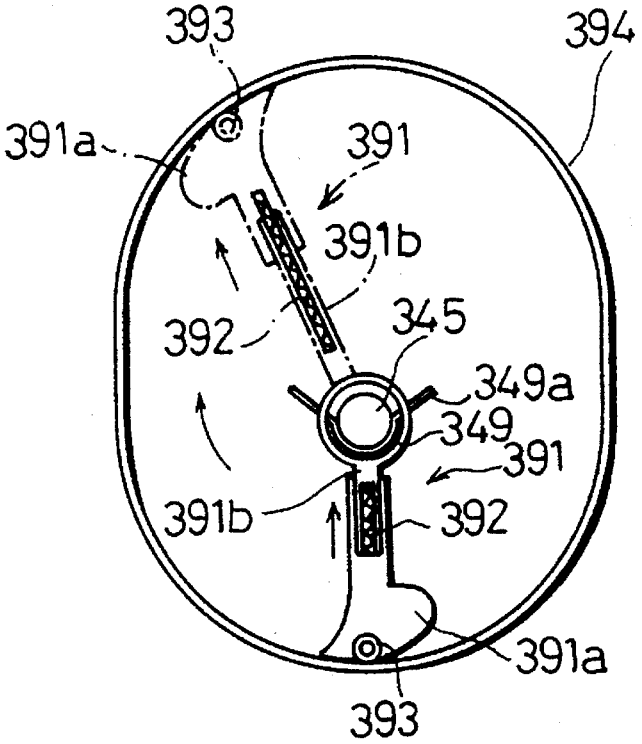
FIG. 43 illustrates a schematic structure of a developer hopper in a developing device according to Embodiment 15 of the present invention.

The following description discusses a fifteenth embodiment of the present invention with reference to FIG. 43.

The members having the same structure and function as in the above-mentioned embodiments will be designated by the same code and their description will be omitted.

A supply device in a developing device of this embodiment includes a developer hopper 394 having a substantially oval cross section shown in FIG. 43 and a collecting member 391, instead of the developer hopper 344 and the collecting member 346 in the developer hopper 344 shown in FIG. 28 of Embodiment 10.

The upper portion 349*a* of the toner receiving section 349 flares toward the top so as to effectively receive the developer falling down from the collecting member 391.

As illustrated in FIG. 43, the collecting member 391 includes the transport screw 345 and the toner receiving section 349 which are located slightly lower than the center position, and the supporting shaft 391*b* which is rotatable around the transport screw 345 and the toner receiving section 349. A shovelling section 391*a* is connected to an end of the collecting member 391 with a spring 392. The spring 392 pushes the shovelling section 391*a* toward an inner wall surface of the developer hopper 394. When the collecting member 391 is rotated, the collecting member 391 stretches out in the developer hopper 394. Consequently, the developer in the developer hopper 394 is completely collected by the collecting member 391, thereby improving the efficiency of collecting developer in the developer hopper 394.

A roller 393 is mounted on the shovelling section 391*a* in contact with the inner wall surface of the developer hopper 394. This arrangement decreases contact resistance between the shovelling section 391*a* and the inner wall surface of the developer hopper 394 during the rotation of the collecting member 391. As a result, the collecting member 391 is smoothly rotated. It is thus possible to decrease rotating burden of the collecting-member drive motor 348 and reduce the rotation torque thereof.

[Embodiment 16]

Figure 44:
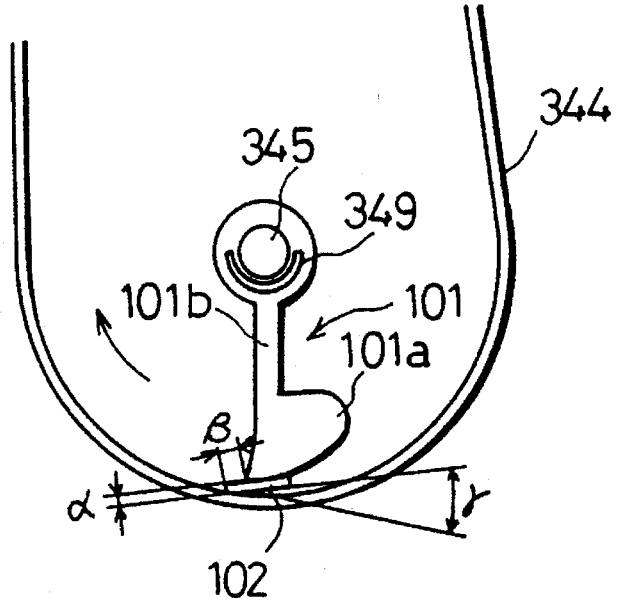
FIG. 44 illustrates a schematic structure of a developer hopper in a developing device according to Embodiment 16 of the present invention.

The following description discusses a sixteenth embodiment of the present invention with reference to FIG. 44.

The members having the same structure and function as in the above-mentioned embodiments will be designated by the same code and their description will be omitted.

A supply device in a developing device of this embodiment includes a collecting member 101, instead of the collecting member 346 in the developer hopper 344 shown in FIG. 28 of Embodiment 10.

As illustrated in FIG. 44, the collecting member 101 is rotatable around the transport screw 345 and the toner receiving section 349, and has a shovelling section 101*a* connected to an end thereof.

Like the shovelling section 346*a* shown in FIG. 28 of Embodiment 10, the shovelling section 101*a* extends in a longitudinal direction of the developer hopper 344, and a contact member 102 made of a resilient material having satisfactory fatigue resistance such as polyethylene terephthalate is provided in a contact portion between the shovelling section 101*a* and the developer hopper 344.

The contact member 102 has a thickness α between 0.5 mm and 3.0 mm and a protruded portion β of 5 mm to 10 mm sticking out from the shovelling section 101*a*, and forms an acute angle γ with the contact portion in a rotating direction. Comparisons between the values of the thickness α and the protruded portion β, and the collecting rate were made. The results are shown in the following tables.

TABLE 1

| (Thickness in mm) | |
|---|---|
| less than 0.5 | lowered collecting rate, removal and turning of member |
| 0.5–3.0 | satisfactory |
| more than 3.0 | increased torque due to increased rotation resistance, locking, and scratches in inner surface of container |

TABLE 2

| (Dimension of protrued portion in mm) | |
|---|---|
| less than 5 | noise of friction with inner surface of container, increased rotation resistance |
| 5–10 | satisfactory |
| more than 10 | unsatisfactory supply developer collecting rate |

As seen from Table 1, when the thickness of the contact member 102 is less than 0.5 mm, such a thin contact member 102 is likely to be turned by the rotation of the collecting member 101. If the possibility of the removal of the contact member 102 from the shovelling section 101*a* increases, the collecting rate of the developer in the developer hopper 344 is lowered.

On the other hand, when the thickness of the contact member 102 is more than 3.0 mm, the contact resistance during rotation is increased, resulting in increased rotation resistance. This may stop the rotation of the collecting member 101 and cause an increased number of scratches in the inner wall surface of the developer hopper 344.

It is therefore desirable to arrange the thickness α of the contact member 102 between 0.5 mm and 3.0 mm. If the thickness α is within this range, suitable ductility is obtained. Consequently, the contact resistance with the inner wall surface of the developer hopper 344 is reduced, and the collecting rate of the developer is improved.

Meanwhile, as seen from Table 2, when the dimension of the protruded portion of the contact member 102 is less than 5 mm, the area of the contact portion between the. contact member and the inner wall surface of the developer hopper 344 becomes smaller, resulting in unsatisfactory collecting performance. On the other hand, when the dimension of the protruded portion is larger than 10 mm, the contact resistance with the inner wall surface of the developer hopper 344 is increased and the rotation resistance is also increased, resulting in degraded developer collecting performance.

It is thus preferable to arrange the dimension of the protruded portion of the contact member 102 within a range between 5 mm and 10 mm. When the dimension of the protruded portion is within this range, the contact resistance with the inner wall surface of the developer hopper 344 is reduced, thereby improving the developer collecting performance.

[Embodiment 17]

Figure 45:
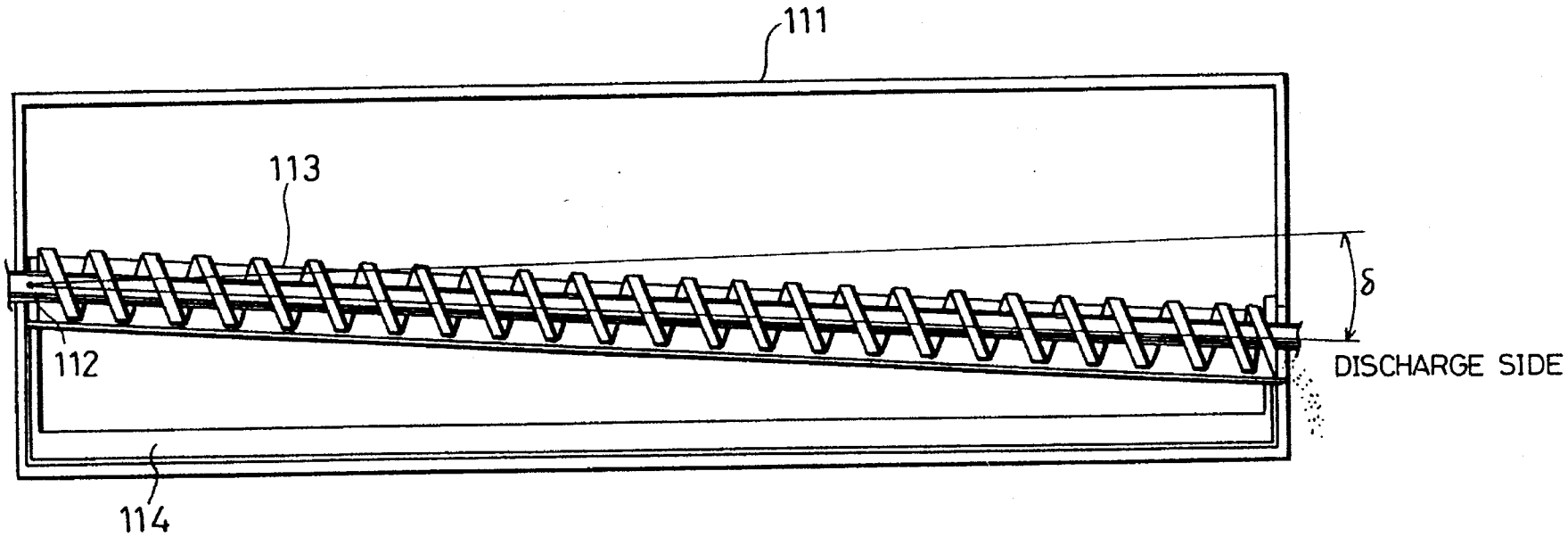
FIG. 45 illustrates a schematic structure of a transport screw in a developing device according to Embodiment 17 of the present invention.
Figure 46:
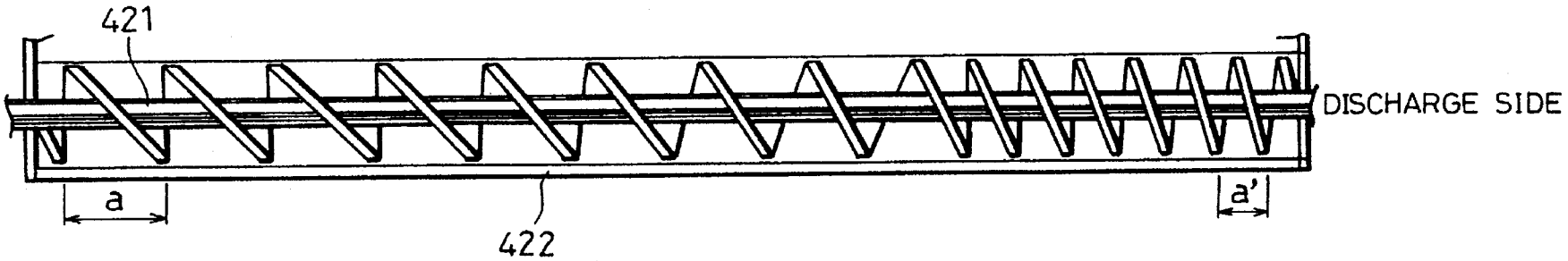
FIG. 46 illustrates a schematic structure of a modified example of the transport screw in the developing device according to Embodiment 17 of the present invention.
Figure 47:
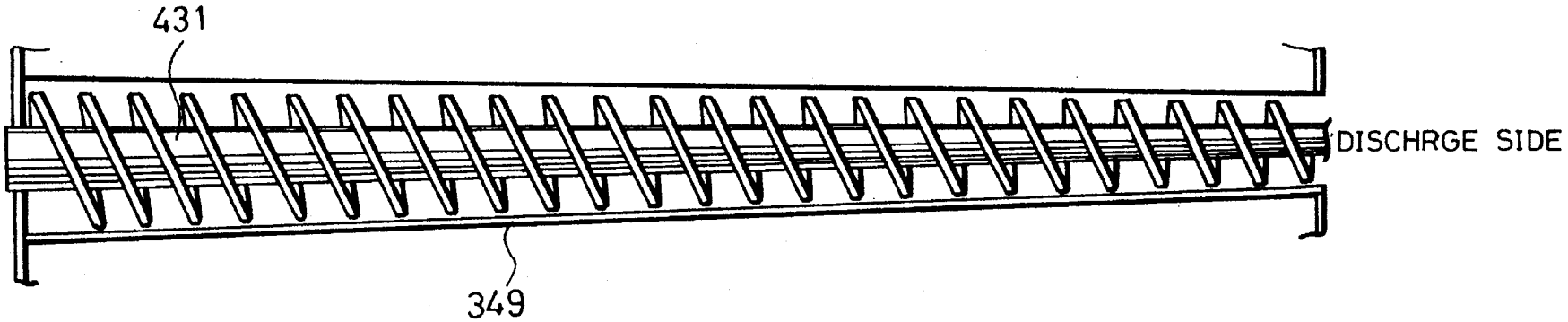
FIG. 47 illustrates a schematic structure of another modified example of the transport screw in the developing device according to Embodiment 17 of the present invention.

The following description discusses a seventeenth embodiment of the present invention with reference to FIGS. 45 to 47.

The members having the same structure and function as in the above-mentioned embodiments will be designated by the same code and their description will be omitted.

In order to achieve smooth discharge of developer, a supply device in a developing device of this embodiment includes a developer hopper 111 shown in FIG. 45, instead of the developer hopper 344 shown in FIG. 28 of Embodiment 10.

As illustrated in FIG. 45, the developer hopper 111 includes a transport screw 112 and a toner receiving section 113, instead of the transport screw 345 and the toner receiving section 349 shown in FIG. 28 of Embodiment 10. The transport screw 112 and the toner receiving section 113 are tilted at an angle δ so that the ends of these members on the developer discharge side become lower than the other ends thereof on the other side.

The developer hopper 111 also includes a collecting member 114 which is rotatable on the transport screw 112 and the toner receiving section 113. The collecting member 114 is formed into a shape corresponding to the shape of the bottom section of the developer hopper 111.

By tilting the transport screw 112 and the toner receiving section 113 so as to make the ends thereof on the developer discharge side lower than the other ends thereof on the other side, the developer is transported more efficiently due to its own weight compared to the transport carried out only by the transport force of the transport screw 112. With this structure, since the developer is successively supplied to the toner receiving section 113, the developer is stably transported to the developer container 340 at an increased speed.

The transport speed of developer may also be increased, for example, by using a transport screw 421 whose screw pitch increases from the developer discharge side toward the other side as illustrated in FIG. 46, instead of the transport screw 112 of FIG. 45.

For instance, denoting that the screw pitch in a portion of the transport screw 421 far away from the developer discharge side as a and the screw pitch in a portion of the transport screw 421 near the developer discharge side as a', their relation is a>a'. With this structure, the developer in portions far away from the developer discharge side of the developer hopper 111 is transported at an increased speed toward the developer discharge side, and the transport speed of the developer is decreased toward the discharge opening. It is thus possible to efficiently transport the developer in the developer hopper 111 to the developer discharge side, and to discharge an appropriate amount of developer through the discharge opening.

Accordingly, the developer is stably transported to the developer container 340 at an increased speed. Moreover, it is not necessary to locate the toner receiving section 422 parallel to the bottom section of the developer hopper 111 (see FIG. 45), and it may be tilted so that an end thereof on the developer discharge side becomes lower than the other end thereof on the other side like the toner receiving section 113. In this case, however, like the toner receiving section 422, it is necessary to tilt the transport screw 421.

Furthermore, in order to improve the transport speed of developer, it is preferable to use a transport screw 431 whose screw diameter increases from the developer discharge side toward the other side as shown in FIG. 47, for example, instead of .the transport screw 112 of FIG. 45. In this case, the diameter of a toner receiving section 349 is also increased toward the developer discharge side with the increase in the diameter of the transport screw 431.

With the above-mentioned structure, since the diameter of the transport screw 431 is increased from the developer discharge side toward the other side, the developer in the developer hopper 111 located in portions far away from the developer discharge side is transported at an increased speed, and the transport speed is lowered toward the developer discharge opening. It is thus possible to efficiently transport the developer toward the developer discharge opening, and to discharge an appropriate amount of developer through the discharge opening.

[Embodiment 18]

Figure 48:
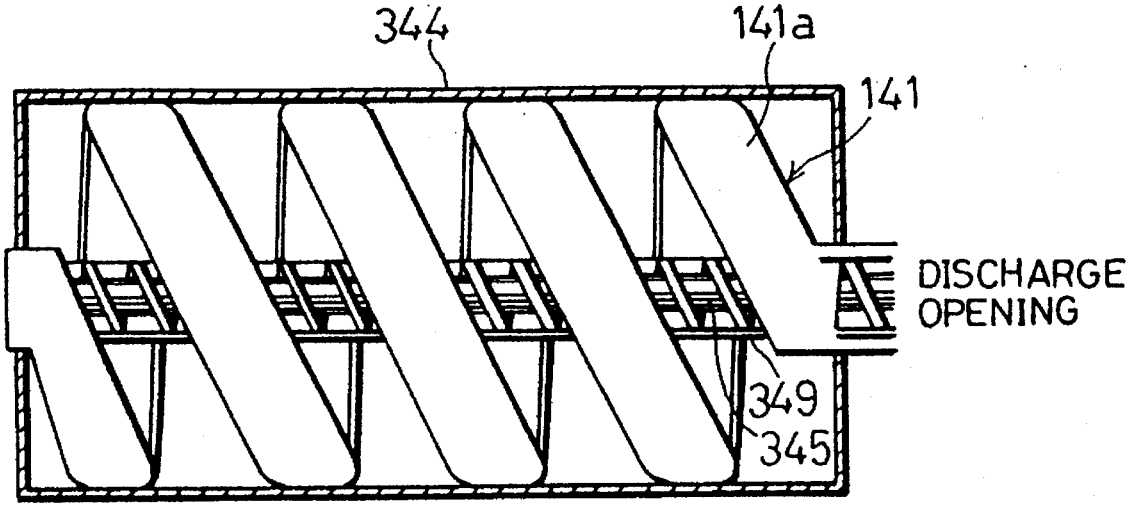
FIG. 48 illustrates a schematic structure of a developer hopper in a developing device according to Embodiment 18 of the present invention.
Figure 49:
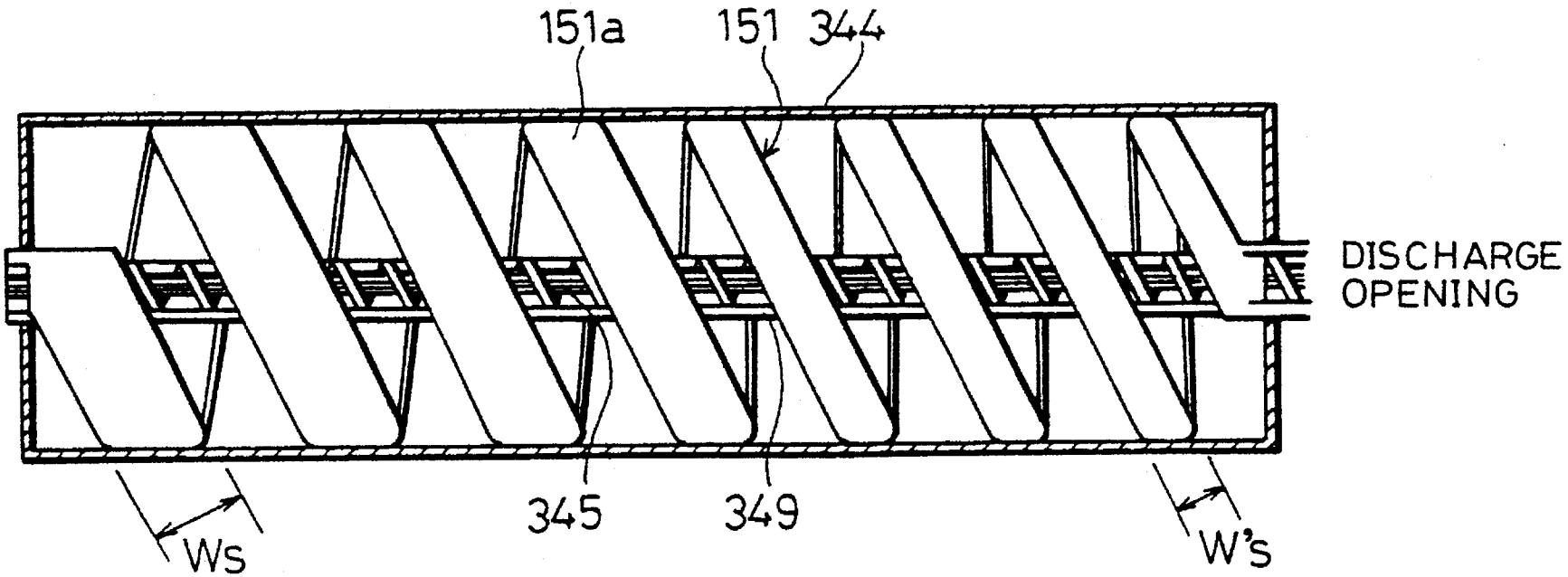
FIG. 49 illustrates a schematic structure of a modified example of the developer hopper in a developing device according to Embodiment 18 of the present invention.

The following description discusses an eighteenth embodiment of the present invention with reference to FIGS. 48 and 49.

The members having the same structure and function as in the above-mentioned embodiments will be designated by the same code and their description will be omitted.

As illustrated in FIG. 48, a supply device in a developing device of this embodiment includes a collecting member 141 having a spiral shovelling section 141*a* which covers the transport screw 345 and the toner receiving section 349 and are in contact with an inner wall surface of the developer hopper 344, instead of the collecting member 346 in the developer hopper 344 shown in FIG. 28 of Embodiment 10.

Since the collecting member 141 in the developer hopper 344 has the spiral shovelling section 141*a*, the toner and the carrier in the developer are agitated in an improved manner, and the developer is efficiently moved before being supplied. Namely, the spiral shovelling section 141*a* moves the developer toward the discharge opening while shovelling and efficiently agitating the developer.

If the length of the developer hopper 344 is increased, as shown in FIG. 49, the developer hopper 344 is provided with a shovelling member 151 whose spiral width Ws at a location farthest away from the discharge opening is larger than a spiral width Ws' thereof at a location near the discharge opening.

With this structure, the developer in the developer hopper 344 at locations far away from the discharge opening is efficiently shovelled into the toner receiving section 349 and transported toward the discharge opening, and the toner and the carrier in the developer are agitated in an improved manner. Consequently, the developer is efficiently moved before being supplied. It is thus possible to improve the transport speed of developer in the developer hopper 344, and to stably supply the developer to the developer container 340.

[Embodiment 19]

Figure 50:
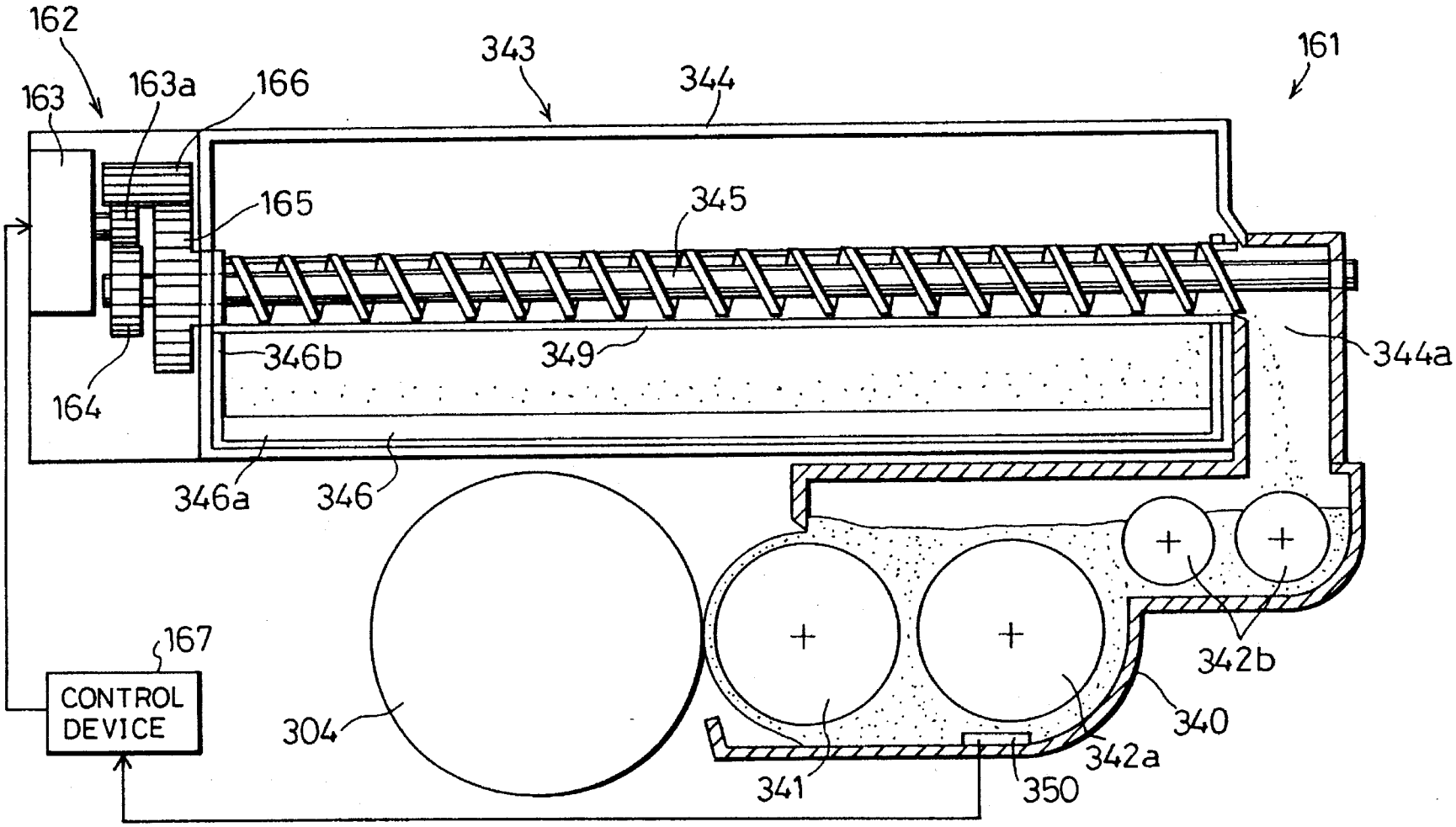
FIG. 50 illustrates a schematic structure of a developing device according to Embodiment 19 of the present invention.

The following description discusses a nineteenth embodiment of the present invention with reference to FIG. 50.

The members having the same structure and function as in the above-mentioned embodiments will be designated by the same code and their description will be omitted.

As illustrated in FIG. 50, this embodiment is applied to a developing device 161 instead of the developing device 309 shown in FIG. 28 of Embodiment 10. The developing device 161 includes a driving mechanism 162 as driving means instead of the drive motors 347 and 348 as driving power sources for driving the transport screw 345 and the collecting member 346 in the developing device 309 of FIG. 28.

Except for the above-mentioned transport-screw drive motor 347 and the collecting-member drive motor 348, all the members used in the developing device 161 of this embodiment are the same as those used in the developing device 309 of Embodiment 10.

As illustrated in FIG. 50, the driving mechanism 162 includes a drive motor 163. A drive gear 163*a* of the drive motor 163 meshes with a first gear 164 attached to an end of the transport screw 345 and with an intermediate gear 166 which meshes with a second gear 165 connected to the supporting shaft 346*b* of the collecting member 346. With this structure, the transport screw 345 and the collecting member 346 are rotated by simply rotating the drive motor 163. Namely, the transport screw 345 and the collecting member 346 are rotated by the same driving means, i.e., by the drive motor 163.

The drive motor 163 is controlled by the control device 167 according to a detection signal of the toner-concentration sensor 350 in the developer container 340. For instance, when the toner concentration in the developer container 340 is judged to be low by the toner-concentration detecting sensor 167 based on the output of the toner-concentration sensor 350, the control device 167 controls the drive motor 163 so that the transport screw 345 and the collecting member 346 are rotated to supply the developer in the developer hopper 344 to the developer container 340. Then, when the control device 167 judges from an output of the toner-concentration sensor 350 that the toner concentration in the developer exceeds a predetermined value, it stops the rotation of the drive motor 163 so as to stop the supply of the developer to the developer container 340.

The gear ratio of the first gear 164 to the second gear 165 is determined by considering the ratio of rotation speed between the transport screw 345 and the collecting member 346. Namely, it is necessary to set the gear ratio by keeping the balance of the discharge of the developer from the transport screw 345 and the supply of developer to the transport screw 345 by the collecting member 346.

For example, in this embodiment, the gear ratio is set so that the collecting member 346 turns ⅓ to ⅕ of a rotation during one rotation of the transport screw 345. This gear ratio maintains a balanced relationship between the discharge of the developer from the transport screw 345 and the supply of developer to the transport screw 345 by the collecting member 346.

With this structure, since the transport screw 345 and the collecting member 346 in the developer hopper 344 are rotated by a single drive motor 163, the number of parts in a developer supply mechanism is reduced, achieving a reduction in the manufacturing costs.

Moreover, since the supply speed and the supply amount of developer to the developer container 340 are varied by simply changing the gear ratio used in the driving mechanism 162, it is not necessary to individually adjust the rotation speeds of the respective members, resulting in a simplified adjustment process.

[Embodiment 20]

Figure 51:
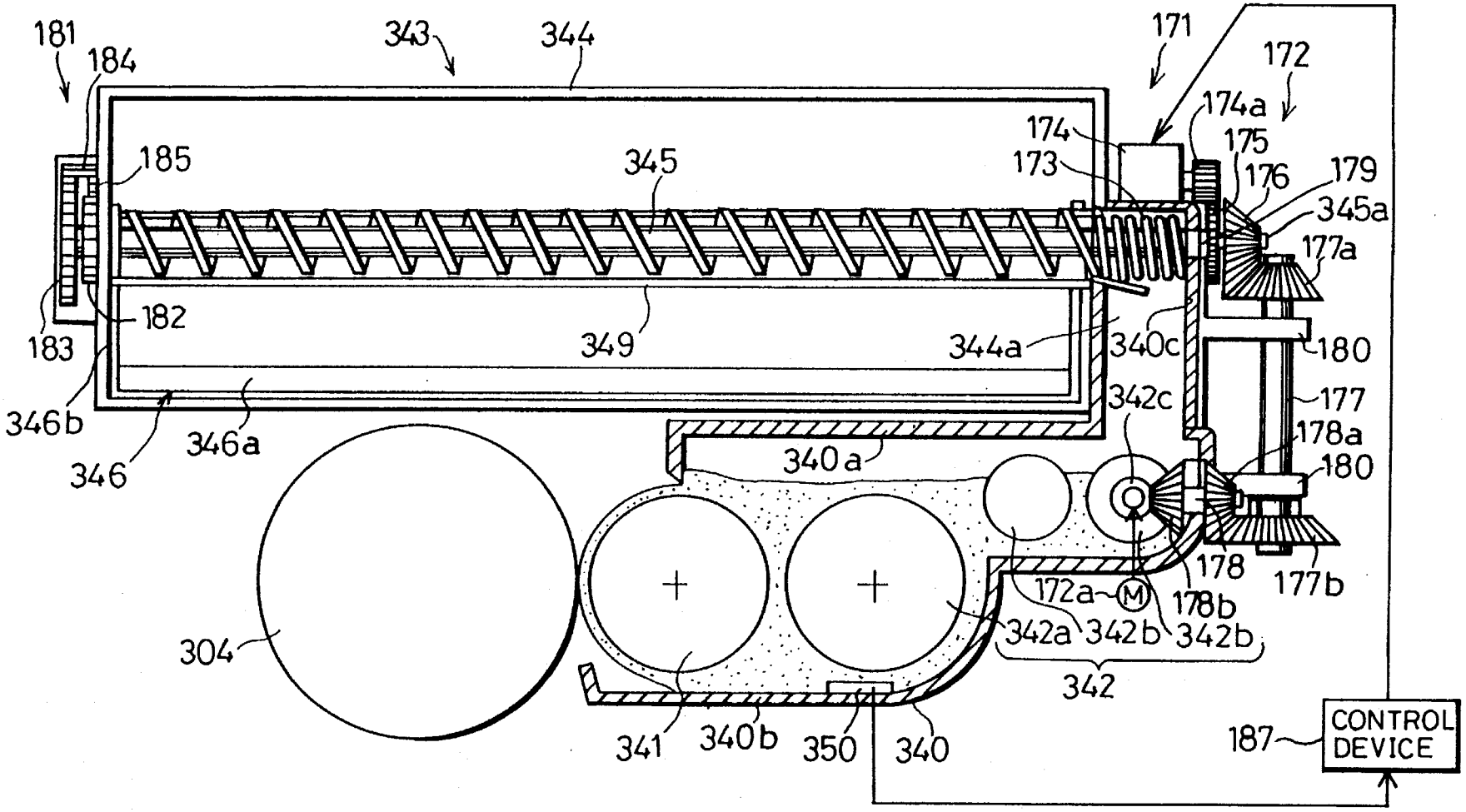
FIG. 51 illustrates a schematic structure of a developing device according to Embodiment 20 of the present invention.

The following description discusses a twentieth embodiment of the present invention with reference to FIG. 51.

The members having the same structure and function as in the above-mentioned embodiments will be designated by the same code and their description will be omitted.

As illustrated in FIG. 51, this embodiment is applied to a developing device 171 instead of the developing device 309 shown in FIG. 28 of Embodiment 10. The developing device 171 does not include the drive motors 347 and 348 as driving power sources for driving the transport screw 345 and the collecting member 346 in the developing device 309.

As illustrated in FIG. 51, disposed in a developer discharge opening 344*a* is a small transport screw 173 (second transport screw) which is rotated independently of the transport screw 345 (first transport screw). An end of the small transport screw 173 is connected to the driving shaft 179 which is connected to the wall surface 340*c* of the developer container 340.

The developing device 171 includes a drive motor 174 (second transport screw driving means) for rotating exclusively the small transport screw 173. A drive gear 174*a* of the drive motor 174 meshes with the gear 175 attached to the driving shaft 179. Thus, the driving force of the drive motor 174 is transmitted to the small transport screw 173. The small transport screw 173 is driven by the drive motor 174 independently of the transport screw 345.

With the structure of this embodiment, the transport screw 345 and the collecting member 346 in the developer hopper 344 are rotated using. the driving force of a drive motor 172*a* (developer container driving means) for rotating the rollers (the developing roller 341 and the agitating roller 342) in the developer container 340.

Namely, the developing device 171 includes a driving force transmitting mechanism 172 (driving force transmitting means, a first drive force transmitting section) for transmitting the driving force of the drive motor 172*a* to the transport screw 345. The driving force transmitting mechanism 172 includes a first helical gear 176, a second helical gear 177, and a third helical gear 178.

The rotation shaft 345*a* of the transport screw 345 passes through the hollow driving shaft 179 to the outside of the developer container 340. The first helical gear 176 is attached to the rotation shaft 345*a*, and meshes with a first gear section 177*a* of the second helical gear 177. The second helical gear 177 is rotatably supported by supporting members 180 mounted on the side wall 340*c*. A second gear section 177*b* of the second helical gear 177 meshes with a first gear section 178*a* of the third helical gear 178. The first gear section 178*a* is positioned outside of the side wall 340*c*, and the second gear section 178*b* thereof is positioned to mesh with a gear section 342*c* of a small agitating roller 342*b* in the developer container 340.

A gear box 181 (driving force transmitting means and a second driving force transmitting section) is disposed opposite the driving force transmitting mechanism 172 in the developer hopper 344.

The gear box 181 includes therein a first gear 182 attached to an end of the transport screw 345, a second gear 183 which interacts with the supporting shaft 346*b* of the collecting member 346, a first intermediate gear 184, and a second intermediate gear 185. The second gear 183 meshes with the first intermediate gear 184 which engages with the second intermediate gear 185. The second intermediate gear 185 meshes with the first gear 182. Namely, the driving force of the drive motor 174 is transmitted from the transport screw 345 to the supporting shaft 346*b* of the collecting member 346 through these gears.

Consequently, the transport screw 345 and the collecting member 346 in the developer hopper 344 interact with each other through the gear box 181.

With this structure, the drive motor 172*a* rotates not only the rollers in the developer container 340, but also the transport screw 345 and the collecting member 346. Thus, the transport-screw drive motor and the collecting-member drive motor become unnecessary, decreasing the size and the price of the device.

The gear ratio between the first gear 182 and the second gear 183 in the gear box 181 is determined depending on a ratio of rotation speed between the transport screw 345 and the collecting member 346. Namely, it is necessary to set the gear ratio to balance the discharge of the developer from the transport screw 345 with the supply of developer from the collecting member 346 to the transport screw 345.

In this embodiment, for instance, the gear ratio of the first gear 182 and the second gear 183 is set so that the collecting member 346 is turned ⅓ to ⅕ of a rotation during one rotation of the transport screw 345. With such a gear ratio, the discharge of the developer from the transport screw 345 balances with the supply of developer from the collecting member 346 to the transport screw 345.

The developer transported to the discharge opening 344*a* by the transport screw 345 is supplied to the developer container 340 by the small transport screw 173. The drive motor 174 for driving the small transport screw 173 is controlled by the control device 187 according to a detection signal of the toner-concentration detecting sensor 350 in the developer container 340. In short, the control device 187 adjusts the rotation speed of the small transport screw 173 by controlling the drive motor 174 according to an output of the toner-concentration sensor 350 for detecting a toner concentration in the developer container 340. More specifically, the control device 187 controls the drive motor 174 to rotate the small transport screw 173 at an increased speed as the toner concentration in the developer container 340 decreases.

[Embodiment 21]

Figure 52:
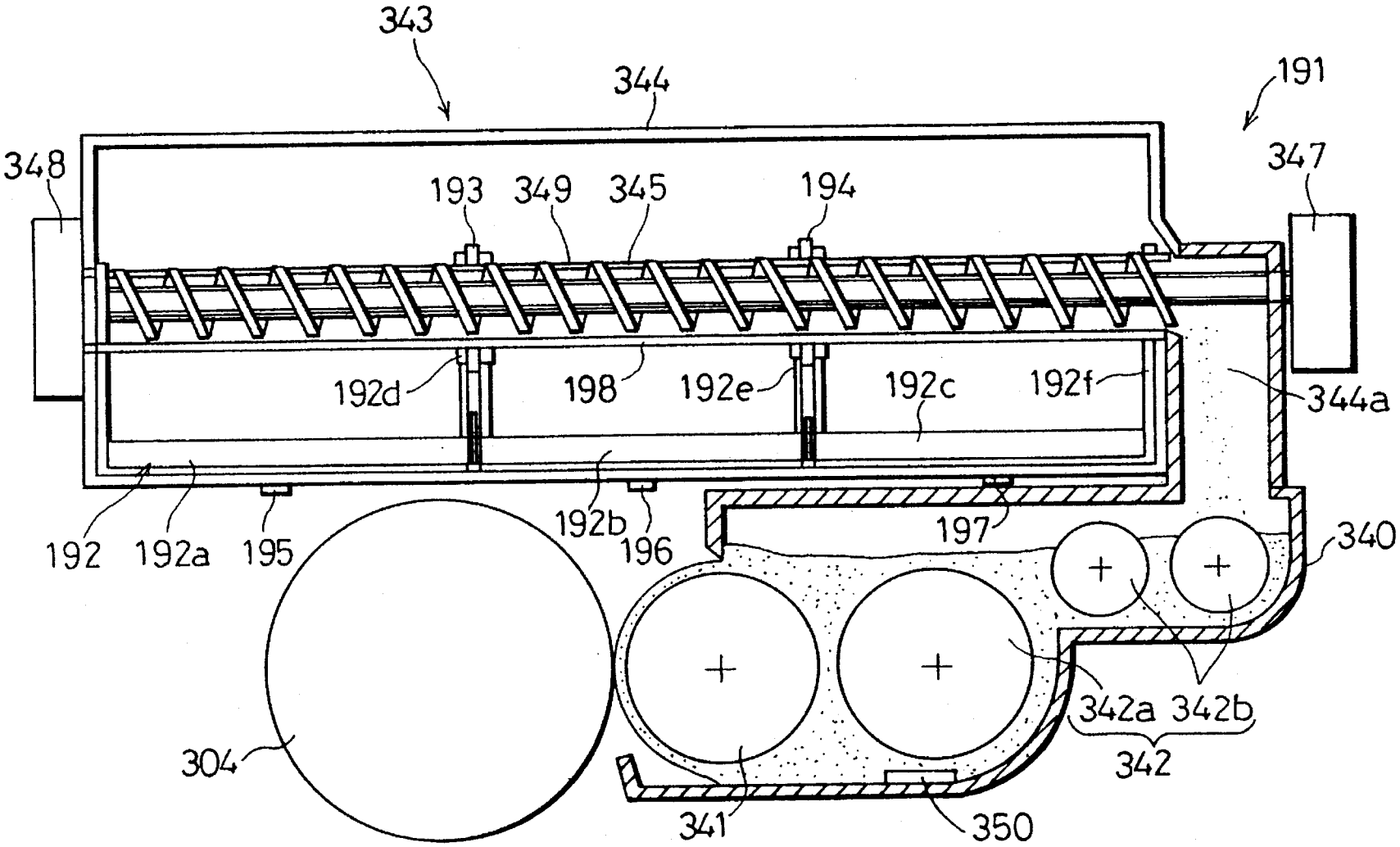
FIG. 52 illustrates a schematic structure of a developing device according to Embodiment 21 of the present invention.
Figure 53:
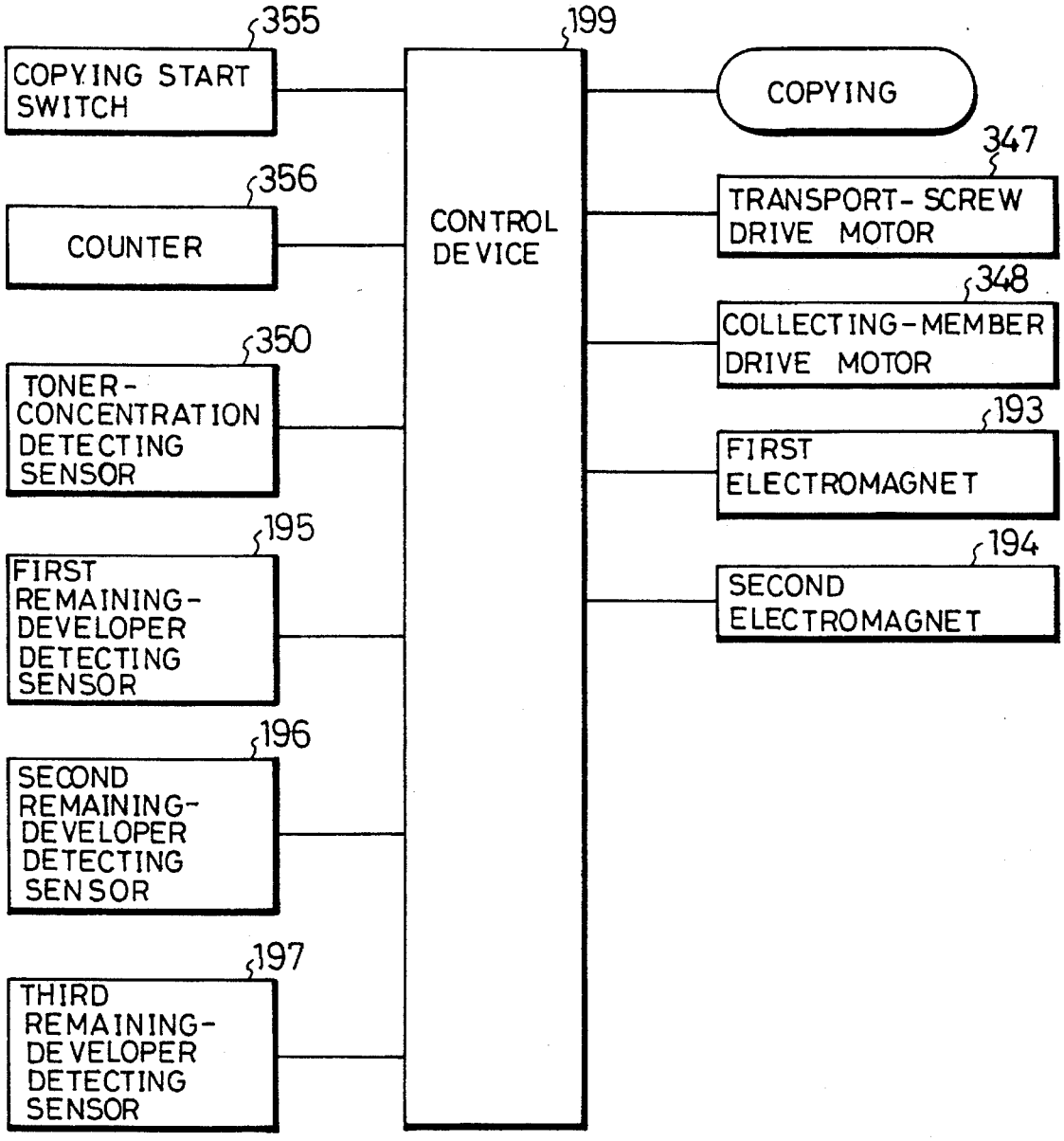
FIG. 53 is a control block diagram of a control device for controlling the driving of the developing device of FIG. 52.
Figure 54:
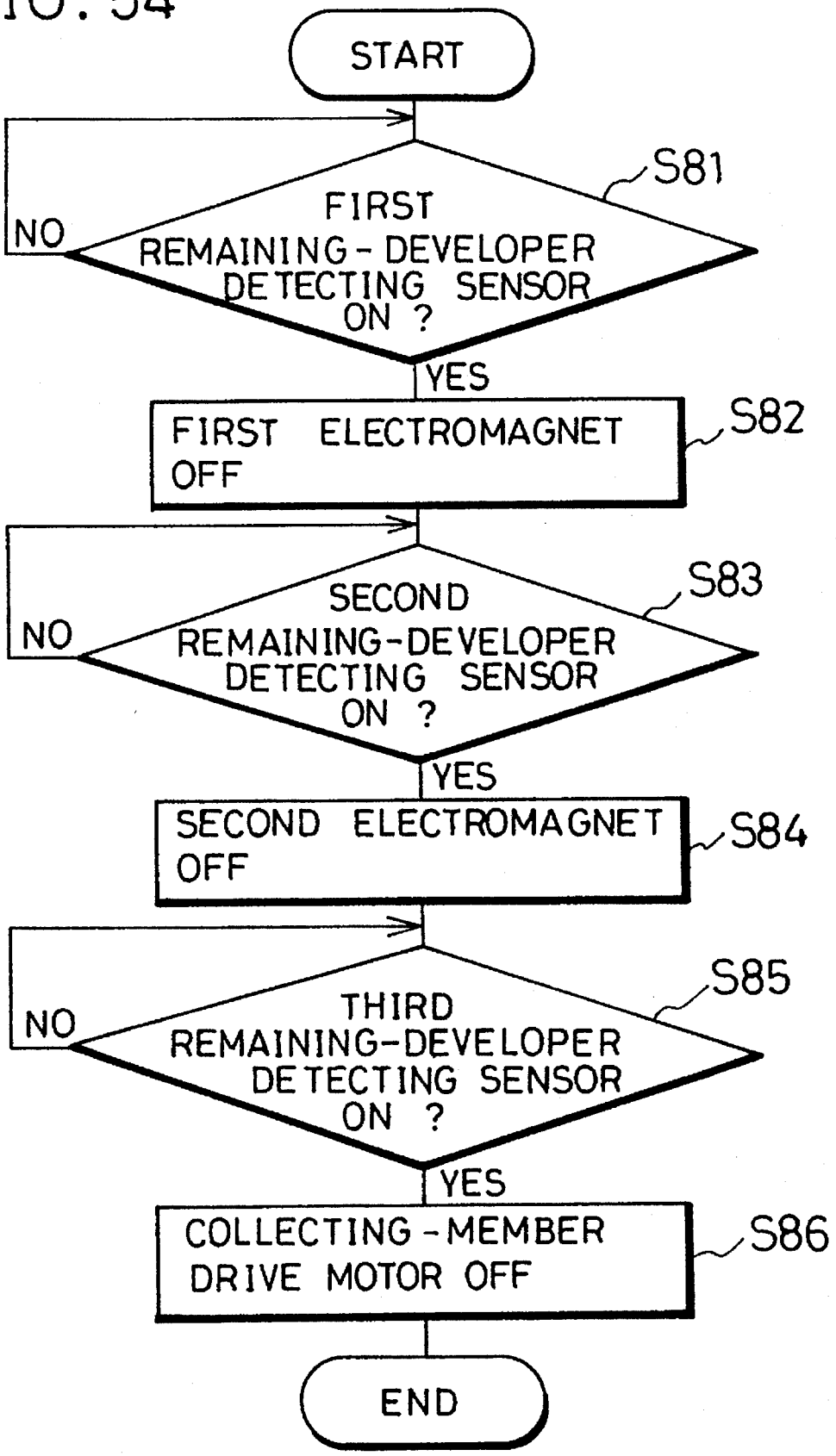
Figure 55:
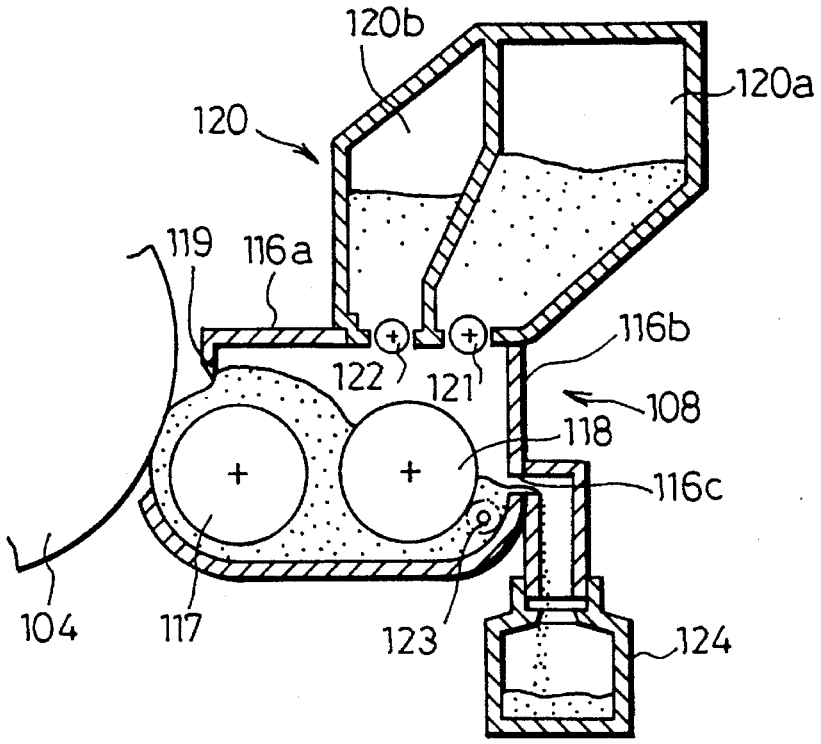
FIG. 55 PRIOR ART
FIGS. 55 and 56 illustrate conventional examples.
Figure 56:
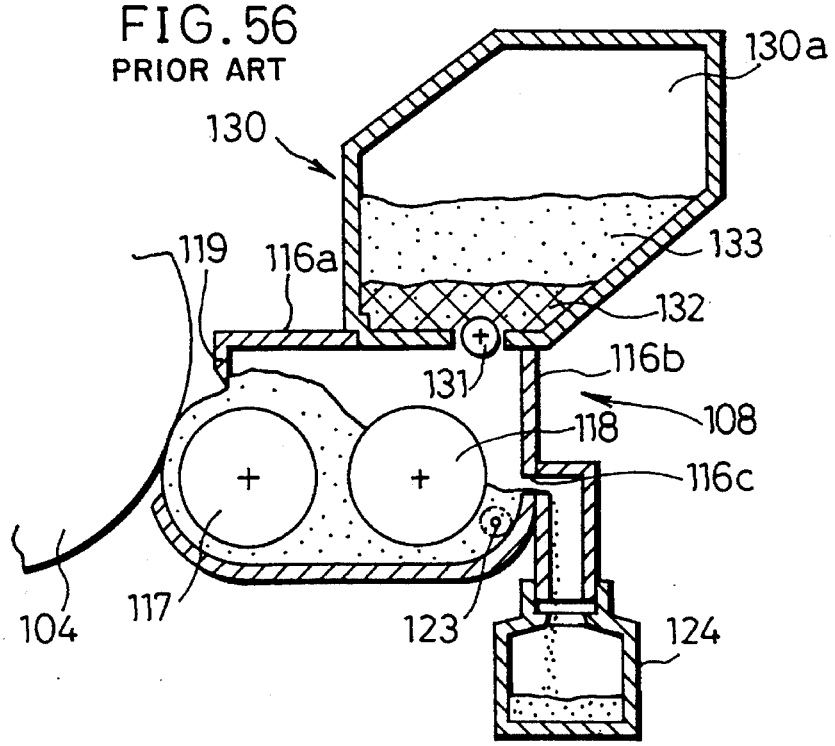
FIG. 56 PRIOR ART

The following description discusses a twenty first embodiment of the present invention with reference to FIGS. 52 to 54.

The members having the same structure and function as in the above-mentioned embodiments will be designated by the same code and their description will be omitted.

As illustrated in FIG. 52, this embodiment is applied to a developing device 191 instead of the developing device 309 shown in FIG. 28 of Embodiment 10. Then, the developer hopper 344 includes a collecting member 192 instead of the collecting member 346 of FIG. 28.

As illustrated in FIG. 52, the collecting member 192 has a first shovelling section 192*a*, a second shovelling section 192*b*, and a third shovelling section 192*c* which are separately arranged in this order from a side opposite the developer discharge opening 344*a*.

The first shovelling section 192*a* is connected to a first supporting shaft 192*d* which is connected to a transmitting shaft 198 for transmitting the driving force of a collecting-member drive motor 348 (driving force generating means) with a first electromagnet 193 (clutch means and an electromagnet clutch). Namely, the first supporting shaft 192*d* is fixed by the transmitting shaft 198 of the first electromagnet 193, or slidably mounted. Specifically, when the first electromagnet 193 is turned on, the first supporting shaft 192*d* is fixed to the transmitting shaft 198 and rotated together with the transmitting shaft 198. On the other hand, when the first electromagnet 193 is turned off, it is not rotated.

The second shovelling section 192*b* is connected to a second supporting shaft 192*e* which is connected to the transmitting shaft 198 for transmitting the driving force of the collecting-member drive motor 348 with a second electromagnet 194 (clutch means and an electromagnet clutch). Namely, the second supporting shaft 192*e* is fixed by the transmitting shaft 198 of the second electromagnet 194, or slidably mounted. Specifically, when the second electromagnet 194 is turned on, the second supporting shaft 192*e* is fixed to the transmitting shaft 198 and rotated together with the transmitting shaft 198. On the other hand, when the second electromagnet 194 is turned off, it is not rotated.

The third shovelling section 192*c* is connected to a third supporting shaft 192*f* which is connected to the transmitting shaft 198 for transmitting the driving force of the collecting-member drive motor 348. Namely, the third shovelling section 192*c* is directly driven by the collecting-member drive motor 348.

The electromagnets 193 and 194 and the collecting-member drive motor 348 are driven according to detection signals of a first remaining-developer detecting sensor 195, a second remaining-developer detecting sensor 196 and a third remaining-developer detecting sensor 197 disposed on the bottom section of the developer hopper 344 so as to correspond to the shovelling sections 192*a*, 192*b* and 192*c* of the collecting member 192.

The remaining-developer detecting sensors 195, 196, and 197 detect a remaining amount of developer in the developer hopper 344.

The electromagnets 193 and 194 and the collecting-member drive motor 348 are driven under the control of a control device 199 formed by a microcomputer shown in FIG. 53. The controlling operation of the control device 199 is explained below with reference to the flowchart shown in FIG. 54.

In this embodiment, the developer is supplied to the developer container 340 from the developer supply unit 343 on condition that a detection signal is output from the toner-concentration detecting sensor 350 in the developer container 340 shown in FIG. 52 (i.e., when the toner concentration in the developer container 340 becomes lower than a predetermined value) and the supply of developer is required.

In general, the developer in the developer hopper 344 is gradually consumed from a location farthest away from the developer discharge opening 344*a*. Therefore, the first remaining-developer detecting sensor 195, the second remaining-developer detecting sensor 196, and the third remaining-developer detecting sensor 197 are turned on in this order.

For instance, upon a detecting signal indicating a toner concentration, the transport-screw drive motor 347 and the collecting-member drive motor 348 are rotated to start the supply of the developer from the developer supply unit 343. When the remaining amount of developer in the developer supply unit 343 decreases after the supply of developer to the developer container 340, the first remaining-developer detecting sensor 195 is turned on (Step 81). Then, the first electromagnet 193 is turned off (Step 82), and the first supporting shaft 192*d* and the transmitting shaft 198 are disconnected so as to stop rotating the first shovelling section 192*a*. It is thus possible to prevent the first shovelling section 192*a* from being unnecessarily rotated when no developer is stored in the developer hopper 344.

When the remaining amount of developer in the developer supply unit 343 further decreases, the second. remaining-developer detecting sensor 196 as well as the first remaining-developer detecting sensor 195 are turned. on (Step 83). Then, the second electromagnet 194 is turned off (Step 84), and the second supporting shaft 192*e* and the transmitting shaft 198 are disconnected so as to stop rotating the second shovelling section 192*b*. In this state, since the first electromagnet 193 is turned off, it is possible to prevent the first shovelling section 192*a* and the second shovelling section 192*b* from being unnecessarily rotated when no developer is stored in the developer hopper 344.

Then, when the remaining amount of developer in the developer supply unit 343 further decreases, the first to third remaining-developer detecting sensors 195 to 197 are all turned on (Step 85), and the collecting-member drive motor 348 are stopped rotating (Step 86). In this state, since the first electromagnet 193 and the second electromagnet 192*b* are turned off, it is possible to prevent the first to third shovelling sections 192*a*, 192*b* and 192*c* from being unnecessarily rotated when no developer is stored in the developer hopper 344. Additionally, since only the transport screw 345 is driven at this time, an alarm lamp, not shown, gives the user a warning that no developer is stored in the developer hopper 344.

As described above, since the collecting member 192 is partly driven according to a remaining amount of the developer in the developer hopper 344, even when the developer hopper 344 has an increased size, it is possible to reduce the rotation resistance of the collecting-member drive motor 348. As a result, the energy consumed by the device is decreased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device for developing an electrostatic latent image, comprising:

a developer container for storing a developer including toner and carrier;

agitating means for agitating the developer in said developer container;

a developing roller for bringing the developer in said developer container agitated by said agitating means into contact with the electrostatic latent image;

developer supply means for successively supplying a supply developer including toner and carrier to said developer container; and developer discharge means for discharging the developer in said developer container as the supply developer is supplied to said developer container by said developer supply means, said developer supply means including:

a single supply-developer storage section, disposed above said developer container, for storing the supply developer including a mixture of toner and carrier;

a toner attracting member, disposed at a bottom of said supply-developer storage section, for selectively attracting toner to a surface thereof;

a carrier attracting member, disposed at a bottom of said supply-developer storage section, for selectively attracting carrier to a surface thereof; and a scraper means for scraping and bringing the toner and the carrier from the surfaces of said toner attracting member and said carrier attracting member into said developer container, wherein both said toner attracting member and said carrier attracting member are disposed at the bottom of said single supply-developer storage section.

2. The developing device according to claim 1, wherein said toner attracting member and said carrier attracting member are formed as a single rotatable roller.

3. The developing device according to claim 2, wherein said toner attracting member is a sponge member, and said carrier attracting member is a magnet member and attracts the carrier by a magnetic force.

4. The developing device according to claim 3, wherein said magnet member is a permanent magnet.

5. The developing device according to claim 3, wherein said magnet member is an electromagnet.

6. The developing device according to claim 1, wherein said toner attracting member is a sponge roller formed by shaping a sponge member into a rotatable roll, and said carrier attracting member is a magnet roller formed by shaping a magnet member into a rotatable roll, said magnet member attracting the carrier by a magnetic force.

7. The developing device according to claim 6, further comprising:

toner-concentration detecting means for detecting a toner concentration in the developer in said developer container;

first driving means for driving said magnet roller;

second driving means for driving said sponge roller; and controlling means for controlling said first and second driving means according to a detection signal of said toner-concentration detecting means.

8. The developing device according to claim 7, wherein said controlling means adjusts a rotation, speed ratio between said sponge roller and said magnet roller by controlling said first and second driving means so that a ratio of a supply amount of the toner to a supply amount of the carrier increases as the toner concentration in the developer in said developer container detected by said toner-concentration detecting means decreases.

9. The developing device according to claim 7, wherein said controlling means adjusts a ratio of rotation time between said sponge roller and said magnet roller by controlling said first and second driving means so that a ratio of a supply amount of the toner to a supply amount of the carrier increases as the toner concentration in the developer in said developer container detected by said toner-concentration detecting means decreases.

10. The developing device according to claim 6, wherein said magnet roller includes an electromagnet, and said developing device further comprises:

a power source for supplying electric power to said electromagnet;

toner-concentration detecting means for detecting a toner concentration in the developer in said developer container; and controlling means for controlling said power source to change a value of electric power to be supplied to said electromagnet according to a detection signal of said toner-concentration detecting means.

11. The developing device according to claim 10, wherein said controlling means adjusts an amount of carrier to be attracted to said magnet roller by controlling said power source so that a value of electric power to be supplied to said electromagnet is increased as the toner concentration in the developer detected by said toner-concentration detecting means increases.

12. The developing device according to claim 6, wherein said magnet roller includes a plurality of electromagnets, and said developing device further comprises:

a power source for supplying electric power to said electromagnets;

toner-concentration detecting means for detecting a toner concentration in the developer in said developer container; and controlling means for controlling said power source to change the number of said electromagnets to which electric power is to be supplied according to a detection signal of said toner-concentration detecting means.

13. The developing device according to claim 12, wherein said controlling means adjusts an amount of carrier to be attracted to said magnet roller by controlling said power source so that the number of said electromagnets to which electric power is to be supplied is increased as the toner concentration in the developer detected by said toner-concentration detecting means increases.

14. The developing device according to claim 6, wherein said magnet roller includes a plurality of electromagnets, and said developing device further comprises:

a power source for supplying electric power to each of said electromagnets separately;

toner-concentration detecting means for detecting a toner concentration in the developer in said developer container; and controlling means for controlling said power source to change the number of said electromagnets to which electric power is to be supplied and a value of electric power to be supplied to a selected electromagnet according to a detection signal of said toner-concentration detecting means.

15. The developing device according to claim 14, wherein said controlling means adjusts an amount of carrier to be attracted to said magnet roller by controlling said power source so that a total amount of electric power to be supplied to said electromagnets increases as the toner concentration in the developer detected by said toner-concentration detecting means increases.

16. A developing device for developing an electrostatic latent image, comprising:

a developer container for storing a developer including toner and carrier;

agitating means for agitating the developer in said developer container;

a developing roller for bringing the developer in said developer container agitated by said agitating means into contact with the electrostatic latent image;

developer supply means for successively supplying a supply developer including toner and carrier to said developer container; and developer discharge means for discharging the developer in said developer container as the supply developer is supplied to said developer container by said developer supply means, said developer supply means including:

a supply-developer storage section for storing the supply developer including a mixture of toner and carrier;

at least one transporting means, disposed in said supply-developer storage section, for transporting the developer deposited in a lower part of said supply-developer storage section toward an upper part thereof; and driving means for changing relative positions of said transporting means in said supply-developer storage section and said supply-developer storage section by driving at least one of said supply-developer storage section and said transporting means, for agitating the supply developer in said supply-developer storage section, wherein the toner and the carrier in said supply-developer storage section are evenly mixed by changing the relative positions of said transporting means and said supply-developer storage section by said driving means while transporting the developer deposited in the lower part of said supply-developer storage section toward the upper part thereof by said transporting means.

17. The developing device according to claim 16, wherein said transporting means includes a transport screw which is mounted in the vicinity of the lower part of said supply-developer storage section to extend to the upper part of said supply-developer storage section, and a screw driving section for driving said transport screw.

18. The developing device according to claim 16, wherein said driving means drives said transporting means to be rotated in a predetermined orbit in said supply-developer storage section.

19. The developing device according to claim 16, wherein said supply-developer storage section is rotatably mounted, and said driving means rotates said supply-developer storage section.

20. The developing device according to claim 19, wherein said supply-developer storage section is a rotatable inverted-cone-shaped container and includes a gear section attached to a periphery of the upper part thereof, and said driving means includes a driving gear which meshes with said gear section of said supply-developer storage section, and a drive motor for rotating said driving gear.

21. The developing device according to claim 16, wherein said supply-developer storage section is an inverted-cone-shaped container, said driving means includes a transport screw which is mounted in the vicinity of the lower part of said supply-developer storage section to extend to the upper part along an inner wall of said supply-developer storage section, and a screw driving section attached to an upper end of said transport screw for driving said transport screw, and said driving means includes a supporting member for supporting said screw driving section of said transporting means, and a drive motor for rotating said transporting means in a predetermined orbit by rotating said supporting member on an end of said supporting member.

22. A developing device for developing an electrostatic latent image, comprising:

a developer container for storing a developer including toner and carrier;

agitating means for agitating the developer in said developer container;

a developing roller for bringing the developer in said developer container agitated by said agitating means into contact with the electrostatic latent image;

developer supply means for successively supplying a supply developer including toner and carrier to said developing container; and developer discharge means for discharging the developer in said developer container as the supply developer is supplied to said developer container by said developer supply means, said developer supply means including:

a supply-developer storage section for storing the supply developer including a mixture of toner and carrier;

developer transporting means, disposed in said supply-developer storage section, for transporting the developer in said supply-developer storage section to said developer container; and developer providing means, provided in said supply-developer storage section, for agitating the developer while rotating around the circumference of said developer transporting means and providing the developer in said supply-developer storage section to said developer transporting means.

23. The developing device according to claim 22, wherein said developer transporting means includes:

a developer receiving section, disposed in a longitudinal direction of said supply-developer storage section with a predetermined space from a bottom of said supply-developer storage section, for receiving the developer provided by said developer providing means; and a developer transporting section for transporting the developer supplied to said developer receiving section to said developer container, and wherein said developer providing means includes a collecting member having a shovelling section arranged in a longitudinal direction of said supply-developer storage section, said collecting member collecting the developer remaining in a lower part of said supply-developer storage section by said shovelling section and providing the developer to said developer receiving section while rotating around said developer receiving section.

24. The developing device according to claim 23, wherein the bottom portion of said supply-developer storage section is formed so that a cross section thereof cut across a direction orthogonal to a transport direction of the developer has a shape of an arc corresponding to an orbit of said collecting member, and said shovelling section of said collecting member is moved along the bottom portion of said supply-developer storage section.

25. The developing device according to claim 24, wherein the bottom portion of said supply-developer storage section is shaped into an arc of at least 180° so that a center point of the bottom portion coincides with the midpoint of the arc.

26. The developing device according to claim 23, wherein said collecting member includes a supporting shaft which supports said shovelling section and orbits said developer receiving section, and said shovelling section is supported by said supporting shaft and swings around said supporting shaft through a predetermined angle range so as to prevent the developer collected by said collecting member from being dropped when said collecting member is rotated upward.

27. The developing device according to claim 26, further comprising a weight, attached to an edge of said shovelling section, for adjusting the center of gravity so that, when said shovelling section comes near a top of an orbit in which said shovelling section rotates, an angle between said shovelling section and said supporting shaft is varied to drop the collected developer.

28. The developing device according to claim 23, wherein said developer supply means is divided into a plurality of portions in a longitudinal direction of said supply-developer storage section, and the number of collecting members for collecting the developer in a downstream portion of a developer transport direction of said developer transporting means is larger than the number of collecting members for collecting the developer in an upstream portion of the developer transport direction.

29. The developing device according to claim 23, wherein an opening is formed on a front face of said shovelling section to extend to a rear face thereof, and wherein said shovelling section includes a resilient shutter member which is mounted on the rear face of said shovelling section, covers said opening to prevent the developer from going through said opening when a pressure which is lower than a predetermined value is applied to said shovelling section, and is bent to uncover said opening when a pressure which is higher than the predetermined value is applied to said shovelling section.

30. The developing device according to claim 29, wherein said shutter member is a plate-like polyethylene terephthalate.

31. The developing device according to claim 23, wherein an opening is formed on a front face of said shovelling section to extend to a rear face thereof, and wherein said shovelling section further includes:

a shutter mechanism for covering and uncovering said opening so as to vary an amount of developer to be collected by said collecting member; and developer-level detecting means for detecting whether a developer level in the developer container becomes lower than an installation position of said developer transporting means, said shutter mechanism closes said opening when said developer-level detecting means detects that the developer level in the developer container becomes lower than the installation position of said developer transporting means and opens said opening when the developer level in the developer container is higher than the installation position of said developer transporting means.

32. The developing device according to claim 31, wherein said shutter mechanism includes:

a door member which is attached to the rear face of said shovelling section and slides to open and close said opening; and driving means for driving said door member to slide according to an output of said developer-level detecting means.

33. The developing device according to claim 23, wherein said collecting member includes:

a supporting shaft which supports said shovelling section and orbits said developer receiving section; and a spring, mounted on a junction between said supporting shaft and said shovelling section, for pushing said shovelling section toward an inner face of said supply-developer storage section, said collecting member being flexible due to a stretching motion of said spring and being stretched and retracted according to a shape of the inner face of said supply-developer storage section.

34. The developing device according to claim 33, wherein a rotatable roller is mounted on said shovelling section in contact with the inner face of said supply-developer storage section.

35. The developing device according to claim 23, wherein said shovelling section includes a plate-like resilient member which protrudes from an edge of said shovelling section and comes into contact with an inner face of said supply-developer storage section.

36. The developing device according to claim 35, wherein said resilient member is polyethylene terephthalate.

37. The developing device according to claim 35, wherein said resilient member has a thickness within a range between 0.5 mm and 3.0 mm.

38. The developing device according to claim 35, wherein a dimension of said protruded portion of said resilient member stretched from the edge of said shovelling section is in a range between 5 mm and 10 mm.

39. The developing device according to claim 23, wherein said developer receiving section and said developer transporting section are tilted so that a developer discharge side becomes lower than the opposite side in a longitudinal direction of said supply-developer storage section and that the developer is efficiently transported because of its own weight.

40. The developing device according to claim 23, wherein said developer transporting section is a transport screw having a spiral blade attached around said rotation shaft, and said developer transport screw is formed so that a screw pitch thereof increases from the developer discharge side toward the opposite side.

41. The developing device according to claim 23, wherein said developer receiving section and said. developer transporting section have increased sizes toward a side opposite to the developer discharge side.

42. The developing device according to claim 22, wherein said developer transporting means includes:

a developer receiving section, disposed in a longitudinal direction of said supply-developer storage section with a predetermined space from a bottom of said supply-developer storage section, for receiving the developer provided by said developer providing means; and a developer transporting section for transporting the developer supplied to said developer receiving section toward said developer container, and wherein said developer providing means includes:

a collecting member which is formed to spiral around said developer receiving section and said developer transporting section, said collecting member collecting the developer deposited in a lower part of said supply-developer storage section and providing the developer to said developer receiving section while being rotated around said developer receiving section and said developer transporting section.

43. The developing device according to claim 42, wherein said collecting member has an increasing spiral width toward a side opposite the developer discharge side so that an increased amount of developer is collected toward the side opposite the developer discharge side.

44. The developing device according to claim 23, wherein said developer transporting section is a transport screw having a rotation shaft and a spiral blade attached around said rotation shaft, and said developing device further includes driving means for rotating said transport screw and said collecting member, said driving means comprising:

a first gear attached to said rotation shaft of said transport screw;

a second gear which interacts with a rotation of said collecting member; and a drive motor for simultaneously rotating said first and second gears.

45. The developing device according to claim 23, wherein said developer transporting section includes:

a first transport screw for transporting the supply developer in said supply-developer storage section toward a developer discharge opening formed therein; and a second transport screw, mounted in said developer discharge opening, for supplying the developer to said developer container from said developer discharge opening, and wherein said developing device further includes:

developer-container driving means for driving said agitating means and said developing roller in said developer container;

driving-force transmitting means for transmitting a driving force of said developer-container driving means to said first transport screw and to said collecting member; and second transport-screw driving means for rotating said second transport screw.

46. The developing device according to claim 45, wherein said driving-force transmitting means includes:

a first driving-force transmitting section for transmitting the driving force of said developer-container driving means to said first transport screw; and a second driving-force transmitting section for transmitting a rotating force of said first transport screw to said collecting member.

47. The developing device according to claim 46, further comprising:

toner-concentration detecting means for detecting a toner concentration in the developer in said developer container; and controlling means for controlling said second transport-screw driving means according to a detection signal of said toner-concentration detecting means.

48. The developing device according to claim 23, wherein said developer providing means includes a plurality of said collecting members divided in a longitudinal direction of said supply-developer storage section, and said developing device further comprising:

a driving-force generating section for generating a driving force for rotating said collecting members;

clutch means for transmitting and interrupting transmission of the driving force of said driving-force generating means to said collecting means;

remaining-developer detecting means, disposed on points corresponding to installation positions of said collecting members in said supply-developer storage section, for detecting whether an amount of developer remaining at each of said points becomes less than a predetermined amount and almost zero; and controlling means for controlling said clutch means to stop rotating a collecting member corresponding to a point where a remaining amount of the developer is almost zero.

49. The developing device according to claim 48, wherein said clutch means includes:

a transmission shaft for transmitting the driving force of said driving-force generating means; and an electromagnetic clutch for connecting and disconnecting said transmission shaft to and from said collecting members.

50. The developing device according to claim 22, further comprising:

toner-concentration detecting means for detecting a toner concentration in the developer in said developer container; and controlling means for adjusting an amount of developer to be supplied to said developer container by controlling said developer transporting means according to a detection signal of said toner-concentration detecting means.

51. The developing device according to claim 22, further comprising:

toner-concentration detecting means for detecting a toner concentration in the developer in said developer container; and controlling means for adjusting an amount of developer to be supplied to said developer container by controlling said developer transporting means according to a detection signal of said toner-concentration detecting means, and adjusting an amount of developer to be supplied to said developer transporting means by controlling said developer providing means according to the detection signal.

52. The developing device according to claim 22, further comprising:

remaining-developer detecting means, disposed on the bottom of said supply-developer storage section, for detecting whether an amount of developer remaining in said supply-developer storage section becomes less than a predetermined amount and almost zero; and controlling means for controlling said developer providing means to stop operating during a time in which said remaining-developer detecting means detects that the remaining amount of the developer is almost zero.

53. The developing device according to claim 52, further comprising warning means for warning that an amount of developer remaining in said supply-developer storage section becomes almost zero, wherein said controlling means operates said warning means when said remaining-developer detecting means detects that the remaining amount of the developer is almost zero.

54. The developing device according to claim 23, further comprising:

developer-level detecting means for detecting whether a developer level in said supply-developer storage section becomes lower than an installation position of said developer transporting means; and controlling means for controlling said developer providing means to operate during a time in which said developer-level detecting means detects that the developer level is lower than the installation position of said developer transporting means, and controlling said developer providing means to stop operating for other time.

55. The developing device according to claim 23, further comprising:

developer-level detecting means for detecting whether a developer level in said supply-developer storage section becomes lower than an installation position of said developer transporting means;

remaining-developer detecting means, disposed on the bottom of said supply-developer storage section, for detecting whether an amount of developer remaining in said supply-developer storage section becomes less than a predetermined amount and almost zero; and controlling means for controlling said developer providing means to operate during a time in which said developer-level detecting means detects that the developer level is lower than the installation position of said developer transporting means and in which said remaining-developer detecting means does not detect that the remaining amount of the developer is almost zero, and controlling said developer providing means to stop operating for other time.

56. The developing device according to claim 23, wherein said supply-developer storage section includes a door for opening and closing a developer supply opening formed on a top of said supply-developer storage section, and wherein said developing device further comprises:

door-movement detecting means for detecting whether said door opens or closes said developer supply opening; and controlling means for controlling said developer providing means to operate during a time in which said door-movement detecting means detects that said door is open.

* * * * *